US005369958A

United States Patent [19]

Kasai et al.

[11] Patent Number: 5,369,958

[45] Date of Patent: Dec. 6, 1994

[54] AIR CONDITIONER

[75] Inventors: Tomohiko Kasai; Tatsuo Ono; Takashi Nakamura, all of Wakayama, Japan

[73] Assignee: Mitsubishi Denki Kabushiki Kaisha, Tokyo, Japan

[21] Appl. No.: 135,625

[22] Filed: Oct. 14, 1993

[30] Foreign Application Priority Data

Oct. 15, 1992 [JP] Japan ..... 4-277138
Oct. 20, 1992 [JP] Japan ..... 4-281347

[51] Int. Cl.[5] ..... F25B 7/00; F25B 1/10

[52] U.S. Cl. ..... 62/158; 62/196.3; 62/175; 62/510

[58] Field of Search ..... 62/158, 175, 510, 468, 62/196.3

[56] References Cited

U.S. PATENT DOCUMENTS 4,411,141 10/1983 Hara .
4,586,351 5/1986 Igarashi et al. .
5,094,598 3/1992 Amata et al. ..... 62/510 X
5,236,311 8/1993 Lindstrom ..... 62/510 X
5,245,837 9/1993 Kitamoto ..... 62/175

FOREIGN PATENT DOCUMENTS 62-33113 8/1987 Japan .
64-70657 3/1989 Japan .
3-152351 6/1991 Japan .

*Primary Examiner*—William E. Wayner
*Attorney, Agent, or Firm*—Oblon, Spivak, McClelland, Maier & Neustadt

[57] ABSTRACT

An air conditioner in which, when a first compressor is being operated and a second compressor is being stopped, liquid refrigerant does not flow into the second compressor even in a state of wet vapor suction, a decrease in lubricating oil in the second compressor or a decline in its concentration are not experienced, and breakage of the second compressor does not occur owing to faulty lubrication when the second compressor is started. In addition, to obtain an air conditioner which does not lapse into a wasteful shortage of cooling and heating capabilities when the air conditioner is not in the state of wet vapor suction, by reliably detecting the presence or absence of the state of wet vapor suction. In the air conditioner, the first compressor and the second compressor are connected together by an equalizing pipe. A bypass passage which connects together a discharge pipe and a suction pipe of the second compressor is provided.

13 Claims, 39 Drawing Sheets

AIR CONDITIONER

BACKGROUND OF THE INVENTION

1. Field of the Invention

The present invention relates to an air conditioner in which two compressors are connected in parallel with a refrigerant circuit of one system.

2. Description of Relevant Art

As a conventional apparatus of this type, one shown in FIG. 53A (or 53B) is known. In the drawing, reference character A denotes a heat source unit, and B denotes an indoor unit. Reference numeral 1 (or 201) denotes a first compressor of a low-pressure shell type; 2 (or 202), a second compressor of the low-pressure shell type; and 3 (or 203), an equalizing pipe for connecting together the shell of the first compressor 1 and the shell of the second compressor 2, the equalizing pipe 3 being disposed at a position sufficiently higher than a minimum oil level for properly effecting the lubrication of the compressors. Numeral 4 denotes a discharge pipe of the first compressor 1; 5, a discharge pipe of the second compressor 2; 6, a common discharge pipe provided after the discharge pipes 4, 5 converge; 7 (or 212), a suction pipe of the first compressor 1; 8 (or 213), a Auction pipe of the second compressor 2; 9, a common suction pipe before branching into the suction pipes 7, 8; 10 (or 204), an oil separator provided in the common discharge pipe 6 and having a shell 10*a*, an inlet pipe 10*b*, an outlet pipe 10*c*, and an oil return pipe 10*d*; 11 (or 205), a four-way changeover valve; 12 (or 206), a heat source unit-side heat exchanger; 15 (or 209), an accumulator provided in a branching portion in which the common suction pipe 9 branches into the suction pipes 7, 8; 22, an oil-returning bypass passage for connecting the oil return pipe 10d of the oil separator 10 and the common suction pipe 9; 23 (or 210), a solenoid on-off valve provided midway in the oil-returning bypass passage 22; and 24 (or 211), a capillary tube provided in parallel with the solenoid on-off valve 23. Numeral 16 denotes a U-pipe provided in the accumulator 15 and corresponding to the suction pipe 8, and numeral 17 denotes a U-pipe provided in the accumulator 15 and corresponding to the suction pipe 8. Numeral 18 denotes a bypass hole provided in the U-pipe 16 and designed to prevent the first compressor 1 from becoming damaged by temporarily sucking lubricating oil and a liquid refrigerant 25 accumulated in the U-pipe 16 at the time of the starting of the first compressor 1. Numeral 19 denotes a bypass hole provided in the U-pipe 17 and designed to prevent the second compressor 2 from becoming damaged as the second compressor 2 temporarily sucks lubricating oil and the liquid refrigerant 25 accumulated in the U-pipe 17 at the time of the starting of the second compressor 2. Numeral 20 denotes an oil return hole provided in the U-pipe 16 for gradually sucking the lubricating oil and the liquid refrigerant 25 accumulated in the bottom of the accumulator 15 and returning the same to the first compressor 1. Numeral 21 denotes an oil return hole provided in the U-pipe 17 for gradually sucking the lubricating oil and the liquid refrigerant 25 accumulated in the bottom of the accumulator 15 and returning the same to the second compressor 2. The heat source unit A is arranged as described above. Numeral 13 (or 207) denotes a throttling device; 14, an indoor-side heat exchanger; and B, an indoor unit comprised of the aforementioned throttling device 13 and the indoor-side heat exchanger 14. Numeral 26 denotes a first connecting pipe having one end connected to the heat source unit A by the heat source unit-side heat exchanger 12 and the other end connected to the indoor unit B by the throttling device 13, while numeral 27 denotes a second connecting pipe having one end connected to the heat source unit A by the four-way changeover valve 11 and the other end connected to the indoor unit B by the indoor-side heat exchanger 14. In the drawing, the solid-line arrows indicate the direction of flow of the refrigerant during cooling operation, while the broken-line arrows indicate the direction of flow of the refrigerant during heating operation.

Next, a description will be given of the operation during cooling operation. The high-temperature, high-pressure gas refrigerant discharged from the first compressor 1 or the second compressor 2 passes through the oil separator 10 and the four-way changeover valve 11, and flows into the heat source unit-side heat exchanger 12 where the gas refrigerant radiates heat and condenses into a high-pressure liquid refrigerant. The pressure of this liquid refrigerant is reduced by the throttling device 13, and flows into the indoor-side heat exchanger 14 as a low-pressure gas-liquid two-phase refrigerant. By absorbing heat here, the refrigerant evaporates, flows into the accumulator 15 via the four-way changeover valve 11, passes thorough the U-pipes 16, 17 and the suction pipes 7, 8, and returns to the first compressor 1 or the second compressor 2.

At this time, as for the lubricating oil which has flowed out together with the refrigerant from the first compressor 1 or the second compressor 2, a major portion of it is separated by the oil separator 10, and is accumulated in the shell 10*a* of the oil separator 10. A portion of the accumulated lubricating oil, together with the gas refrigerant in the oil separator 10, is constantly sent to the accumulator 15 via the common suction pipe 9 by the capillary tube 24. The remaining lubricating oil in the shell 10*a* of the oil separator 10 is sent to the accumulator 15 via the common suction pipe 9 as the solenoid on-off valve 23 is opened. The lubricating oil which was not separated by the oil separator 10 is sent together with the refrigerant to the accumulator 15 via the four-way changeover valve 11, the heat source unit-side heat exchanger 12, the throttling device 13, the indoor-side heat exchanger 14, and the four-way changeover valve 11. The lubricating oil which has entered the accumulator 15 is accumulated in the bottom of the accumulator 15, and a portion of it flows into the U-pipes 16, 17 through the oil return holes 20, 21, passes through the suction pipes 7, 8, and returns to the first compressor 1 or the second compressor 2.

Since the first and second compressors 1, 2 are of the low-pressure shell type, the following relationships hold among the pressure $P_{S0}$ at a branching portion where the common suction pipe 9 branches into the suction pipes 7, 8, the pressure $P_{S1}$ within the shell of the first compressor 1, and the pressure $P_{S2}$ within the shell of the second compressor 2:

$$P_{S1}=P_{S0}-\Delta P_{S1}$$

$$P_{S2}=P_{S0}-\Delta P_{S2}$$

where $\Delta P_{S1}$ is a pressure loss from the branching portion where the common suction pipe 9 branches into the suction pipes 7, 8 to the first compressor 1, while $\Delta P_{S2}$ is a pressure loss from the branching portion where the common suction pipe 9 branches into the suction pipes 7, 8 to the second compressor 2, and the following relationships hold:

$$\Delta P_{S1}=z_1\, r_g\, V_{12}/2$$

$$\Delta P_{S2}=z_2\, r_g\, V_{22}/2$$

$r_g$: concentration of the gas refrigerant $V_1$: flow rate of the gas refrigerant flowing through the suction pipe 7

$V_2$: flow rate of the gas refrigerant flowing through the suction pipe 8

$z_1$: constant representing channel resistance from the branching portion where the common suction pipe 9 branches into the suction pipes 7, 8 up to the first compressor 1

$z_2$: constant representing channel resistance from the branching portion where the common suction pipe 9 branches into the suction pipes 7, 8 up to the second compressor 2

Accordingly, a pressure difference $\Delta P_{S12}$ ($P_{S1}-P_{S2}$), which is shown below, takes place in the shells of the first compressor 1 and the second compressor 2.

$$\Delta P_{S12}=(-z_1\, V_{12}+z_2\, V_{22})\, r_g/2$$

Therefore, the pressure difference $\Delta P$ which occurs at both ends of the equalizing pipe 3 becomes as shown below. It should be noted, however, that it is assumed that both ends of the equalizing pipe are at substantially the same height.

$$\Delta P=\Delta P_{S12}+r_1\, g\, (h_1-h_2)$$

$r_1$: concentration of a mixture of the lubricating oil and the liquid refrigerant g: gravitational acceleration $h_1$: liquid level of the first compressor 1 with respect to the connecting portion between the shell of the first compressor 1 and the equalizing pipe 3 (when the liquid level is lower than the connecting portion, a setting is provided such that $h_1=0$)

$h_2$: liquid level of the second compressor 2 with respect to the connecting portion between the shell of the second compressor 2 and the equalizing pipe 3 (when the liquid level is lower than the connecting portion, a setting is provided such that $h_2=0$)

That is, when $\Delta P>0$, the gas refrigerant and a mixed liquid (a mixed liquid of the lubricating oil and the liquid refrigerant) flow from the first compressor 1 to the second compressor 2 through the equalizing pipe 3. Meanwhile, when $\Delta P<0$, the gas refrigerant and the mixed liquid (the mixed liquid of the lubricating oil and the liquid refrigerant) flow from the second compressor 2 to the first compressor 1 through the equalizing pipe 3.

In addition, when $\Delta P>0$, the liquid level of the mixed liquid (the mixed liquid of the lubricating oil and the liquid refrigerant) in the first compressor 1 drops until it reaches the position of the equalizing pipe 3, but it does not drop further below that position. Hence, if the concentration of the lubricating oil is high, the lubrication of the second compressor 2 is effected properly. Thus, a refrigeration cycle during cooling is formed.

Next, a description will be given of the operation during heating operation. The high-temperature, high-pressure gas refrigerant discharged from the first compressor 1 or the second compressor 2 passes through the oil separator 10 and the four-way changeover valve 11, and flows into the indoor-side heat exchanger 14 where the gas refrigerant radiates heat and condenses into a high-pressure liquid refrigerant. The pressure of this liquid refrigerant is reduced by the throttling device 13, and flows into the heat source unit-side heat exchanger 12 as a low-pressure gas-liquid two-phase refrigerant. By absorbing heat here, the refrigerant evaporates, flows into the accumulator 15 via the four-way changeover valve 11, passes thorough the U-pipes 16, 17 and the suction pipes 7, 8, and returns to the first compressor 1 or the second compressor 2.

At this time, as for the lubricating oil which has flowed out together with the refrigerant from the first compressor 1 or the second compressor 2, a major portion of it is separated by the oil separator 10, and is accumulated in the shell 10*a* of the oil separator. A portion of the accumulated lubricating oil, together with the gas refrigerant in the shell 10*a* of the oil separator, is constantly sent to the accumulator 15 via the common suction pipe 9 by the capillary tube 24. The remaining lubricating oil in the shell 10*a* of the oil separator 10 is sent to the accumulator 15 via the common suction pipe 9 as the solenoid on-off valve 23 is opened. The lubricating oil which was not separated by the oil separator 10 is sent together with the refrigerant to the accumulator 15 via the four-way changeover valve 11, the indoor-side heat exchanger 14, the throttling device 13, the heat source unit-side heat exchanger 12, and the four-way changeover valve 11. The lubricating oil which has entered the accumulator 15 is accumulated in the bottom of the accumulator 15, and a portion of it flows into the U-pipes 16, 17 through the oil return holes 20, 21, passes through the suction pipes 7, 8, and returns to the first compressor 1 or the second compressor 2.

Since the flow through the equalizing pipe 3 is utterly the same as during cooling, description thereof will be omitted here. Thus, a refrigeration cycle during heating is formed.

The flow-rate of a mixed fluid flowing through the equalizing pipe 3 is calculated in simple form by the following formula:

$$G_1=a(\Delta p/r)^{\frac{1}{2}}$$

$G_1$: flow rate of a mixed liquid of refrigerant and lubricating oil flowing through the equalizing pipe 3

$\alpha$: flow coefficient $\rho$: concentration of the mixed liquid $\Delta p$: differential pressure across the equalizing pipe (=difference between internal pressures of compressor shells)

With such a conventional air conditioner, after the power supply of the air conditioner is turned on, in a state in which, of the two compressors 1 and 2, the compressor 1 is being operated and the compressor 2 is being stopped, when the compressor 2 is started after the running capacity of the compressor 1 has reached a certain level, the compressor 2 is started as it is.

Then, a description will be given of the case where the liquid refrigerant is accumulated in the accumulator 15 and of the operation of the refrigerant system at that time. When the first compressor 1 is started in a state in which both the first compressor 1 and the second compressor 2 are being stopped, since the evaporation temperature of the refrigerant in the evaporator (the indoor-side heat exchanger 14 during cooling operation and the heat source unit-side heat exchanger 12 during heating operation) has not been sufficiently lowered, the unevaporated liquid refrigerant temporarily flows into the common suction pipe 9. However, since the accumulator 15 is provided, the liquid refrigerant which has been sucked in the state of wet vapor does not reach the first compressor 1 or the second compressor 2, is temporarily stored in the accumulator 15, flows into the U-pipe 16 through the oil return hole 20 together with the lubricating oil accumulated here, and returns gradually to the first compressor 1 via the suction pipe 7. For this reason, the first compressor 1 is prevented from being damaged by the temporary wet vapor suction at the time of starting. In addition, since the quantity of wet vapor sucked at that time is not very large, the liquid refrigerant in the accumulator 15 is removed in a relatively short time.

In addition, when the first compressor 1 is started in a state in which the both the first and second compressors 1 and 2 have been stopped for a long time, the first compressor 1 is started in the state in which a large quantity of refrigerant lies inside the shells of the first and second compressors 1 and 2 as a liquid refrigerant. In this case, the liquid refrigerant held up inside the shell of the first compressor 1 is discharged in the form of a saturated gas or partially in the liquid state as it is, and the liquid refrigerant flows into the oil separator 10 via the discharge pipe 4 and the common discharge pipe 6. Since the discharge pipe 4, the common discharge pipe 6, and the oil separator 10 have become cool by being cooled by the outside air during stopping for a long time, the saturated gas refrigerant discharged from the first compressor 1 is cooled, condensed and liquefied. In addition, since the first compressor 1 is operated and the second compressor 2 remains stopped, the pressure within the shell of the first compressor 1 is lower than the pressure within the shell of the second compressor 2, and the liquid refrigerant held up inside the shell of the second compressor 2 is supplied to the first compressor 1 via the equalizing pipe 3. In the same way as the liquid refrigerant held up inside the shell of the first compressor 1, this liquid refrigerant is discharged in the form of a saturated gas or partially in the liquid state as it is, and this liquid refrigerant flows into the oil separator 10 via the discharge pipe 4 and the common discharge pipe 6, while the saturated gas refrigerant is cooled, condensed and liquefied. In the oil separator 10, a major portion of the liquid refrigerant is separated, and flows into the common suction pipe 9 via the solenoid on-off valve 23 since the solenoid on-off valve 23 is open for a fixed period of time during starting. However, since the accumulator 15 is provided, the liquid refrigerant which has been sucked in the state of wet vapor does not reach the first compressor 1 or the second compressor 2, is temporarily stored in the accumulator 15, flows into the U-pipe 16 through the oil return hole 20 together with the lubricating oil accumulated here, and returns gradually to the first compressor 1 via the suction pipe 7. For this reason, the first compressor 1 is prevented from being damaged by the temporary, but a large quantity of, wet vapor suction at the time of starting after stopping for a long time. In addition, since the quantity of wet vapor sucked at that time is very large, the liquid refrigerant in the accumulator 15 is removed after the lapse of a relatively long time.

During the cooling operation the first connecting pipe 26 is in the high-pressure liquid single phase or in the gas-liquid two-phase state in which the dryness is very small, but during the heating operation the first connecting pipe 26 is in the gas-liquid two-phase state in which the dryness is 0.1 to 0.2. Hence, the average concentration of the refrigerant in the first connecting pipe 26 is much greater during the cooling operation than during the heating operation, so that the quantity of refrigerant distributed in the first connecting pipe 26 is larger during the cooling operation. Accordingly, in a case where the locations of installation of the heat source unit A and the indoor unit B are distant from each other and the first connecting pipe 26 is long, the total quantity of refrigerant required during the cooling operation becomes greater than the total quantity of refrigerant required during the heating operation. Since the quantity of refrigerant charged in the system is normally determined by the operation in which the total quantity of refrigerant required becomes maximum, excess refrigerant is produced during the heating operation by a portion in which the total quantity of refrigerant required is smaller than during the cooling operation. This excess refrigerant is distributed in the accumulator 15.

In addition, if the first connecting pipe 26 is short, excess refrigerant is produced in the case of a chargeless system in which the refrigerant is not added when the setup work of the system is carried out by fixing the quantity of refrigerant charged in the system irrespective of the length of the first connecting pipe 26, i.e., by setting the quantity of refrigerant charged in the system to be the total quantity of refrigerant required when the length of the first connecting pipe 26 is the largest irrespective of the length of the first connecting pipe 26. This excess refrigerant is distributed in the accumulator 15.

As described above, at the time when the power is turned on, there is a high possibility that a large quantity of refrigerant was held up in the compressors before then. When the compressor 1 is started, the lubricating oil is also liable to flow out together with the liquid refrigerant owing to foaming at the time of starting, so that the quantity of lubricating oil in the compressor 1 becomes small. When only the compressor 1 is being operated, since the internal pressure of the shell of the compressor 2 being stopped is higher than the internal pressure of the shell of the compressor 1 being operated, the lubricating oil in the compressor 2 is supplied together with the refrigerant to the shell in the compressor 1. In addition, since oil is not returned from the accumulator 15 to the compressor 2 being stopped, the level of the mixed liquid of the lubricating oil and the refrigerant in the compressor 2 drops to the vicinity of the height of the equalizing pipe 3.

When the compressor 2 is started in such a stopped state, the refrigerant undergoes foaming in the compressor 2 due to a sudden drop in the internal pressure of the shell during starting, the lubricating oil in the compressor 2 is liable to be discharged together with the refrigerant, and the pressure difference across the equalizing pipe 3 becomes small or is reversed. Hence, the quantity of lubricating oil supplied to the compressor 1 through the equalizing pipe 3 decreases.

In addition, an observation is made of the compressor 2 which is started, in a case where its running capacity is smaller than that of the compressor 1 already in operation, the relative magnitude of the pressure within the shell is higher in the case of the compressor 2. As a result, when the compressor 2 is started, the liquid level in the shell of the compressor 2 rises with foaming, and even though the liquid level may be lower than the equalizing pipe 3 during stopping, the liquid level rises above the height of the equalizing pipe after starting, so that the mixed liquid of the refrigerant and the lubricating oil is liable to flow out from the equalizing pipe 3 toward the compressor 1.

In a case where the running capacity of the compressor 2 which is started is higher than that of the compressor 1 being operated, the internal pressure of the shell becomes higher in the case of the compressor 1. Hence, oil is returned to the compressor 2 from the compressor 1 through the equalizing pipe 3, but when the concentration of the lubricating oil in the compressor 1 which is already in operation is low, such an oil-returning effect is small.

In a state in which the liquid refrigerant is being accumulated in the accumulator 15, even when the compressor 1 is being operated and the compressor 2 is being stopped, since the interior of the shell of the compressor 1 and the interior of the shell of the compressor 2 communicates with each other via the equalizing pipe 3, the internal pressure of the shell of the compressor 2 being stopped also drops. Consequently, wet gas refrigerant moves from the accumulator 15 to the compressor 2, and condenses in the compressor 2, so that the concentration of the lubricating oil in the compressor 2 decreases gradually. For this reason, in a case where the compressor 2 is started for the first time after the power is turned on, there has been a risk that a bearing is damaged due to a shortage of the lubricating oil. In addition, in a case where excess liquid refrigerant is accumulated in the accumulator 15 when the compressor 2 being stopped is started, wet vapor suction has been liable to occur.

In addition, in a case where the compressor 1 is started with the refrigerant being held up in both compressors, the concentration of the lubricating oil in the compressor 1 is low, and the lubricating oil is liable to flow out due to foaming during starting. Yet, when the compressor 2 is being stopped, the mixed liquid of the refrigerant and the lubricating oil in the compressor 2 is also supplied to the compressor 1 through the equalizing pipe 3. However, if the compressor 2 is started in a short time after the starting of the compressor 1, the lubricating oil in the compressor 2 is discharged together with the refrigerant due to foaming, and it becomes difficult for the oil to be returned to the compressor 1 from the equalizing pipe 3. Furthermore, since the quantity of lubricating oil in the compressor 1 is not sufficient, it is difficult to expect the return of oil from the compressor 1 through the equalizing pipe 3 to the compressor 2 which was started. Hence, there has occurred a problem of seizure of the bearings of the compressors due to the shortage of the lubricating oil in the compressor 1 and the compressor 2.

Furthermore, since the conventional air conditioner is arranged as described above, in a case where the first compressor 1 is being operated and the second compressor 2 is being stopped, the refrigerant flows into the first compressor 1 not only via the U-pipe 16 and the suction pipe 7 but also via the U-pipe 17, the suction pipe 8, the shell of the second compressor 2, and the equalizing pipe 3. At this time, if the liquid refrigerant is accumulated in the accumulator 15, the liquid refrigerant is also accumulated inside the U-pipe 17 due to the presence of the oil return hole 21. Hence, since the flow rate of the refrigerant supplied from the bypass hole 19 is insufficient as the flow rate of the refrigerant supplied to the first compressor via the shell of the second compressor 2, and the liquid refrigerant accumulated inside the U-pipe 17 flows into the shell of the second compressor 2. As a result, the lubricating oil in the shell of the second compressor 2 is mixed with the liquid refrigerant, which has flowed in, and flows out to the shell of the first compressor 1 via the equalizing pipe 3 since the pressure within the shell of the first compressor 1 is lower than the pressure within the shell of the second compressor 2. Thus, the lubricating oil in the second compressor 2 declines in terms of its absolute quantity while the first compressor 1 is being operated and the second compressor 2 is being stopped, and the concentration of the lubricating oil also declines. Consequently, there has been a problem in that a shortage of lubricating oil or faulty lubrication due to such as the lack of viscosity of the lubricating oil occur when the second compressor is started, possibly resulting in the breakage of the second compressor.

SUMMARY OF THE INVENTION

The present invention has been devised to overcome the above-described problems, and its object is to obtain a highly reliable air conditioner in which, even if the liquid refrigerant is accumulated in the accumulator when the first compressor is being operated and the second compressor is being stopped, a shortage of lubricating oil or faulty lubrication due to such as the lack of viscosity of the lubricating oil do not occur when the second compressor is started, which may otherwise result in the breakage of the second compressor.

An air conditioner of the first aspect of the invention has a first time measuring device for counting an operating time of the first compressor upon starting of the first compressor, wherein the second compressor is started after the first time measuring device counts a first predetermined time in a case where the second compressor is started for the first time subsequent to the turning on of the power supply to the control device, or after the first time measuring device counts a second predetermined time in a case where the second compressor had been started even once subsequent to the turning on of the power supply to the control device, respectively, the first predetermined time being set to be longer than the second predetermined time.

An air conditioner according to the second aspect of the invention, has a first refrigerant superheat detecting device for detecting a degree of superheat of the refrigerant discharged from the first compressor, wherein in a case where the second compressor is started for the first time subsequent to the turning on of the power supply to the control device, the second compressor is started after the degree of superheat of the refrigerant detected by the first refrigerant superheat detecting device has fallen within a predetermined range.

An air conditioner according to the third aspect of the invention, has a first lubricating-oil superheat detecting device for detecting a degree of superheat of the refrigerant in the first compressor or a second lubricating-oil superheat detecting device for detecting a degree of superheat of the refrigerant in the second compressor, wherein in a case where the second compressor is started for the first time subsequent to the turning on of the power supply to the control device, the second compressor is started after the degree of superheat of the refrigerant detected by the first lubricating-oil superheat detecting device or the degree of superheat of the refrigerant detected by the second lubricating-oil superheat detecting device has fallen within a predetermined range.

An air conditioner according to the fourth aspect of the invention, has a first temperature detecting device for detecting a temperature of a mixed liquid of the refrigerant and the lubricating oil in the first compressor or a second temperature detecting device for detecting a temperature of a mixed liquid of the refrigerant and the lubricating oil in the second compressor, wherein in a case where the second compressor is started for the first time subsequent to the turning on of the power supply to the control device, the second compressor is started after the temperature of the mixed liquid detected by the first temperature detecting device or the temperature of the mixed liquid detected by the second temperature detecting device has fallen within a predetermined range.

The air conditioner according to the fifth aspect of the invention, a second time measuring device for counting a non-operating time of the first compressor, wherein in a case where the second compressor is started for the first time subsequent to the turning on of the power supply to the control device, the first compressor being operated is stopped at the same time as the second compressor is started, and after a predetermined time is counted by the second time measuring device, the first compressor is restarted.

The air conditioner according to the sixth aspect of the invention, a first refrigerant superheat detecting device for detecting a degree of superheat of the refrigerant discharged from the second compressor, wherein in a case where the second compressor is started for the first time subsequent to the turning on of the power supply to the control device, the first compressor being operated is stopped at the same time as the second compressor is started, and after the degree of superheat of the refrigerant detected by the second refrigerant superheat detecting device has fallen within a predetermined range, the first compressor is restarted.

An air conditioner according to the seventh aspect of the invention, has a third temperature detecting device for detecting a temperature of the refrigerant discharged from the second compressor, wherein in a case where the second compressor is started for the first time subsequent to the turning on of the power supply to the control device, the first compressor being operated is stopped at the same time as the second compressor is started, and after the temperature of the refrigerant detected by the third temperature detecting device has fallen within a predetermined range, the first compressor is restarted.

An air conditioner according to the eighth aspect of the invention, has a third time measuring device for counting an integrated operating time of the first compressor subsequent to the turning on of the power supply to the control device and a second time measuring device for counting an non-operating time of the first compressor, wherein only the first compressor is operated until the second compressor is started for the first time subsequent to the turning on of the power supply to the control device, the first compressor is temporarily stopped after a predetermined time is counted by the third time measuring device, and the first compressor is restarted after a predetermined time is counted by the second counting device.

An air conditioner according to the ninth aspect of the invention, wherein in a state in which the second compressor is being stopped, after the number of times when the first compressor was stopped from an operating state has reached a predetermined number of times, the first compressor is started, and the second compressor is then started forcibly.

An air conditioner according to the tenth aspect of the invention, has a refrigeration circuit including a first compressor and a second compressor which are disposed in parallel with each other, an equalizing pipe for connecting together the first compressor and the second compressor, a four-way changeover valve, a heat source-side heat exchanger, a throttling means, an indoor-side heat exchanger, and an accumulator; a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor.

An air conditioner according to the eleventh aspect of the invention, has the refrigeration circuit; a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor; and an on-off valve is provided midway in the bypass passage.

An air conditioner according to the twelfth aspect of the invention, has a refrigeration circuit; a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor; and an on-off valve is provided midway in the bypass passage, wherein the on-off valve is opened only when the first compressor is operated and the second compressor is stopped, and the on-off valve is closed at other times.

An air conditioner according to the thirteenth aspect of the invention, has a refrigeration circuit, an oil separator which is disposed in a discharge pipe of the first compressor, the converging portion of the discharge pipes of the first and second compressors, or a common discharge pipe located after convergence of the discharge pipes of the first and second compressors, and has an inlet pipe, an outlet pipe, and an oil return pipe; a bypass passage which branches off from a discharge pipe of the first compressor, a converging portion of discharge pipes of the first and second compressors, or the common discharge pipe located after convergence of the discharge pipes of the first and second compressors, and is connected to a suction pipe of the second compressor; an on-off valve provided midway in the bypass passage; and a compressor-continuous-operation-time measuring device which starts timing upon starting of the first compressor for counting a time of continuous operation of the first compressor, wherein when the first compressor is operated and the second compressor is stopped, the on-off valve is opened at the time of starting the first compressor, and the on-off valve is closed when the time counted by the compressor-continuous-operation-time measuring device reaches a first set time set in advance.

An air conditioner according to the fourteenth aspect of the invention, has a refrigeration circuit; an oil separator which is disposed in a discharge pipe of the first compressor, the converging portion of the discharge pipes of the first and second compressors, or a common discharge pipe located after convergence of the discharge pipes of the first and second compressors and has an inlet pipe, an outlet pipe, and an oil return pipe; a bypass passage which branches off from the discharge pipe of the first compressor, a converging portion of discharge pipes of the first and second compressors, or the common discharge pipe, and is connected to a suction pipe of the second compressor; an on-off valve provided midway in the bypass passage; a compressor-continuous-operation-time measuring device which starts timing upon starting of the first compressor for counting a time of continuous operation of the first compressor; and a compressors-continuous-stop-time measuring device for counting a time when both the first and second compressors are being continuously stopped, wherein when the first compressor is operated and the second compressor is stopped, the on-off valve is opened at the time of starting the first compressor, the on-off valve is closed when the time counted by the compressor-continuous-operation-time measuring device reaches a first set time set in advance in a case where the time counted by the compressors-continuous-stop-time measuring device does not reach a second set time set in advance, and the on-off valve is closed when the time counted by the compressor-continuous-operation-time measuring device reaches a third set time set in advance in such a manner as to be longer than the first set time in a case where the starting of the first compressor is a first starting after the turning on of the power or a starting in which the time counted by the compressor-continuous-operation-time measuring device reaches the second set time set in advance.

An air conditioner according to the fifteenth aspect of the invention, has a refrigeration circuit; an oil separator which is disposed in a discharge pipe of the first compressor, the converging portion of the discharge pipes of the first and second compressors, or a common discharge pipe located after convergence of the discharge pipes of the first and second compressors and has an inlet pipe, an outlet pipe, and an oil return pipe; a bypass passage which branches off from the discharge pipe of the first compressor, a converging portion of discharge pipes of the first and second compressors, or the common discharge pipe, and is connected to a suction pipe of the second compressor; an on-off valve provided midway in the bypass passage; and a discharge-temperature detecting device disposed on the discharge pipe of the first compressor, the converging portion of the discharge pipes of the first and second compressors, or the common discharge pipe, wherein when the first compressor is operated and the second compressor is stopped, the on-off valve is opened at the time of starting the first compressor, the on-off valve is closed when a temperature detected by the discharge-temperature detecting device reaches a level greater than or equal to a set value of a discharge-temperature upper limit set in advance, and the on-off valve is opened when the temperature detected by the discharge-temperature detecting device drops to a level less than or equal to a set value of a discharge-temperature lower limit set in advance in such a manner as to be lower than the set value of the discharge-temperature upper limit.

An air conditioner according to the sixteenth aspect of the invention, has a refrigeration circuit; an oil separator which is disposed in a discharge pipe of the first compressor, the converging portion of the discharge pipes of the first and second compressors, or a common discharge pipe located after convergence of the discharge pipes of the first and second compressors and has an inlet pipe, an outlet pipe, and an oil return pipe; a bypass passage which branches off from the discharge pipe of the first compressor, a converging portion of discharge pipes of the first and second compressors, or the common discharge pipe, and is connected to a suction pipe of the second compressor; an on-off valve provided midway in the bypass passage; and a discharge-temperature superheat detecting device disposed on the discharge pipe of the first compressor, the common discharge pipe, or the converging portion of the discharge pipes of the first and second compressors, wherein when the first compressor is operated and the second compressor is stopped, the on-off valve is opened at the time of starting the first compressor, the on-off valve is closed when a degree of superheat detected by the discharge-temperature superheat detecting device reaches a level greater than or equal to a set value of a discharge-temperature superheat upper limit set in advance, and the on-off valve is opened when the degree of superheat detected by the discharge-temperature superheat detecting device drops to a level less than or equal to a set value of a discharge-temperature superheat lower limit set in advance in such a manner as to be lower than the set value of the discharge-temperature superheat upper limit.

An air conditioner according to the seventeenth aspect of the invention, has a refrigeration circuit; an oil separator which is disposed in a discharge pipe of the first compressor, the converging portion of the discharge pipes of the first and second compressors, or a common discharge pipe located after convergence of the discharge pipes of the first and second compressors and has an inlet pipe, an outlet pipe, and an oil return pipe; a bypass passage which branches off from the discharge pipe of the first compressor, a converging portion of discharge pipes of the first and second compressors, or the common discharge pipe, and is connected to a suction pipe of the second compressor; an on-off valve provided midway in the bypass passage; and a shell-temperature detecting device disposed on a first or second shell, wherein when the first compressor is operated and the second compressor is stopped, the on-off valve is opened at the time of starting the first compressor, the on-off valve is closed when a temperature detected by the shell-temperature detecting device reaches a level greater than or equal to a value of a shell-temperature upper limit set in advance, and the on-off valve is opened when the temperature detected by the shell-temperature detecting device drops to a level less than or equal to a set value of a shell-temperature lower limit set in advance in such a manner as to be lower than the set value of the shell-temperature upper limit.

An air conditioner according to the eighteenth aspect of the invention, has a refrigeration circuit; an oil separator which is disposed in a discharge pipe of the first compressor, the converging portion of the discharge pipes of the first and second compressors, or a common discharge pipe located after convergence of the discharge pipes of the first and second compressors and has an inlet pipe, an outlet pipe, and an oil return pipe; a bypass passage which branches off from the discharge pipe of the first compressor, a converging portion of discharge pipes of the first and second compressors, or the common discharge pipe, and is connected to a suction pipe of the second compressor; an on-off valve provided midway in the bypass passage; and a shell-temperature superheat detecting device disposed on a shell of the first or second compressor, wherein when the first compressor is operated and the second compressor is stopped, the on-off valve is opened at the time of starting the first compressor, the on-off valve is closed when a degree of superheat detected by the shell-temperature superheat detecting device reaches a level greater than or equal to a value of a shell-temperature superheat upper limit set in advance, and the on-off valve is opened when the degree of superheat detected by the shell-temperature superheat detecting device drops to a level less than or equal to a set value of a shell-temperature superheat lower limit set in advance in such a manner as to be lower than the set value of the shell-temperature superheat upper limit.

An air conditioner according to the nineteenth aspect of the invention has a refrigeration circuit; a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor; and a flow-rate controlling device provided midway in the bypass passage.

An air conditioner according to the twelfth aspect of the invention, has a refrigeration circuit; a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor; a flow-rate controlling device provided midway in the bypass passage; and a high-pressure detecting device provided in the discharge pipe of the first compressor or the common discharge pipe, wherein the flow-rate controlling device is controlled in accordance with a pressure detected by the high-pressure detecting device.

An air conditioner according to the twenty-first aspect of the invention, has a refrigeration circuit; a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor; and a flow-rate controlling device provided midway in the bypass passage, wherein the flow-rate controlling device is controlled in accordance with the running capacity of the first compressor.

An air conditioner according to the twenty-second aspect of the invention, has a refrigeration circuit having an accumulator; a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor; an on-off valve provided midway in the bypass passage; a liquid-level detecting circuit having one end communicating with a lower end inside the accumulator and another end connected to a discharge pipe of the accumulator; a heating device for heating the liquid-level detecting circuit and having a heating capacity falling within a range for heating the liquid-level detecting circuit so as to produce superheat gas when wet vapor flows through the liquid-level detecting circuit, or maximum, saturated vapor or wet vapor when the liquid refrigerant flows therethrough; a liquid-level-detecting temperature detecting device provided at an outlet of the liquid-level detecting circuit; and a low-pressure detecting device disposed in a suction pipe of the first compressor, the suction pipe of the second compressor, or a common suction pipe of the first and second compressors, wherein when the first compressor is operated and the second compressor is stopped, the on-off valve is closed when a degree of superheat for liquid-level detection calculated from a temperature detected by the liquid-level-detecting temperature detecting device and a pressure detected by the low-pressure detecting device is greater than a liquid-level-detection superheat upper limit value set in advance, and the on-off valve is opened when the degree of superheat for liquid-level detection is less than a liquid-level-detection superheat lower limit value set in advance in such a manner as to be lower than the liquid-level-detection superheat upper limit value.

In the first aspect of the invention, in a case where the second compressor is started for the first time subsequent to the turning on of the power supply while the first compressor is being operated, the second compressor is started after the lapse of a first predetermined time upon starting of the first compressor. Meanwhile, in a case where the second compressor which had been started even once subsequent to the turning on of the power supply is started while the first compressor is being operated, the second compressor is started after the lapse of a second predetermined time upon starting of the first compressor.

In the second aspect of the invention, in a case where the second compressor is started for the first time subsequent to the turning on of the power supply while the first compressor is being operated, the second compressor is started after the degree of superheat of the refrigerant discharged from the first compressor has fallen within a predetermined range.

In the third aspect of the invention, in a case where the second compressor is started for the first time subsequent to the turning on of the power supply while the first compressor is being operated, the second compressor is started after the degree of superheat of the lubricating oil in the first compressor or the degree of superheat of the lubricating oil in the second compressor has fallen within a predetermined range.

In the fourth aspect of the invention, in a case where the second compressor is started for the first time subsequent to the turning on of the power supply while the first compressor is being operated, the second compressor is started after the temperature of the mixed liquid of the refrigerant and the lubricating oil in the first compressor or the temperature of the mixed liquid of the refrigerant and the lubricating oil in the second compressor has fallen within a predetermined range.

In the fifth aspect of the invention, in a case where the second compressor is started for the first time subsequent to the turning on of the power supply while the first compressor is being operated, the second compressor is started and the first compressor is stopped, and after a predetermined time has elapsed after the first compressor was stopped, the first compressor is restarted.

In the sixth aspect of the invention, in a case where the second compressor is started for the first time subsequent to the turning on of the power supply while the first compressor is being operated, the second compressor is started and the first compressor is stopped, and after the degree of superheat of the refrigerant discharged from the second compressor has fallen within a predetermined range, the first compressor is restarted.

In the seventh aspect of the invention, in a case where the second compressor is started for the first time subsequent to the turning on of the power supply while the first compressor is being operated, the second compressor is started and the first compressor is stopped, and after the temperature of the refrigerant discharged from the second compressor has fallen within a predetermined range, the first compressor is restarted.

In the eighth aspect of the invention, in a case where only the first compressor is being operated subsequent to the turning on of the power supply, the first compressor is stopped when an integrated operating time of the first compressor has reached a predetermined time, and the first compressor is restarted after the lapse of a predetermined time subsequent to the stopping of the first compressor.

In the ninth aspect of the invention, when the number of times when the first compressor was stopped has reached a predetermined number of times through control according to the eighth aspect, the second compressor being stopped is started forcibly.

In the air conditioner according to the tenth aspect of the invention, part of the gas refrigerant discharged from the first or second compressor flows into the bypass passage. Since the bypass passage is branched off from the discharge pipe, the refrigerant flowing through the bypass passage is always a high-temperature gas refrigerant. Namely, the high-temperature gas refrigerant is always supplied to the suction pipe of the second compressor. Accordingly, in a case where the first compressor is being operated and the second compressor 2 is being stopped, even if the first compressor is in a state of wet vapor suction, the gas refrigerant supplied from the bypass passage is sufficient in terms of the flow rate of the refrigerant supplied to the first compressor via the shell of the second compressor 2, the pressure within the suction pipe of the second compressor rises, so that the liquid refrigerant is prevented from flowing into the second compressor. In addition, should the liquid refrigerant flow into the suction pipe of the second compressor, the liquid refrigerant is evaporated by the high-temperature gas refrigerant supplied from the bypass passage, so that the liquid refrigerant is prevented from flowing into the second compressor. Thus, in the case where the first compressor is being operated and the second compressor is being stopped, even if the first compressor is in the state of wet vapor suction, the absolute quantity of the lubricating oil in the second compressor does not decrease, and the concentration of the lubricating oil does not decline.

In the air conditioner according to the eleventh aspect of the invention, in a case where the on-off valve is open, part of the gas refrigerant discharged from the first or second compressor flows into the bypass passage. Since the high-temperature refrigerant gas is supplied to the suction pipe of the second compressor through the bypass as described above. Therefore, in the case where the first compressor is being operated and the second compressor is being stopped, even if the first compressor is in the state of wet vapor suction, the absolute quantity of the lubricating oil in the second compressor does not decrease, and the concentration of the lubricating oil does not decline.

In addition, when the on-off valve is closed, the refrigerant is not bypassed via the bypass passage, so that the cooling and heating capabilities do not decline by the portion of the bypass flow.

In the air conditioner according to the twelfth aspect of the invention, in the case where the first compressor is operated and the second compressor is stopped, the on-off valve is opened to allow part of the gas refrigerant discharged from the first compressor to flow into the bypass passage. The high-temperature refrigerant gas is supplied to the suction pipe of the second compressor through the bypass as described above. Therefore, in the case where the first compressor is being operated and the second compressor is being stopped, even if the first compressor is in the state of wet vapor suction, the absolute quantity of the lubricating oil in the second compressor does not decrease, and the concentration of the lubricating oil does not decline.

Meanwhile, when both the first and second compressors are operated, the on-off valve is closed, so that the refrigerant is not bypassed via the bypass passage, thereby preventing a decline in the cooling and heating capabilities by the portion of the bypass flow.

In the air conditioner according to the thirteenth aspect of the invention, in the case where the first compressor is operated and the second compressor is stopped, the on-off valve is opened upon starting of the first compressor until the time counted by the compressor-continuous-operation-time measuring device reaches a first set time set in advance, and part of the gas refrigerant discharged from the first compressor is allowed to flow into the bypass passage. Since the high-temperature refrigerant gas is supplied to the suction pipe of the second compressor through the bypass, as described above. Therefore, in the case where the first compressor is being operated and the second compressor is being stopped, even if the first compressor is in the temporary state of wet vapor suction subsequent to starting, the absolute quantity of the lubricating oil in the second compressor does not decrease, and the concentration of the lubricating oil does not decline.

Meanwhile, when the time counted by the compressor-continuous-operation-time measuring device reaches the first set time set in advance, the on-off valve is closed, so that the refrigerant is not bypassed via the bypass passage, thereby preventing a decline in the cooling and heating capabilities by the portion of the bypass flow.

In the air conditioner according to the fourteenth aspect of the invention, in the case where the first compressor is operated and the second compressor is stopped, when the first compressor is started before the time counted by the compressors-continuous-stop-time measuring device has not reached the second set time set in advance, the on-off valve is opened upon starting of the first compressor until the time counted by the compressor-continuous-operation-time measuring device reaches the first set time set in advance, and part of the gas refrigerant discharged from the first compressor is allowed to flow into the bypass passage. Since the high-temperature refrigerant gas is supplied to the suction pipe of the second compressor through the bypass, as described above. Therefore, in the case where the first compressor is being operated and the second compressor is being stopped, even if the first compressor is in the state of wet vapor suction subsequent to starting, the absolute quantity of the lubricating oil in the second compressor does not decrease, and the concentration of the lubricating oil does not decline.

Meanwhile, when the time counted by the compressor-continuous-operation-time measuring device reaches the first set time set in advance, the on-off valve is closed, so that the refrigerant is not bypassed via the bypass passage, thereby preventing a decline in the cooling and heating capabilities by the portion of the bypass flow.

In addition, when the first compressor is started after the time counted by the compressors-continuous-stop-time measuring device has reached the second set time set in advanced, or when the first compressor is started for the first time after the turning on of the power, the on-off valve is opened upon starting of the first compressor until the time counted by the compressor-continuous-operation-time measuring device reaches a third set time set in advance in such a manner as to be longer than the first set time, thereby allowing part of the gas refrigerant discharged from the first compressor to flow into the bypass passage. Since the refrigerant flowing through this bypass passage is always a high-temperature gas refrigerant, the high-temperature gas refrigerant is always supplied to the suction pipe of the second compressor. Accordingly, in the case where the first compressor is being operated and the second compressor is being stopped, during the time when the first compressor is in a temporary state of, but a long period of, wet vapor suction subsequent to starting with the liquid refrigerant being held up in the shell of the first compressor, the gas refrigerant supplied from the bypass passage is sufficient in terms of the flow rate of the refrigerant supplied to the first compressor via the shell of the second compressor. Hence, the pressure within the suction pipe of the second compressor rises, so that the liquid refrigerant is prevented from flowing into the second compressor. In addition, should the liquid refrigerant flow into the suction pipe of the second compressor, the liquid refrigerant is evaporated by the high-temperature gas refrigerant supplied from the bypass passage, so that the liquid refrigerant is prevented from flowing into the second compressor.

Meanwhile, when the time counted by the compressor-continuous-operation-time measuring device reaches the third set time set in advance, the on-off valve is closed, so that the refrigerant is not bypassed via the bypass passage, thereby preventing a decline in the cooling and heating capabilities by the portion of the bypass flow.

In the air conditioner according to the fifteenth aspect of the invention, in the case where the first compressor is operated and the second compressor is stopped, when the first compressor is started, the on-off valve is opened to allow part of the gas refrigerant discharged from the first compressor to flow into the bypass passage. Since the high-temperature refrigerant gas is supplied to the suction pipe of the second compressor through the bypass, as described above. Therefore, in the case where the first compressor is being operated and the second compressor is being stopped, during the time when the first compressor is in a temporary state of wet vapor suction subsequent to starting or during the time when the first compressor is in a temporary state of, but a long period of, wet vapor suction subsequent to starting with the liquid refrigerant being held up in the shell of the first compressor, the absolute quantity of the lubricating oil in the second compressor does not decrease, and the concentration of the lubricating oil does not decline.

Meanwhile, the on-off valve is closed when the state of wet vapor suction is overcome and the temperature detected by the discharge-temperature detecting device reaches a level greater than or equal to a set value of a discharge-temperature upper limit set in advance. Hence, the refrigerant is not bypassed via the bypass passage, thereby preventing a decline in the cooling and heating capabilities by the portion of the bypass flow.

Then, when the state of wet vapor suction is resumed with a resultant decline in the temperature detected by the discharge-temperature detecting device to a level less than or equal to a set value of a discharge-temperature lower limit, the on-off valve is opened to allow part of the gas refrigerant discharged from the first compressor to flow into the bypass passage. Since the high-temperature refrigerant gas is supplied to the suction pipe of the second compressor through the bypass, as described above. Therefore, in the case where the first compressor is being operated and the second compressor is being stopped, during the time when the first compressor is in the state of wet vapor suction, the absolute quantity of the lubricating oil in the second compressor does not decrease, and the concentration of the lubricating oil does not decline.

In the air conditioner according to the sixteenth aspect of the invention, in the case where the first compressor is operated and the second compressor is stopped, when the first compressor is started, the on-off valve is opened to allow part of the gas refrigerant discharged from the first compressor to flow into the bypass passage. Since the high-temperature refrigerant gas is supplied to the suction pipe of the second compressor through the bypass, as described above. Therefore, in the case where the first compressor is being operated and the second compressor is being stopped, during the time when the first compressor is in a temporary state of wet vapor suction subsequent to starting or during the time when the first compressor is in a temporary state of, but a long period of, wet vapor suction subsequent to starting with the liquid refrigerant being held up in the shell of the first compressor, the absolute quantity of the lubricating oil in the second compressor does not decrease, and the concentration of the lubricating oil does not decline.

Meanwhile, the on-off valve is closed when the state of wet vapor suction is overcome and the degree of superheat detected by the discharge-temperature superheat detecting device reaches a level greater than or equal to a set value of a discharge-temperature superheat upper limit set in advance. Hence, the refrigerant is not bypassed via the bypass passage, thereby preventing a decline in the cooling and heating capabilities by the portion of the bypass flow.

Then, when the state of wet vapor suction is resumed with a resultant decline in the degree of superheat detected by the discharge-temperature superheat detecting device to a level less than or equal to a set value of a discharge-temperature superheat lower limit, the on-off valve is opened to allow part of the gas refrigerant discharged from the first compressor to flow into the bypass passage. Since the high-temperature refrigerant gas is supplied to the suction pipe of the second compressor through the bypass, as described above. Therefore, in the case where the first compressor is being operated and the second compressor is being stopped, during the time when the first compressor is in the state of wet vapor suction, the absolute quantity of the lubricating oil in the second compressor does not decrease, and the concentration of the lubricating oil does not decline.

In the air conditioner according to the seventeenth aspect of the invention, in the case where the first compressor is operated and the second compressor is stopped, when the first compressor is started, the on-off valve is opened to allow part of the gas refrigerant discharged from the first compressor to flow into the bypass passage. Since the high-temperature refrigerant gas is supplied to the suction pipe of the second compressor through the bypass, as described above. Therefore, in the case where the first compressor is being operated and the second compressor is being stopped, during the time when the first compressor is in a temporary state of wet vapor suction subsequent to starting or during the time when the first compressor is in a temporary state of, but a long period of, wet vapor suction subsequent to starting with the liquid refrigerant being held up in the shell of the first compressor, the absolute quantity of the lubricating oil in the second compressor does not decrease, and the concentration of the lubricating oil does not decline.

Meanwhile, the on-off valve is closed when the state of wet vapor suction is overcome and the temperature detected by the shell-temperature detecting device reaches a level greater than or equal to a set value of a shell-temperature upper limit set in advance. Hence, the refrigerant is not bypassed via the bypass passage, thereby preventing a decline in the cooling and heating capabilities by the portion of the bypass flow.

Then, when the state of wet vapor suction is resumed with a resultant decline in the temperature detected by the shell-temperature detecting device to a level less than or equal to a set value of a shell-temperature lower limit, the on-off valve is opened to allow part of the gas refrigerant discharged from the first compressor to flow into the bypass passage. Since the high-temperature refrigerant gas is supplied to the suction pipe of the second compressor through the bypass, as described above. Therefore, in the case where the first compressor is being operated and the second compressor is being stopped, during the time when the first compressor is in the state of wet vapor suction, the absolute quantity of the lubricating oil in the second compressor does not decrease, and the concentration of the lubricating oil does not decline.

In the air conditioner according to the eighteenth aspect of the invention, in the case where the first compressor is operated and the second compressor is stopped, when the first compressor is started, the on-off valve is opened to allow part of the gas refrigerant discharged from the first compressor to flow into the bypass passage. Since the high-temperature refrigerant gas is supplied to the suction pipe of the second compressor through the bypass, as described above. Therefore, in the case where the first compressor is being operated and the second compressor is being stopped, during the time when the first compressor is in a temporary state of wet vapor suction subsequent to starting or during the time when the first compressor is in a temporary state of, but a long period of, wet vapor suction subsequent to starting with the liquid refrigerant being held up in the shell of the first compressor, the absolute quantity of the lubricating oil in the second compressor does not decrease, and the concentration of the lubricating oil does not decline.

Meanwhile, the on-off valve is closed when the state of wet vapor suction is overcome and the degree of superheat detected by the shell-temperature superheat detecting device reaches a level greater than or equal to a set value of a shell-temperature superheat upper limit set in advance. Hence, the refrigerant is not bypassed via the bypass passage, thereby preventing a decline in the cooling and heating capabilities by the portion of the bypass flow.

Then, when the state of wet vapor suction is resumed with a resultant decline in the degree of superheat detected by the shell-temperature superheat detecting device to a level less than or equal to a set value of a shell-temperature superheat lower limit, the on-off valve is opened to allow part of the gas refrigerant discharged from the first compressor to flow into the bypass passage. Since the high-temperature refrigerant gas is supplied to the suction pipe of the second compressor through the bypass, as described above. Therefore, in the case where the first compressor is being operated and the second compressor is being stopped, during the time when the first compressor is in the state of wet vapor suction, the absolute quantity of the lubricating oil in the second compressor does not decrease, and the concentration of the lubricating oil does not decline.

In the air conditioner according to the nineteenth aspect of the invention, part of the gas refrigerant discharged from the first compressor flows into the bypass passage. Since the bypass passage is branched off from the discharge pipe, the refrigerant flowing through the bypass passage is always a high-temperature gas refrigerant. Namely, the high-temperature gas refrigerant is always supplied to the suction pipe of the second compressor. In a case where the first compressor is being operated and the second compressor is being stopped, even if the first compressor is in the state of wet vapor suction, the gas refrigerant supplied from the bypass passage is controlled by the flow-rate controlling device disposed midway in the bypass passage to a necessary and sufficient quantity in terms of the flow rate of the refrigerant supplied to the first compressor via the second compressor. Hence, the pressure within the suction pipe of the second compressor rises, so that the liquid refrigerant is prevented from flowing into the second compressor. In addition, should the liquid refrigerant flow into the suction pipe of the second compressor, the liquid refrigerant is evaporated by the high-temperature gas refrigerant supplied from the bypass passage, so that the liquid refrigerant is prevented from flowing into the second compressor. Thus, in the case where the first compressor is being operated and the second compressor is being stopped, even if the first compressor is in the state of wet vapor suction, the absolute quantity of the lubricating oil in the second compressor does not decrease, and the concentration of the lubricating oil does not decline.

In addition, the flow rate of the refrigerant bypassed via the bypass passage is controlled by the flow-rate controlling device, and excess gas refrigerant is not supplied to the bypass passage, thereby preventing a decline in the cooling and heating capabilities more than is necessary.

In the air conditioner according to the twelfth aspect of the invention, part of the gas refrigerant discharged from the first compressor flows into the bypass passage. Since the bypass passage is branched off from the discharge pipe, the refrigerant flowing through the bypass passage is always a high-temperature gas refrigerant. Namely, the high-temperature gas refrigerant is always supplied to the suction pipe of the second compressor. The flow-rate controlling device is provided midway in the bypass passage, and control is provided such that the opening of the flow-rate controlling device is reduced in accordance with the pressure detected by the high-pressure detecting device if the detected pressure is high, whereas the opening of the flow-rate controlling device is increased if the detected pressure is low. Hence, in a case where the first compressor is being operated and the second compressor is being stopped, even if the first compressor is in the state of wet vapor suction, the gas refrigerant supplied from the bypass passage can be controlled to a necessary and sufficient quantity in terms of the flow rate of the refrigerant supplied to the first compressor via the second compressor. Consequently, even if the high-pressure level is low, the pressure within the suction pipe of the second compressor rises, so that the liquid refrigerant is prevented from flowing into the second compressor. In addition, should the liquid refrigerant flow into the suction pipe of the second compressor, the liquid refrigerant is evaporated by the high-temperature gas refrigerant supplied from the bypass passage, so that the liquid refrigerant is prevented from flowing into the second compressor. Thus, in the case where the first compressor is being operated and the second compressor is being stopped, even if the first compressor is in the state of wet vapor suction, the absolute quantity of the lubricating oil in the second compressor does not decrease, and the concentration of the lubricating oil does not decline.

In addition, since excess gas refrigerant is not supplied to the bypass passage even if the high-pressure level is high, the cooling and heating capabilities do not decline more than is necessary.

In the air conditioner according to the twelfth-first aspect of the invention, part of the gas refrigerant discharged from the first compressor flows into the bypass passage. Since the bypass passage is branched off from the discharge pipe, the refrigerant flowing through the bypass passage is always a high-temperature gas refrigerant. Namely, the high-temperature gas refrigerant is always supplied to the suction pipe of the second compressor. In a case where the first compressor is being operated and the second compressor is being stopped, even if the first compressor is in the state of wet vapor suction, control is provided such that the opening of the flow-rate controlling device is increased in accordance with the running capacity of the first compressor if the running capacity is large, whereas the opening of the flow-rate controlling device is reduced if the running capacity is small. Hence, the gas refrigerant supplied from the bypass passage can be controlled to a necessary and sufficient quantity in accordance with the running capacity of the first compressor in terms of the flow rate of the refrigerant supplied to the first compressor via the second compressor. Consequently, even if the running capacity of the first compressor is large, the pressure within the suction pipe of the second compressor rises, so that the liquid refrigerant is prevented from flowing into the second compressor. In addition, should the liquid refrigerant flow into the suction pipe of the second compressor, the liquid refrigerant is evaporated by the high-temperature gas refrigerant supplied from the bypass passage, so that the liquid refrigerant is prevented from flowing into the second compressor. Thus, in the case where the first compressor is being operated and the second compressor is being stopped, even if the first compressor is in the state of wet vapor suction, the absolute quantity of the lubricating oil in the second compressor does not decrease, and the concentration of the lubricating oil does not decline.

In addition, since excess gas refrigerant is not supplied to the bypass passage even if the running capacity of the first compressor is small, the cooling and heating capabilities do not decline more than is necessary.

In the air conditioner according to the twenty-second aspect of the invention, in the case where the first compressor is operated and the second compressor is stopped, when the first compressor is started, the on-off valve is opened to allow part of the gas refrigerant discharged from the first compressor to flow into the bypass passage. Since the refrigerant flowing through this bypass passage is always a high-temperature gas refrigerant, the high-temperature gas refrigerant is always supplied to the suction pipe of the second compressor. Accordingly, in the case where the first compressor is being operated and the second compressor is being stopped, during the time when the first compressor is in a temporary state of wet vapor suction subsequent to starting or during the time when the first compressor is in a temporary state of, but a long period of, wet vapor suction subsequent to starting with the liquid refrigerant being held up in the shell of the first compressor, the gas refrigerant supplied from the bypass passage is sufficient in terms of the flow rate of the refrigerant supplied to the first compressor via the shell of the second compressor. Hence, the pressure within the suction pipe of the second compressor rises, so that the liquid refrigerant is prevented from flowing into the second compressor. In addition, should the liquid refrigerant flow into the suction pipe of the second compressor, the liquid refrigerant is evaporated by the high-temperature gas refrigerant supplied from the bypass passage, so that the liquid refrigerant is prevented from flowing into the second compressor. Thus, in the case where the first compressor is being operated and the second compressor is being stopped, during the time when the first compressor is in a temporary state of wet vapor suction subsequent to starting or during the time when the first compressor is in a temporary state of, but a long period of, wet vapor suction subsequent to starting with the liquid refrigerant being held up in the shell of the first compressor, the absolute quantity of the lubricating oil in the second compressor does not decrease, and the concentration of the lubricating oil does not decline.

Meanwhile, the on-off valve is closed when the state of wet vapor suction is overcome and the degree of superheat for liquid-level detection reaches a level greater than or equal to a set value of a liquid-level-detection superheat upper limit set in advance. Hence, the refrigerant is not bypassed via the bypass passage, thereby preventing a decline in the cooling and heating capabilities by the portion of the bypass flow.

Then, when the state of wet vapor suction is resumed with a resultant decline in the degree of superheat for liquid-level detection to a level less than or equal to a set value of a liquid-level-detection superheat lower limit, the on-off valve is opened to allow part of the gas refrigerant discharged from the first compressor to flow into the bypass passage. Since the refrigerant flowing through this bypass passage is always a high-temperature gas refrigerant, the high-temperature gas refrigerant is always supplied to the suction pipe of the second compressor. Accordingly, in the case where the first compressor is being operated and the second compressor is being stopped, during the time when the first compressor is in the state of wet vapor suction, the gas refrigerant supplied from the bypass passage is sufficient in terms of the flow rate of the refrigerant supplied to the first compressor via the shell of the second compressor. Hence, the pressure within the suction pipe of the second compressor rises, so that the liquid refrigerant is prevented from flowing into the second compressor. In addition, should the liquid refrigerant flow into the suction pipe of the second compressor, the liquid refrigerant is evaporated by the high-temperature gas refrigerant supplied from the bypass passage, so that the liquid refrigerant is prevented from flowing into the second compressor. Thus, in the case where the first compressor is being operated and the second compressor is being stopped, during the time when the first compressor is in the state of wet vapor suction, the absolute quantity of the lubricating oil in the second compressor does not decrease, and the concentration of the lubricating oil does not decline.

DETAILED DESCRIPTION OF THE PREFERRED EMBODIMENTS

First Embodiment

Referring to FIGS. 1, 2, 3, and 4, a description will be given of a first embodiment of the present invention.

Figure 1:
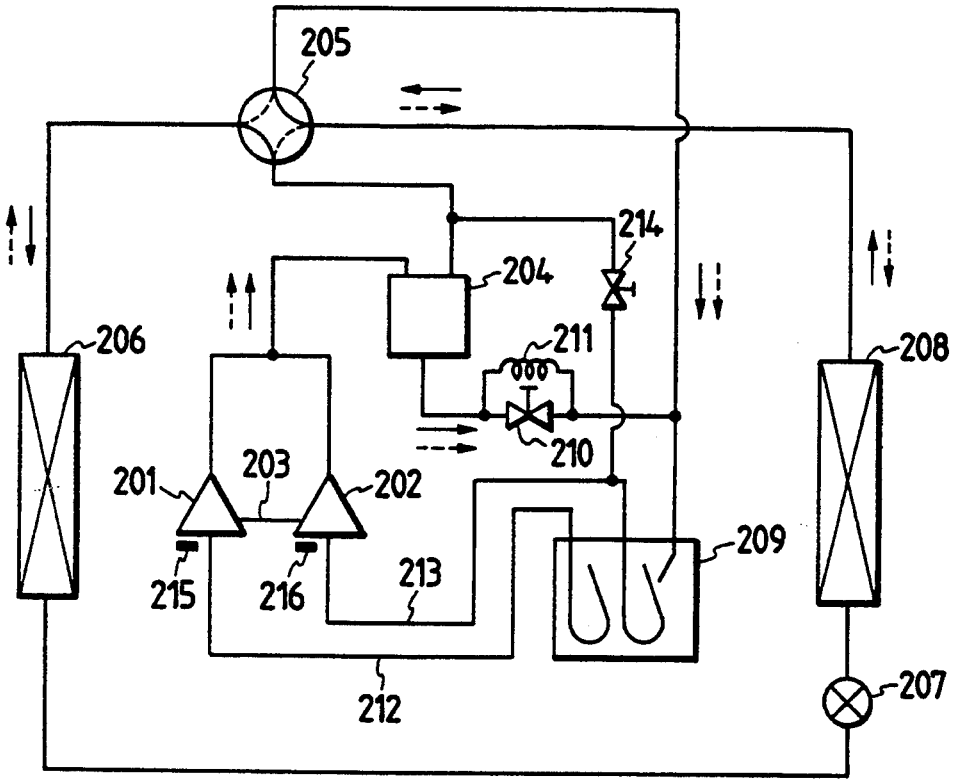
FIG. 1 is a refrigerant circuit diagram of a first embodiment.

FIG. 1 is a refrigerant circuit diagram in accordance with a first embodiment of the present invention. In the drawing, reference numerals 201 to 213 denote the same components as those shown in FIG. 53B which illustrates a conventional example. Reference numeral 214 denotes a solenoid on-off valve provided midway in a pipe connecting together a suction pipe 213 and a pipe between an oil separator 204 and a four-way change-over valve 205. Numerals 215 and 216 denote heaters for heating the compressor 201 and the compressor 202, respectively. It should be noted that the operation of the refrigerant during cooling and heating is similar to that of the air conditioner which has been described in the prior art, and description thereof will be omitted. When the compressor 201 is being operated and the compressor 202 is being stopped, if suction pressure of the compressor 201 drops, the internal pressure of the shell of the compressor 202 which communicates with it through the equalizing pipe 203 also drops. Wet refrigerant moves to the compressor 202 from the accumulator 209, though small in quantity, and condenses, so that the concentration of the lubricating oil in the compressor 202 decreases with the lapse of time. Hence, the solenoid on-off valve 214 is provided to allow the high-temperature, high-pressure discharge gas refrigerant to flow to the suction pipe 213 of the compressor 202, so as to increase the suction pressure and increase the degree of superheat of the suction gas, thereby preventing a decline in the concentration of the lubricating oil in the compressor 202.

Figure 2:
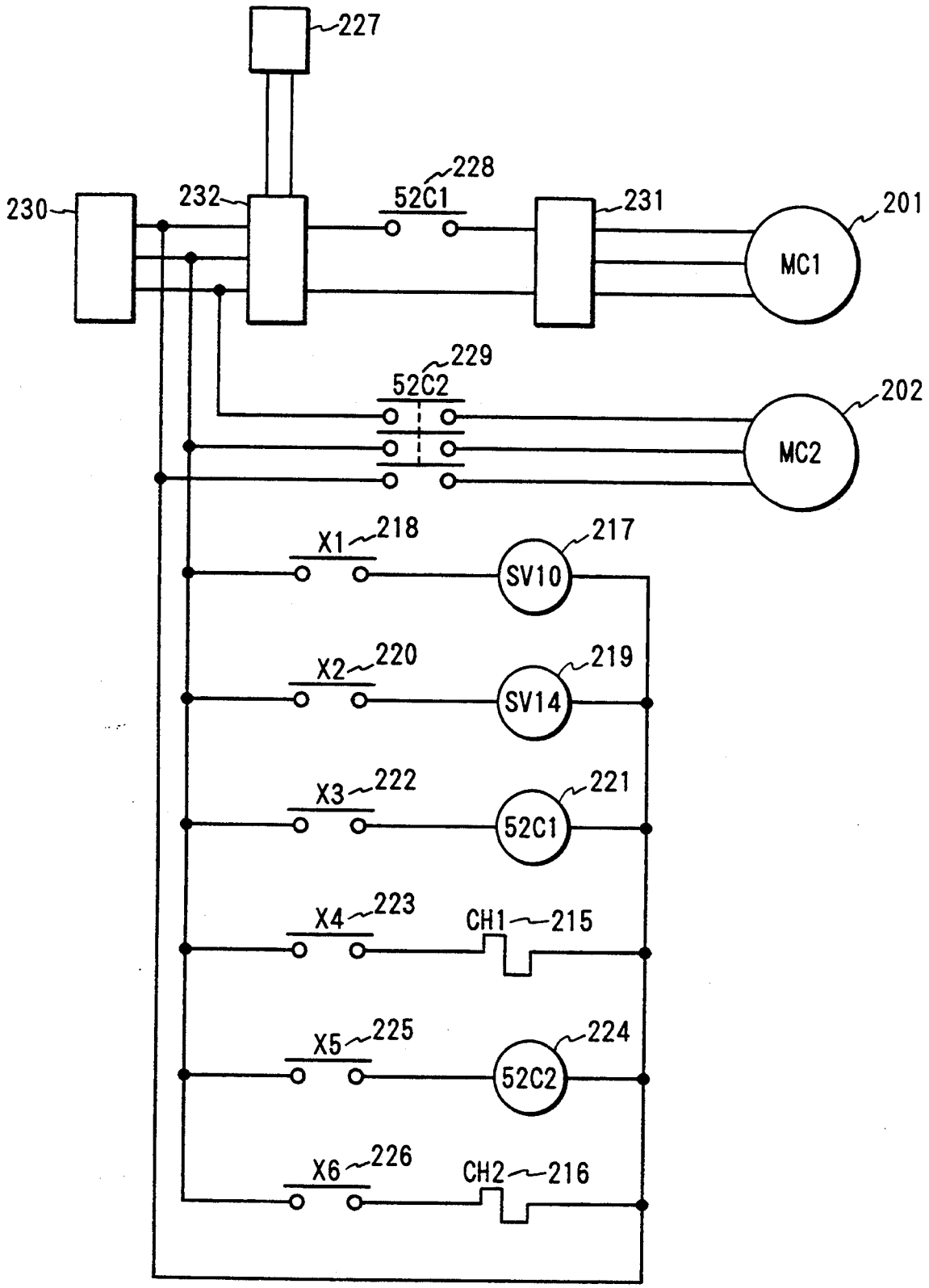
FIG. 2 is an electrical circuit diagram.

FIG. 2 is an electrical circuit diagram in accordance with the first embodiment. In the drawing, reference numeral 217 denotes a solenoid on-off valve coil of the solenoid on-off valve 210; 218, a power supply switch of the solenoid on-off valve coil 217; 219, a solenoid on-off valve coil of the solenoid on-off valve 214; 220, a power supply switch of the solenoid on-off valve coil 219; 221, a starter switch coil of the compressor 201; 222, a power supply switch of the starter switch coil 221; 223, a power supply switch of the heater 215; 224, a starter switch coil of the compressor 202; 225, a power supply switch of the starter switch coil 224; 226, a power supply switch of the heater 216; 227, an operation control unit serving as an example of the controlling device for the compressors 201 and 202 which uses the power supply as a driving source; 226, a starter switch of the compressor 201; 229, a starter switch of the compressor 202; 230, a main power supply; 231, a capacity-variably-changing unit; and 232, a dc converter.

Figure 3:
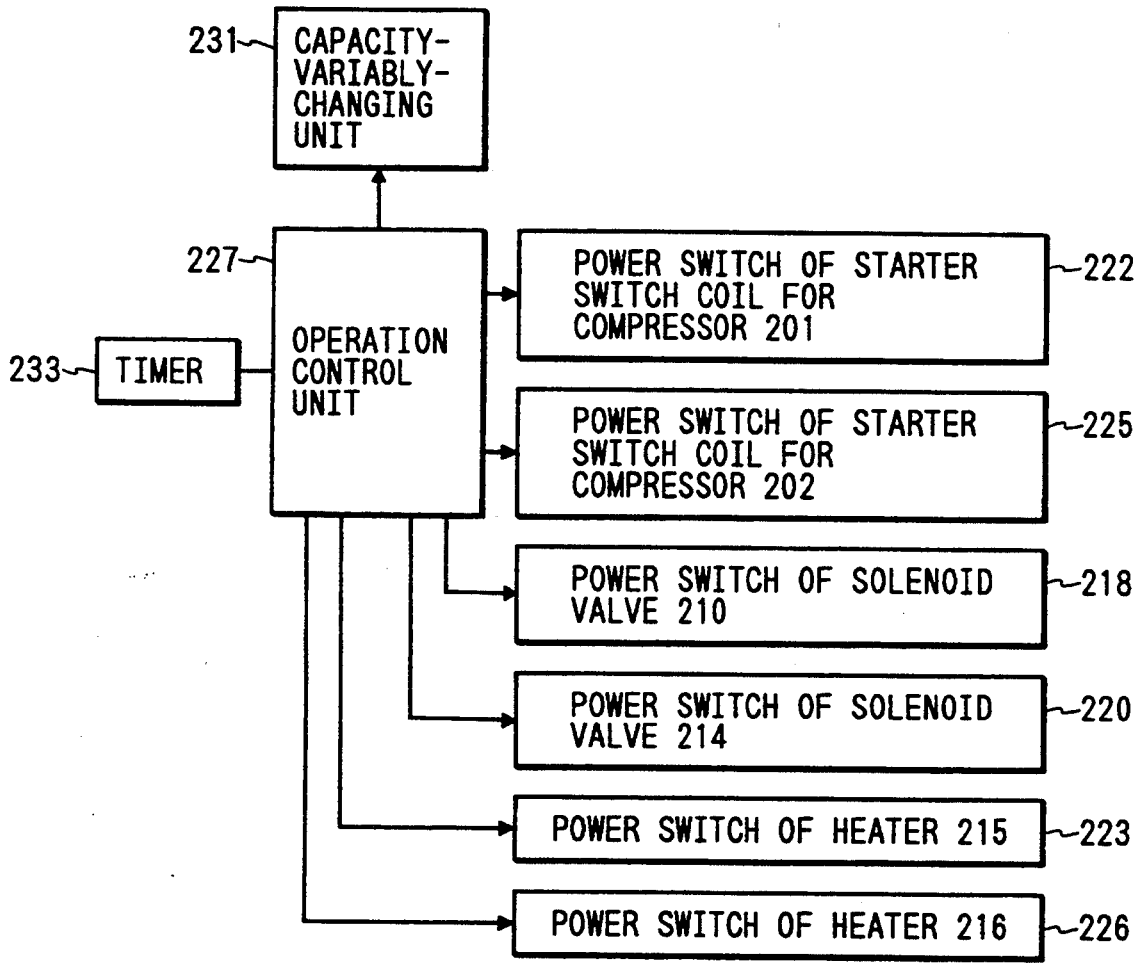
FIG. 3 is a control block diagram of the first embodiment.

FIG. 3 is a control block diagram, in which numeral 233 denotes a timer serving as an example of a first time measuring device.

Figure 4:
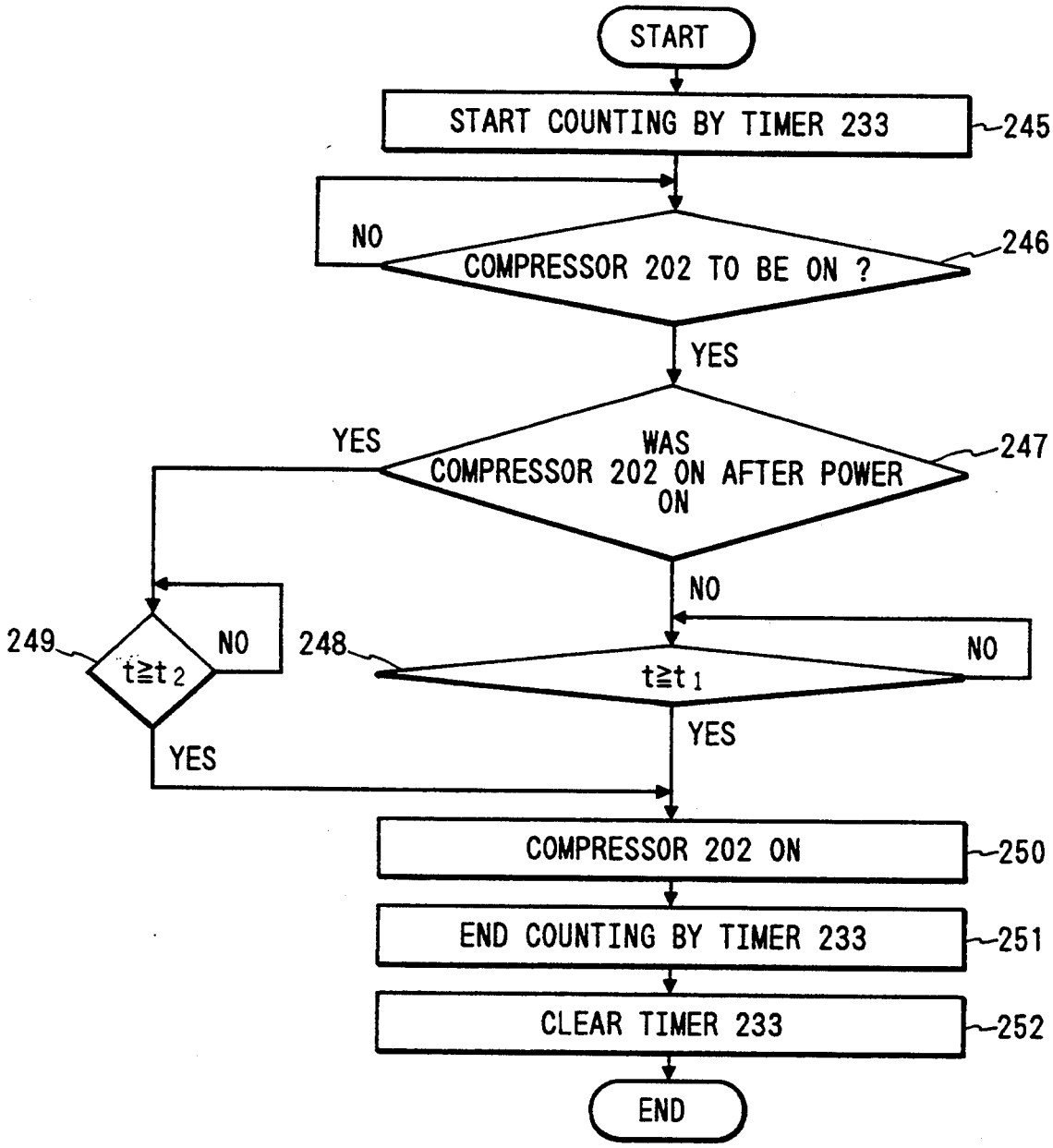
FIG. 4 is a control flowchart of the first embodiment.

FIG. 4 is a control flowchart in accordance with this embodiment.

Here, a description will be given of the operation of each component shown in FIG. 2. When the power supply switch 218 is turned on through the operation control unit 227, power is supplied to the solenoid on-off valve coil 217 to open the solenoid on-off valve 210. When the power supply switch 220 is turned on through the command from the operation control unit 227, power is supplied to the solenoid on-off valve coil 219 to open the solenoid on-off valve 214. When the power supply switch 222 is turned on through the command from the operation control unit 227, power is supplied to the starter switch coil 221 of the compressor 201, and the starter switch 228 is turned on. At this time, an alternating current supplied from the main power supply 230 is converted to a direct current by the dc converter 232, electric power of a predetermined capacity is supplied to the compressor 201 by the capacity-variably-changing unit 231, and the compressor 201 is operated. When the power supply switch 223 is turned on through the command from the operation control unit 227, the heater 215 of the compressor 201 is turned on to heat the compressor 201. When the power supply switch 225 is turned on through the command from the operation control unit 227, power is supplied to the starter switch coil 224 of the compressor 202, and the starter switch 229 is turned on. When the starter switch 229 is turned on, power is supplied to the compressor 202 from the main power supply 230, and the compressor 202 is operated. When the power supply switch 226 is turned on through the command from the operation control unit 227, the heater 216 of the compressor 202 is turned on to heat the compressor 202. The dc converter 232 also supplies power for the operation control unit 227 separately from power for the compressor 201.

Next, a description will be given of the flowchart shown in FIG. 4. When the compressor 201 is started, the timer 233 starts counting a time t (Step 245). Then, a determination is made as to whether or not the running capacity of the compressor 201 being outputted from the operation control unit 227 to the capacity-variably-changing unit 231 has reached a changing-over capacity for starting the compressor 202 (Step 246). If the changing-over capacity has not been reached, this control is reserved until the changing-over capacity is reached; if the changing-over capacity has been reached, the operation proceeds to Step 247. Then, if the compressor 202 had never been operated after the supply of power to the operation control unit 227, the operation proceeds to Step 248. If the compressor 202 had been operated even once, the operation proceeds to Step 249. In Step 248, a determination is made as to whether or not the time t counted by the timer 233 is longer than a first predetermined time t1 set in advance. If $t \geqq t1$, the operation proceeds to Step 250. On the other hand, if $t < t1$, counting is continued until $t \geqq t1$. In Step 249, control similar to that in Step 248 is effected, but a second predetermined time t2 is used for comparison with the time t. It should be noted that a relationship $t1 \geqq t2$ holds between the first predetermined time t1 and the second predetermined time t2. When the operation proceeds to Step 250, the compressor 202 is started, and the counting of the timer ends (Step 251), the time t is cleared (Step 252), and the control of this embodiment ends. It should be noted that, while the compressor 202 is being stopped, the power supply switch 226 is turned on to energize the heater 216 of the compressor 202, so as to promote the evaporation of the liquid refrigerant.

As a result, even if the compressor 201 is started with the refrigerant being held up in the compressor 201 when the compressor 201 is started for the first time upon turning on of the power, the compressor 202 is not started before a predetermined time elapses. Hence, the time duration when the mixed liquid of the refrigerant and the lubricating oil in the compressor 202 is supplied to the compressor 201 through the equalizing pipe 203 is prolonged, so that even if some lubricating oil is discharged together with the refrigerant due to foaming caused by a decline in suction pressure during the starting of the compressor 201, the lubricating oil does not run short.

Furthermore, even if a large quantity of refrigerant is accumulated in the accumulator 209 before starting, that quantity can be reduced sufficiently by prolonging the first predetermined time t1. Hence, a large quantity of wet vapor suction does not occur when the compressor 202 is started, so that a decline in the concentration of the lubricating oil or liquid compression do not occur.

Second Embodiment

Similar operation and effects are obtained if, in the first embodiment, the second predetermined time t2 is made as short as possible, or a setting is provided such that $t2=0$, and immediately when Step 249 is selected, the operation proceeds to Step 250 to start the compressor 202.

Third Embodiment

Figure 5:
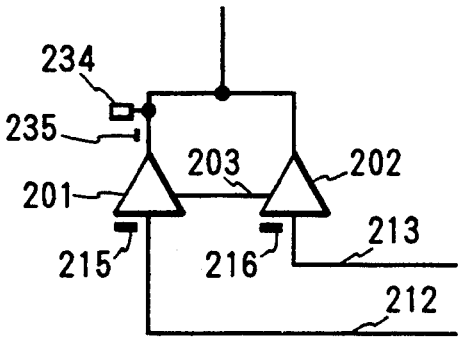
FIG. 5 is a part of a refrigerant circuit diagram of a third embodiment.

A refrigerant circuit diagram in accordance with this embodiment is shown in FIG. 5. The refrigerant circuit diagram in FIG. 5 shows only those portions that differ from those of the first embodiment, and a discharge-pressure sensor 234 and a discharge-temperature sensor 235 are provided in a discharge portion of the compressor 201. It should be noted that since the operation of the refrigerant and the lubricating oil during cooling and heating operations is similar to that of the first embodiment, description thereof will be omitted.

Figure 6:
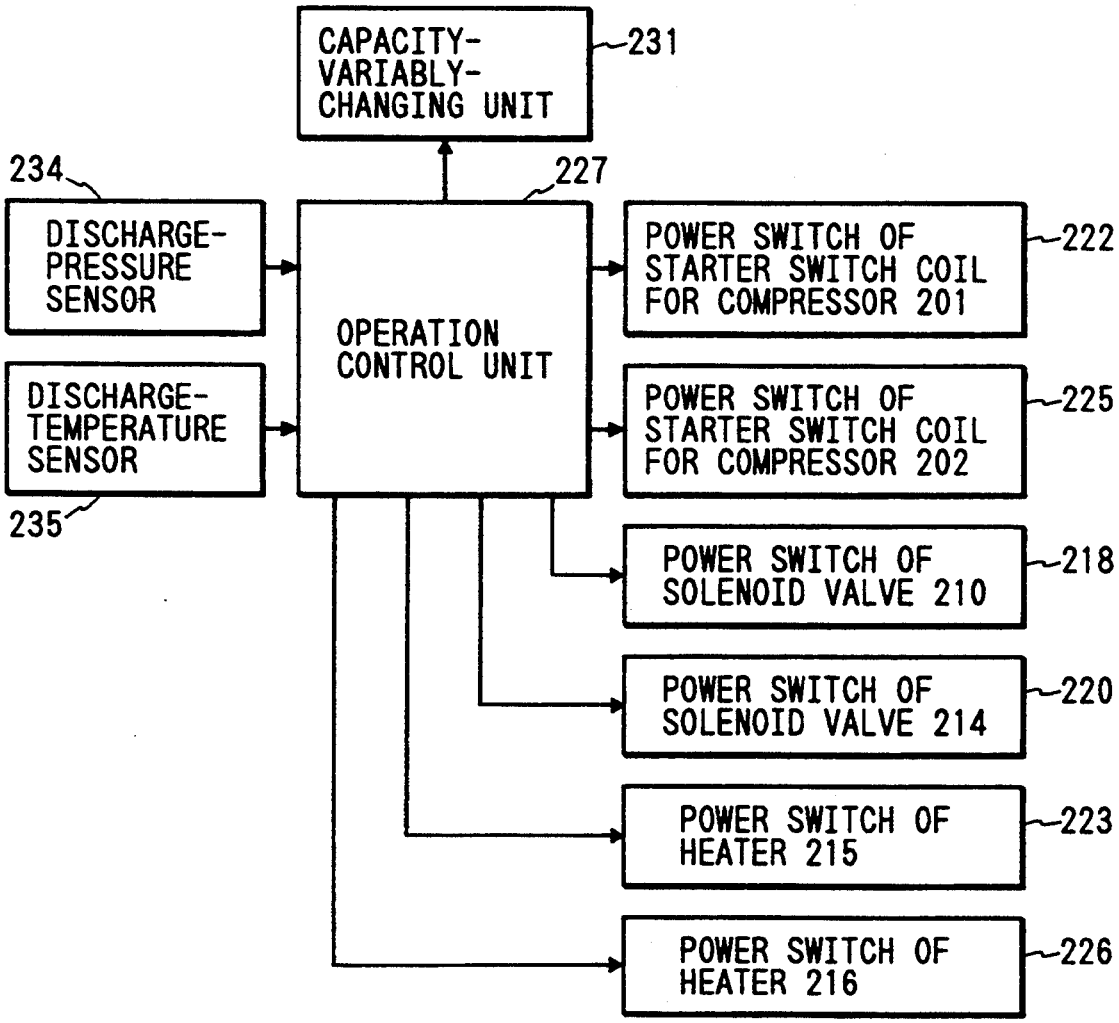
FIG. 6 is a control block diagram of the third embodiment.

FIG. 6 is a control block diagram in accordance with this embodiment, and as shown in this diagram, the discharge-pressure sensor 234 and the discharge-temperature sensor 235 for the refrigerant discharged from the compressor 201 are connected to the operation control unit 227. In the operation control unit 227, a first refrigerant superheat/temperature detecting device is arranged for simply calculating the degree of superheat of the refrigerant on the basis of the difference between the saturation temperature of the refrigerant in the pressure measured by the discharge-pressure sensor 234 and the actual temperature of the refrigerant measured by the discharge-temperature sensor 235. The other components are similar to those of the first embodiment except for the timer 233.

Figure 7:
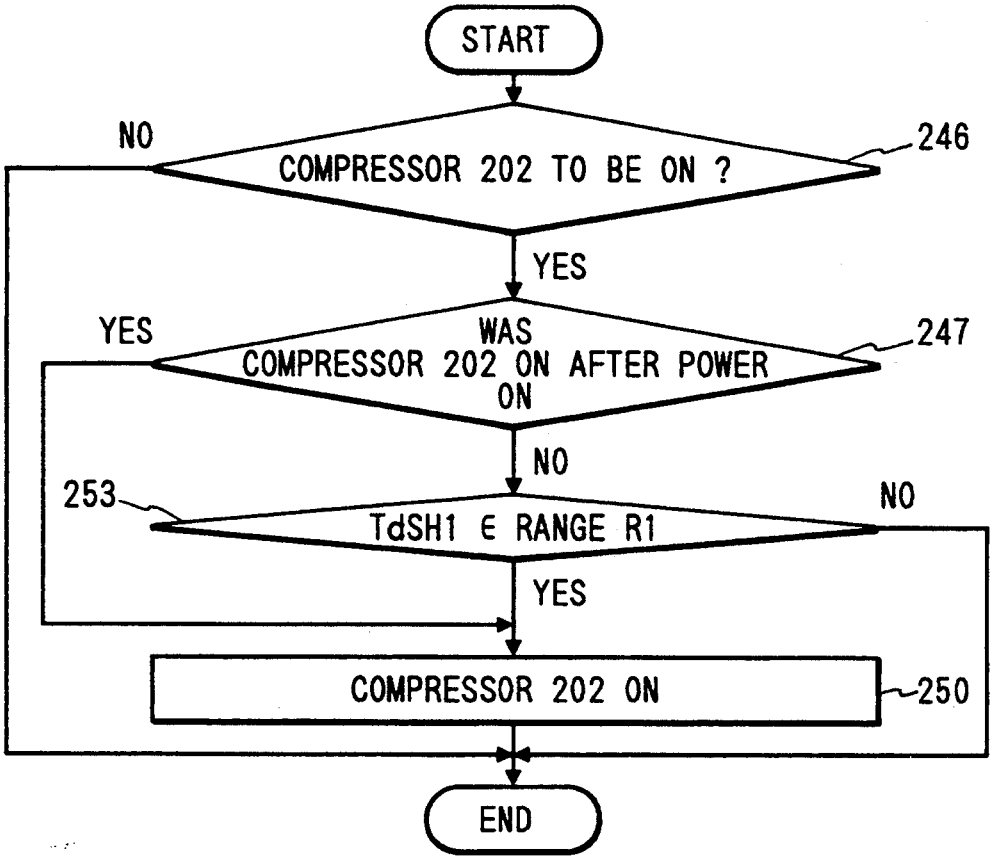
FIG. 7 is a control flowchart of the third embodiment.

A control flowchart is shown in FIG. 7. In this control, a determination is first made as to whether or not the running capacity of the compressor 201 outputted to the capacity-variably-changing unit 231 from the operation control unit 227 has reached a changing-over capacity for starting the compressor 202 (Step 246). If the changing-over capacity has not been reached, this control ends, whereas if the changing-over capacity has been reached, the operation proceeds to Step 247. In Step 247, if the compressor 202 had never been operated after the supply of power to the operation control unit 227, the operation proceeds to Step 253. In Step 253, if a degree of discharged-refrigerant superheat TdSH1 of the compressor 201 detected by the first refrigerant superheat detecting device is not within a predetermined range R1 set in advance, it is determined that the compressor is in a state of wet vapor suction, so that this control ends without starting the compressor 202. If the degree of discharged-refrigerant superheat TdSH1 is within the range R1, the operation proceeds to Step 250 to start the compressor 202. If it is determined in Step 247 that the compressor 202 had been operated even once, the operation similarly proceeds to Step 250 to start the compressor 202. Thus, this control ends. It should be noted that, while the compressor 202 is being stopped, the power supply switch 226 is turned on to energize the heater 216 of the compressor 202, so as to promote the evaporation of the liquid refrigerant.

By adopting the above-described process, it is possible to ascertain the state in which the state of wet vapor suction has been resolved in the compressor 201. Since the common accumulator 209 is used for both the compressor 201 and the compressor 202, even in a case where the compressor 202 is started for the first time after the turning on of power, wet vapor suction does not occur, so that a decline in the concentration of the lubricating oil or liquid compression do not occur.

Fourth Embodiment

Figure 8:
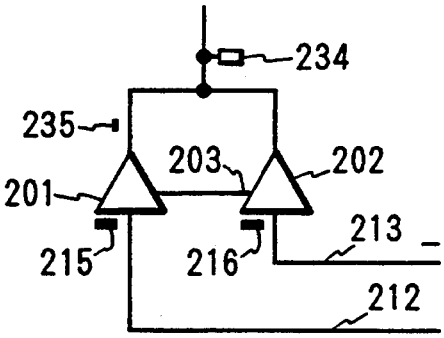
FIG. 8 is a part of a refrigerant circuit diagram of a fourth embodiment.

Even in a case where the position of the discharge-pressure sensor 234 in the third embodiment is located at or downstream of a converging portion of the discharge pipe of the compressor 201 and the discharge pipe of the compressor 202 as shown in FIG. 8, there is no major difference in the value detected by the discharge-pressure sensor 234, so that operation and advantages similar to those of the third embodiment are obtained.

Fifth Embodiment

Figure 9:
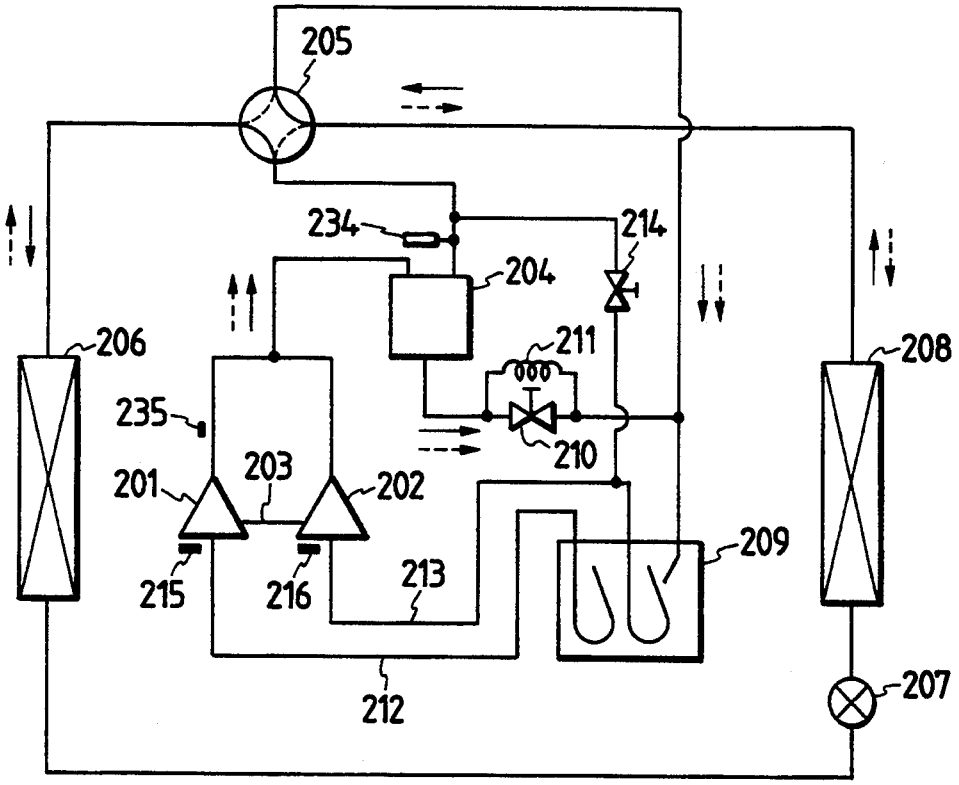
FIG. 9 is a refrigerant circuit diagram of a fifth embodiment.

Even in a case where the position of the discharge-pressure sensor 234 in the third embodiment is located between the oil separator 204 and the four-way change-over valve 205 as shown in FIG. 9, there is no major difference in the value detected by the discharge-pressure sensor 234, so that operation and advantages similar to those of the third embodiment are obtained.

Sixth Embodiment

Figure 10:
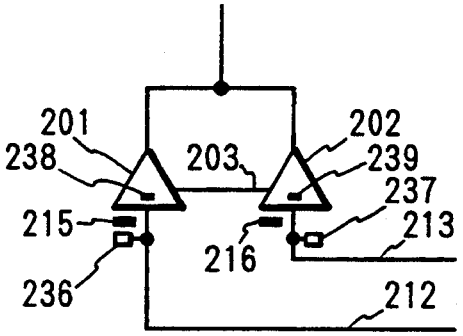
FIG. 10 is a part of a refrigerant circuit diagram of a sixth embodiment.

A refrigerant circuit diagram of this embodiment is shown in FIG. 10. The refrigerant circuit diagram in FIG. 10 shows only portions that differ from those of the first embodiment. A suction-pressure sensor 236 is provided in the suction pipe 212 of the compressor 201; a shell-temperature sensor 238 is provided on the body of the compressor 201; a suction-pressure sensor 237 is provided in the suction pipe of the compressor 202; and a shell-temperature sensor 239 is provided on the body of the compressor 202. It should be noted that since the operation of the refrigerant and the lubricating oil during cooling and heating operations is similar to that of the first embodiment, description thereof will be omitted.

Figure 11:
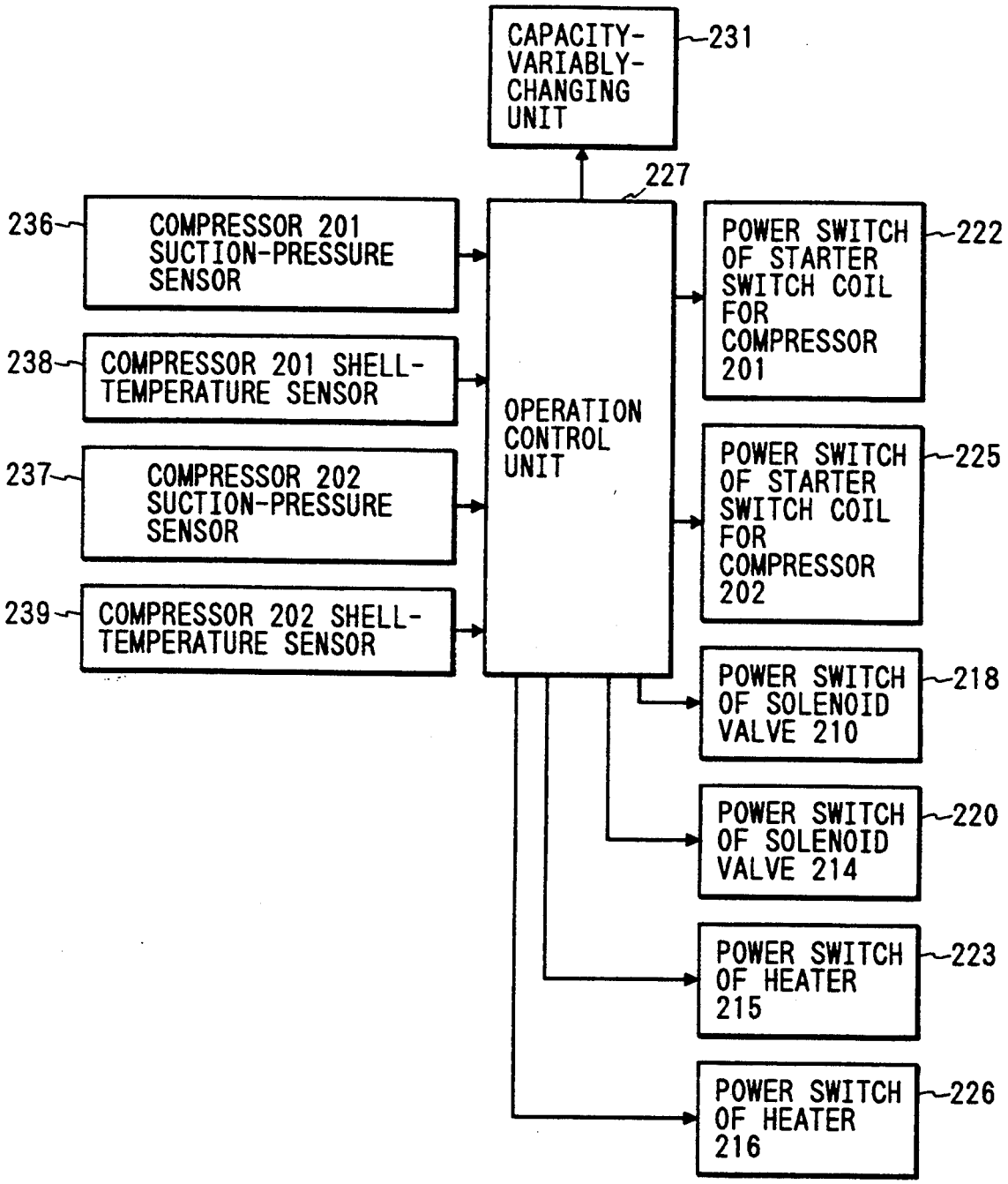
FIG. 11 is a control block diagram of the sixth embodiment.

As a control block diagram is shown in FIG. 11, the suction-pressure sensor 236 of the compressor 201, the shell-temperature sensor 238 of the compressor 201, the suction-pressure sensor 237 of the compressor 202, and the shell-temperature sensor 239 of the compressor 202 are connected to the operation control unit 227. In the operation control unit 227, a first lubricating-oil superheat detecting device is arranged for simply determining the degree of superheat of the lubricating oil on the basis of the difference between a saturation temperature determined from the value of the suction-pressure sensor 236 and the value of the shell-temperature sensor 238. Similarly, a second lubricating-oil superheat detecting device is arranged for determining the degree of superheat of the lubricating oil on the basis of the values of the suction-pressure sensor 237 and the shell-temperature sensor 239. The other components are similar to those of the first embodiment except for the timer 233. It should be noted that, as for the first lubricating-oil superheat detecting device and the second lubricating-oil superheat detecting device, only one of them may be provided.

Figure 12:
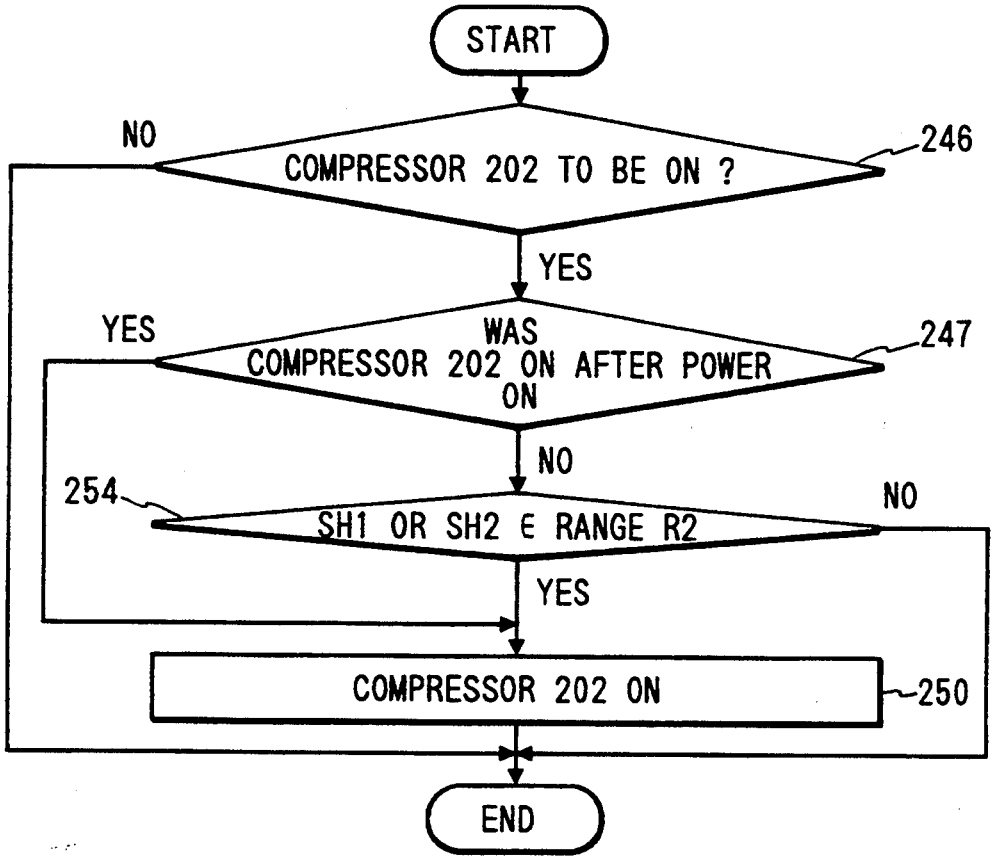
FIG. 12 is a control flowchart of the sixth embodiment.

A control flowchart is shown in FIG. 12. In this control, a determination is first made as to whether or not the running capacity of the compressor 201 outputted to the capacity-variably-changing unit 231 from the operation control unit 227 has reached a changing-over capacity for starting the compressor 202 (Step 246). If the changing-over capacity has not been reached, this control ends, whereas if the changing-over capacity has been reached, the operation proceeds to Step 247. In Step 247, if the compressor 202 had never been operated after the supply of power to the operation control unit 227, the operation proceeds to Step 254. In Step 254, if a degree of lubricating-oil superheat SH1 of the compressor 201 detected by the first lubricating-oil superheat detecting device or a degree of lubricating-oil superheat SH2 of the compressor 202 detected by the second lubricating-oil superheat detecting device is not within a predetermined range R2 set in advance, it is determined that the state is that of wet vapor suction or that of a low lubricating-oil concentration, so that control ends without starting the compressor 202. If the degree of lubricating-oil superheat SH1 or the degree of lubricating-oil superheat SH2 is within the range R2, the operation proceeds to Step 250 to start the compressor 202. If it is determined in Step 247 that the compressor 202 had already been started, the compressor 202 is similarly started in Step 250. Thus, this control ends. It should be noted that, while the compressor 202 is being stopped, the power supply switch 226 is turned on to energize the heater 216 of the compressor 202, so as to promote the evaporation of the liquid refrigerant.

Consequently, in the state in which the refrigerant is held up, the concentration of the lubricating oil in the compressor 201 during starting is low and the degree of superheat of the lubricating oil is also low. However, by continuing the operation, the concentration of the lubricating oil in the compressor 201 rises due to the return of oil from the accumulator 209, so that the degree of superheat of the lubricating oil also rises and becomes stable. Hence, by ascertaining the stable state of the concentration of the lubricating oil in the mixed liquid in the compressor 201, and by starting the compressor 202 in a state in which the concentration of the lubricating oil in the compressor 201 has become high, it becomes possible to supply the mixed liquid of the refrigerant and the lubricating oil with a high lubricating-oil concentration from the compressor 201 to the compressor 202 through the equalizing pipe 203.

In addition, it is similarly possible not to start the compressor 202 in a state in which the concentration of the lubricating oil in the compressor 202 is low.

Seventh Embodiment

Figure 13:
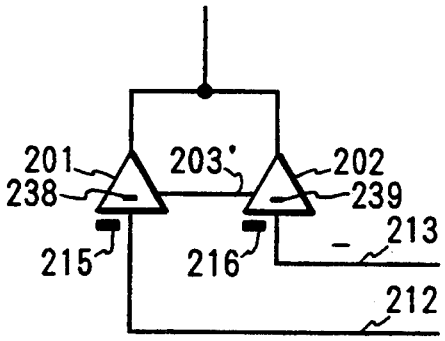
FIG. 13 is a part of a refrigerant circuit diagram of a seventh embodiment.

A refrigerant circuit diagram in accordance with this embodiment is shown in FIG. 13. The refrigerant circuit diagram in FIG. 13 shows only those portions that differ from those of the first embodiment. The compressor 201 is provided with the shell-temperature sensor 238 serving as a first temperature detecting device, and the compressor 202 is provided with the shell-temperature sensor 239 serving as a second temperature detecting device, so as to simply detect the temperature of the mixed liquid of the refrigerant and the lubricating oil in the shells of the compressor 201 and the compressor 202. It should be noted that since the operation of the refrigerant and the lubricating oil during cooling and heating operations are similar to those of the first embodiment, description thereof will be omitted. In addition, as for the first temperature detecting device and the second temperature detecting device, only one of them may be provided.

Figure 14:
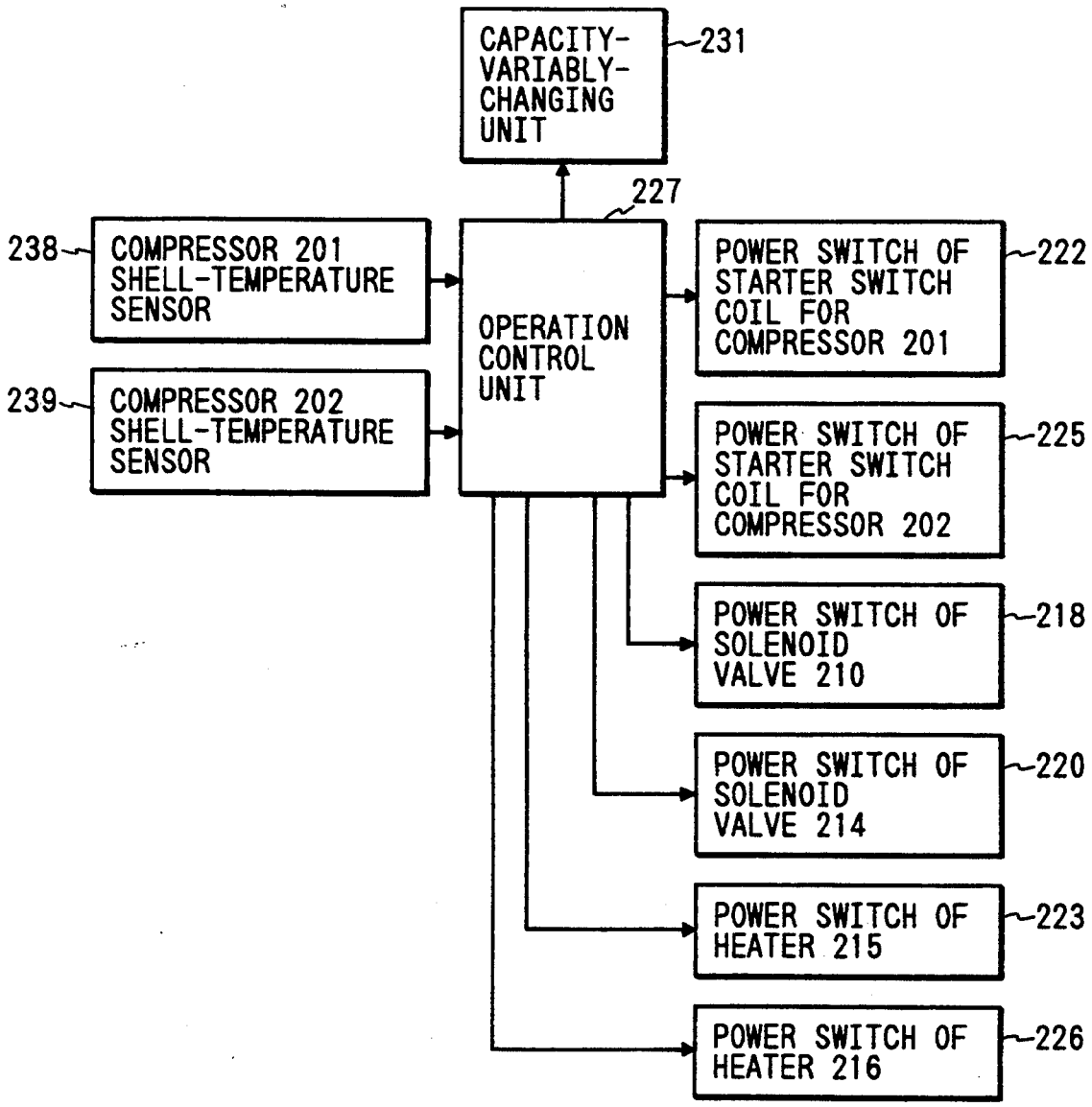
FIG. 14 is a control flowchart of the seventh embodiment.

As a control block diagram is shown in FIG. 14, the shell-temperature sensor 238 and the shell-temperature sensor 239 are connected to the operation control unit 227, and the other components are similar to those of the first embodiment except for the timer 233.

Figure 15:
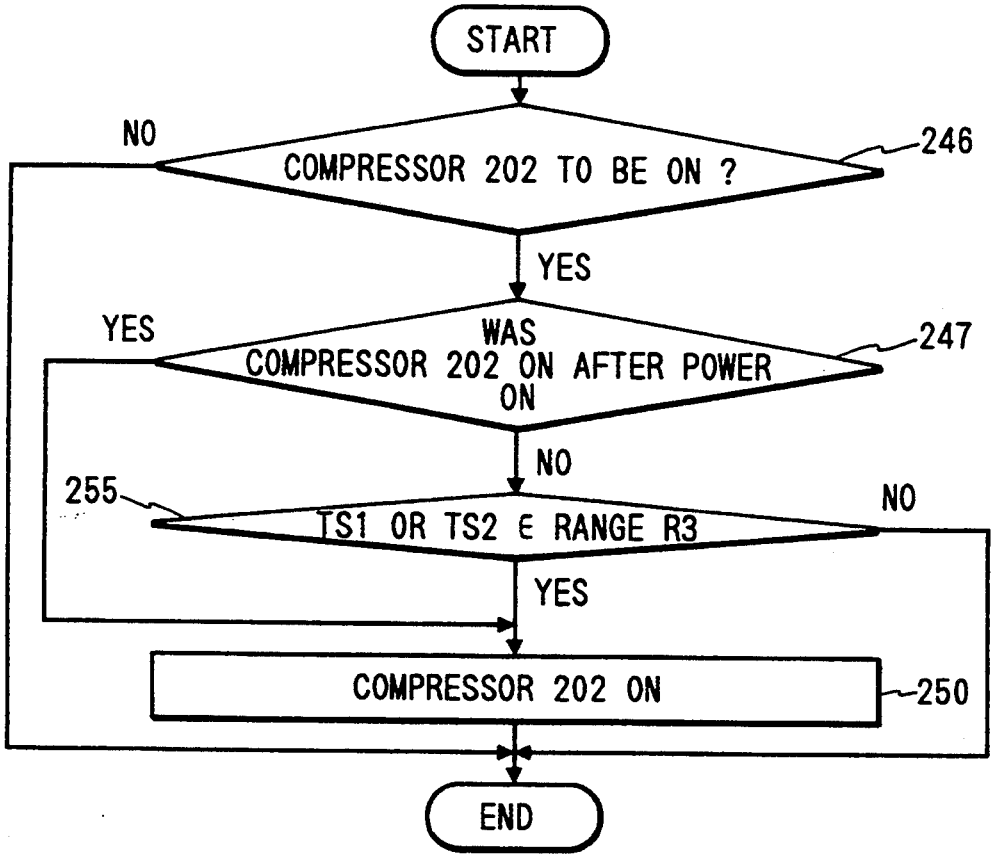
FIG. 15 is a control flowchart of the seventh embodiment.

A control flowchart is shown in FIG. 15. In this control, a determination is first made as to whether or not the running capacity of the compressor 201 outputted to the capacity-variably-changing unit 231 from the operation control unit 227 has reached a changing-over capacity for starting the compressor 202 (Step 246). If the changing-over capacity has not been reached, this control ends, whereas if the changing-over capacity has been reached, the operation proceeds to Step 247. In Step 247, if the compressor 202 had never been operated after the supply of power to the operation control unit 227, the operation proceeds to Step 255. In Step 255, if a temperature TS1 of the mixed liquid in the shell of the compressor 201 detected by the first shell-temperature sensor 238 or a temperature TS2 of the mixed liquid in the shell of the compressor 202 detected by the second shell-temperature sensor 239 is not within a predetermined range R3 set in advance, it is determined that the state is that of wet vapor suction or that of a low lubricating-oil concentration, so that control ends without starting the compressor 202. If the temperature TS1 of the mixed liquid in the shell of the compressor 201 or the temperature TS2 of the mixed liquid in the shell of the compressor 202 is within the range R3, the operation proceeds to Step 250 to start the compressor 202. If it is determined in Step 247 that the compressor 202 had already been started, the compressor 202 is similarly started in Step 250. Thus, this control ends. It should be noted that, while the compressor 202 is being stopped, the power supply switch 226 is turned on to energize the heater 216 of the compressor 202, so as to promote the evaporation of the liquid refrigerant.

Consequently, in the state in which the refrigerant is held up, the concentration of the lubricating oil in the compressor 201 during starting is low, and foaming or the like occurs during starting owing to a sudden drop in the suction pressure. Hence, the liquid refrigerant is evaporated, and the temperature of the mixed liquid declines. However, by continuing the operation, the suction pressure rises, the temperature of the mixed liquid also rises, and the concentration of the lubricating oil in the compressor 201 also rises due to the return of oil from the accumulator 209. Thus, even if the compressor 202 is started, the mixed liquid of a high concentration can be supplied from the compressor 201 to the compressor 202 via the equalizing pipe 203.

In addition, if the pressure drops during the starting of the compressor 201, since the compressors communicate with each other via the equalizing pipe 203, the pressure of the compressor 202 being stopped also declines, and the temperature of the mixed liquid drops due to the evaporation of the refrigerant in the mixed liquid. However, if the state of operation of the compressor 201 becomes stable, the temperature of the mixed liquid in the compressor 202 also becomes stable. In such a stable state, the concentration of the lubricating oil in the mixed liquid in the compressor 201 rises, so that even if the compressor 202 is started, the mixed liquid of a high concentration can be supplied to the compressor 202 via the equalizing pipe 203.

In addition, it is similarly possible not to start the compressor 202 in a state in which the concentration of the lubricating oil in the compressor 202 is low.

Eighth Embodiment

Since the refrigerant circuit diagram of this embodiment is similar to that of the first embodiment, the refrigerant circuit diagram will be omitted. In addition, since the operation of the refrigerant and the lubricating oil during cooling and heating operations is similar to that of the first embodiment, description thereof will be omitted.

Figure 16:
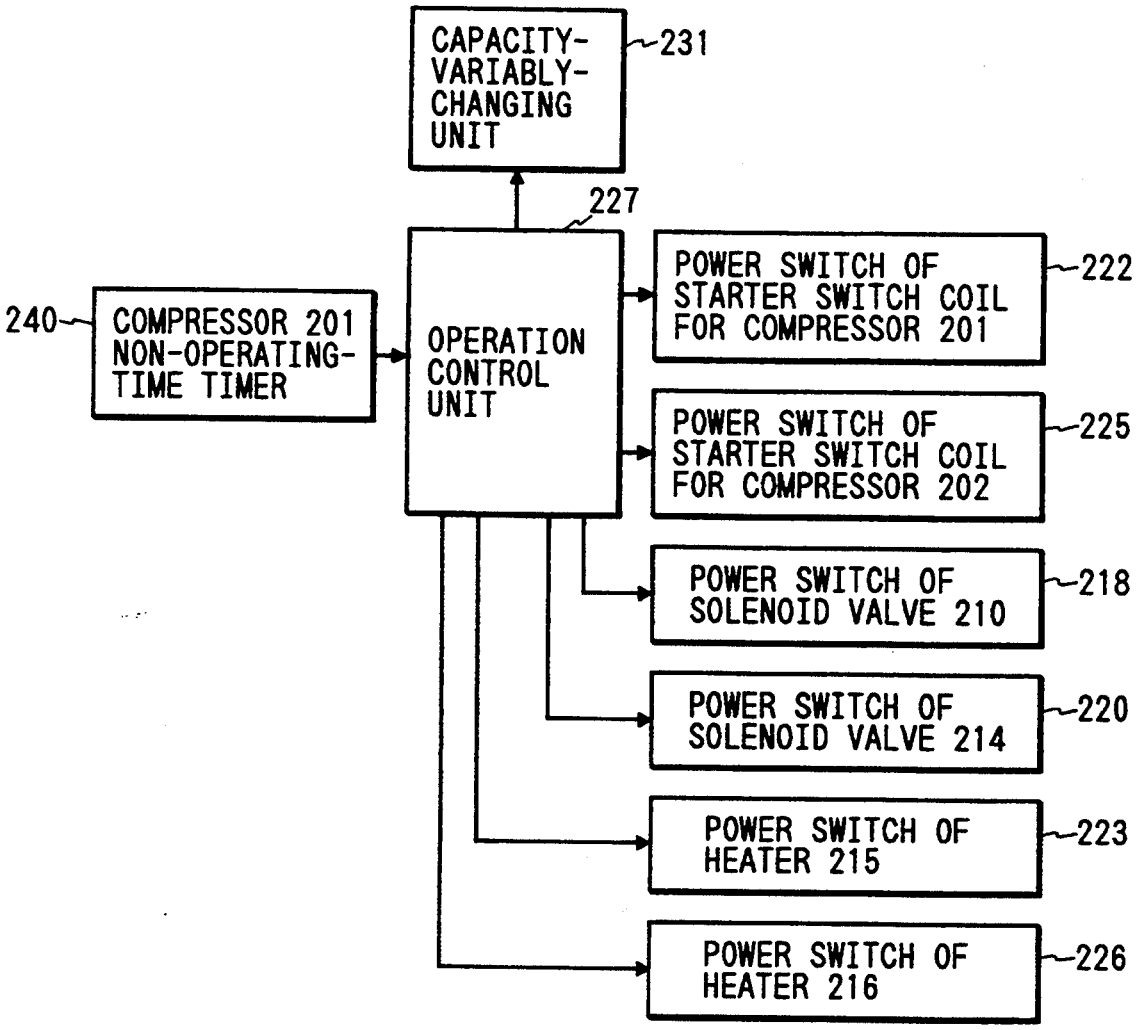
FIG. 16 is a control block diagram of an eighth embodiment.

As a control block diagram is shown in FIG. 16, a timer 240 for measuring the non-operating time of the compressor 201 is provided as a second time measuring device, and the other components are similar to those of the first embodiment except for the timer 233.

Figure 17:
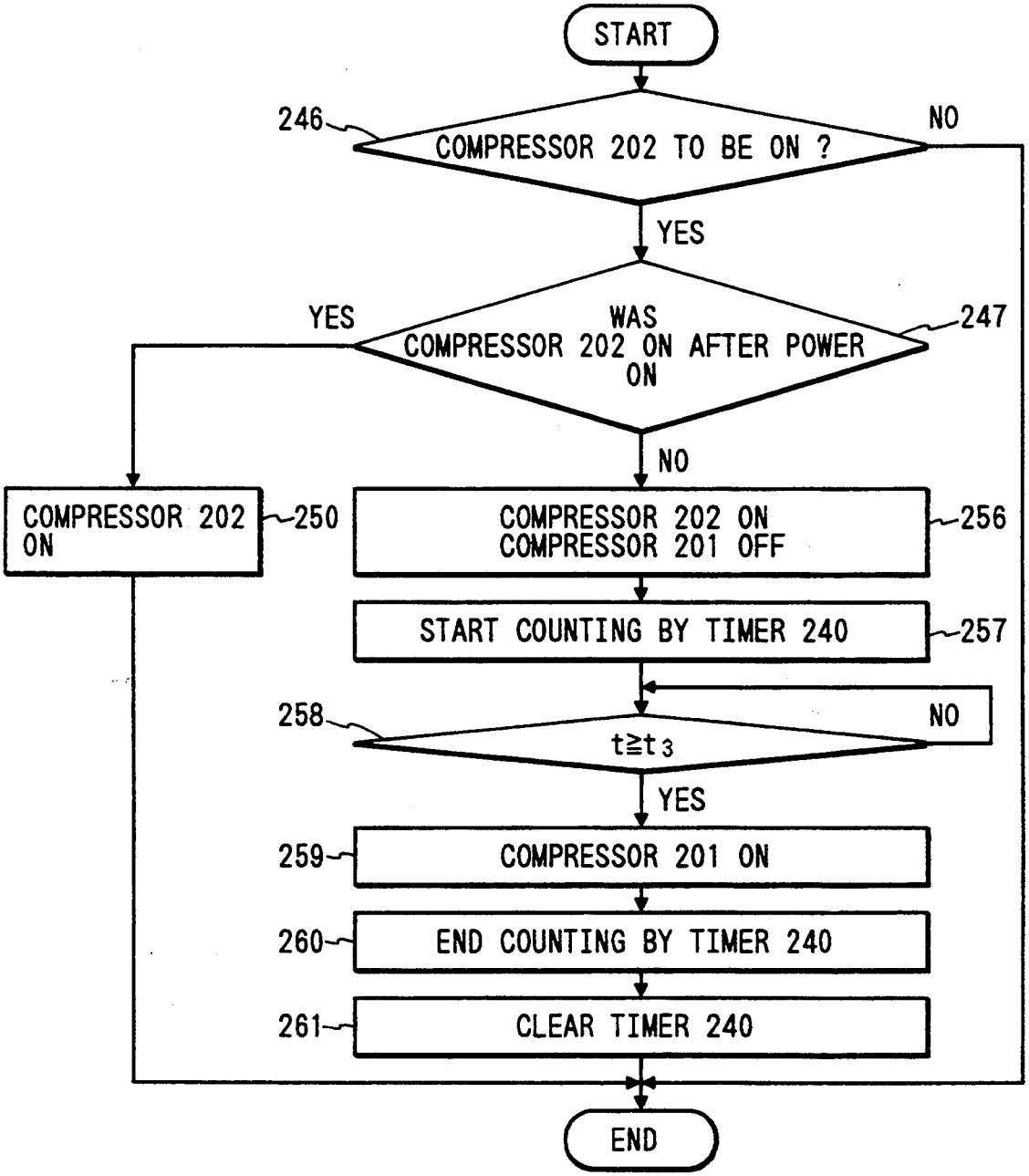
FIG. 17 is a control flowchart of the eighth embodiment.

A control flowchart is shown in FIG. 17. In this control, a determination is first made as to whether or not the running capacity of the compressor 201 outputted to the capacity-variably-changing unit 231 from the operation control unit 227 has reached a changing-over capacity for starting the compressor 202 (Step 246). If the changing-over capacity has not been reached, this control ends, whereas if the changing-over capacity has been reached, the operation proceeds to Step 247. In Step 247, if the compressor 202 had never been operated after the supply of power to the operation control unit 227, the operation proceeds to Step 256. In Step 256, the compressor 201 is stopped at the same time as the compressor 202 is started. Then, the non-operating time t of the compressor 201 is counted by the non-operating-time timer 240 (Step 257). In Step 258, a comparison is made between the non-operating time t and a predetermined time t3 set in advance, and if $t \geqq t3$, the compressor 201 is restarted (Step 259). If $t < t3$, the compressor 201 is stopped until $t \geqq t3$. If it is determined in Step 247 that the compressor 202 had already been started, the compressor 202 is started with the compressor 201 left as it is (Step 250), and this control ends. It should be noted that, while the compressor 201 is being stopped, the power supply switch 223 is turned on to energize the heater 215 of the compressor 201, so as to promote the evaporation of the liquid refrigerant.

Consequently, when the compressor 201 is stopped and the compressor 202 is started, since the pressure difference across the equalizing pipe 203 becomes large, the mixed liquid of a high lubricating-oil concentration can be supplied from the compressor 201 being stopped to the compressor 202 which was started.

As the compressor 202 is started, and the compressor 201 being stopped is restarted after the lapse of the time t3, the internal pressure of the shell of the compressor 201 which was restarted drops. Hence, the difference between the internal pressures of the shells of the compressor 201 and the compressor 202 becomes small, with the result that the quantity of lubricating oil moving from the compressor 201 to the compressor 202 through the equalizing pipe 203 also decreases. Meanwhile, in a case where the running capacity of the restarted compressor 201 is larger than the running capacity of the compressor 202, the suction pressure of the compressor 201 becomes lower than the suction pressure of the compressor 202, so that the lubricating oil flows from the compressor 202 to the compressor 201. Hence, the quantity of lubricating oil in the shell of the compressor 201 does not drop more than is necessary.

In addition, since the lubricating oil is returned together with the refrigerant from the accumulator 209 to the compressor 201 which was restarted after the lapse of the time t3, the quantity of lubricating oil in the shell of the compressor 201 does not drop more than is necessary.

Ninth Embodiment

Figure 18:
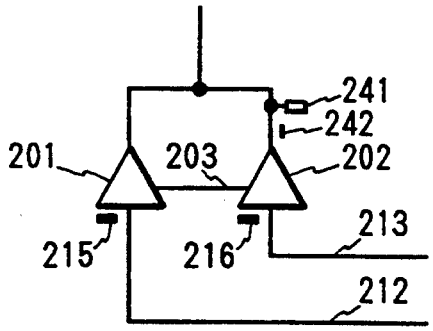
FIG. 18 is a part of a refrigerant circuit diagram of a ninth embodiment.

A refrigerant circuit diagram in accordance with this embodiment is shown in FIG. 18. The refrigerant circuit diagram in FIG. 18 shows only those portions that differ from those of the first embodiment, and the compressor 202 is provided with a discharge-pressure sensor 241 and a discharge-temperature sensor 242. It should be noted that since the operation of the refrigerant and the lubricating oil during cooling and heating operations is similar to that of the first embodiment, description thereof will be omitted.

Figure 19:
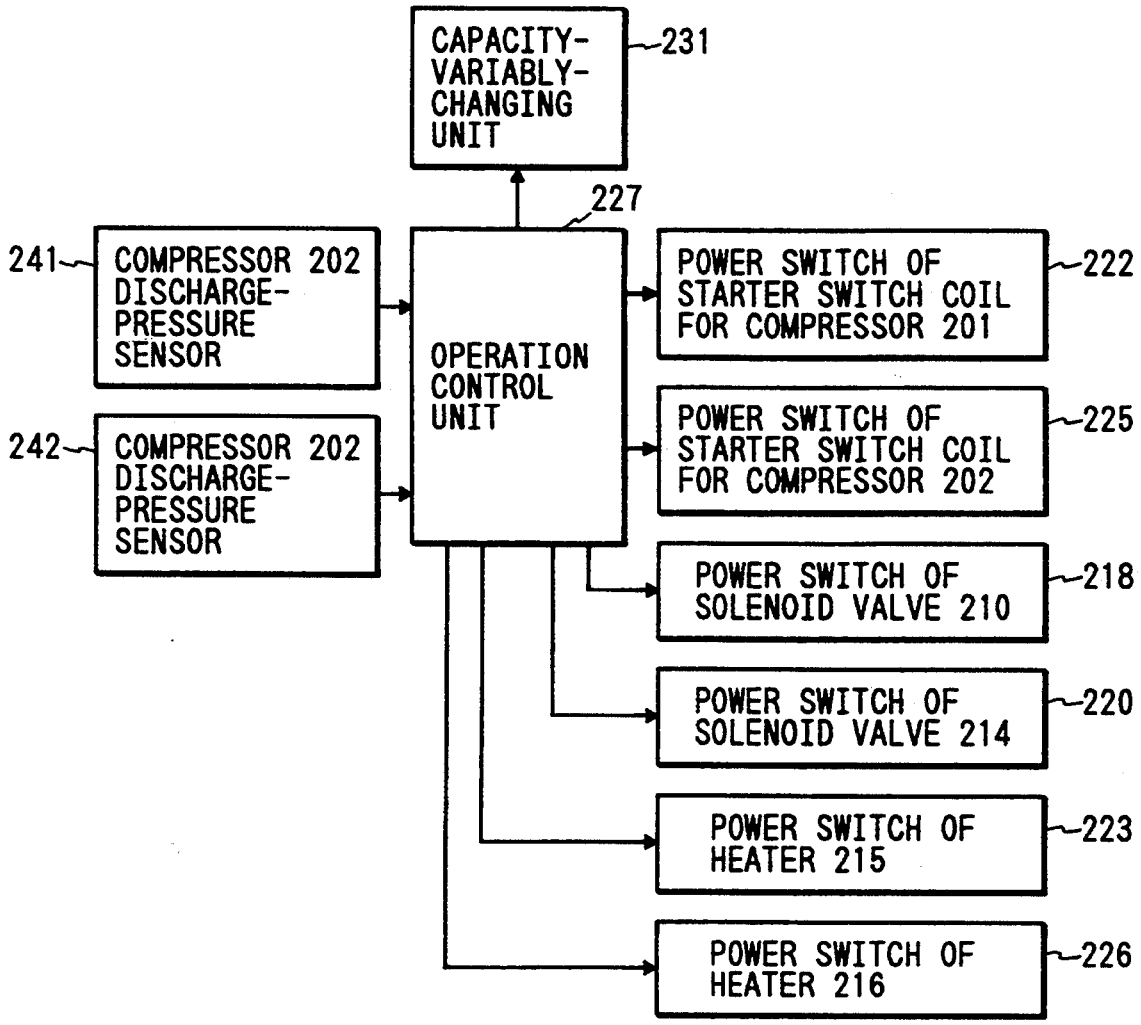
FIG. 19 is a control block diagram of the ninth embodiment.

As a control block diagram is shown in FIG. 19, the discharge-pressure sensor 241 and a discharge-temperature sensor 242 are connected to the operation control unit 227. In the operation control unit 227, a second refrigerant superheat/temperature detecting device is arranged for simply calculating the degree of superheat of the discharged refrigerant on the basis of the difference between the saturation temperature based on the value of the discharge-pressure sensor 241 and the value of the discharge-temperature sensor 242. The other components are similar to those of the first embodiment except for the timer 233.

Figure 20:
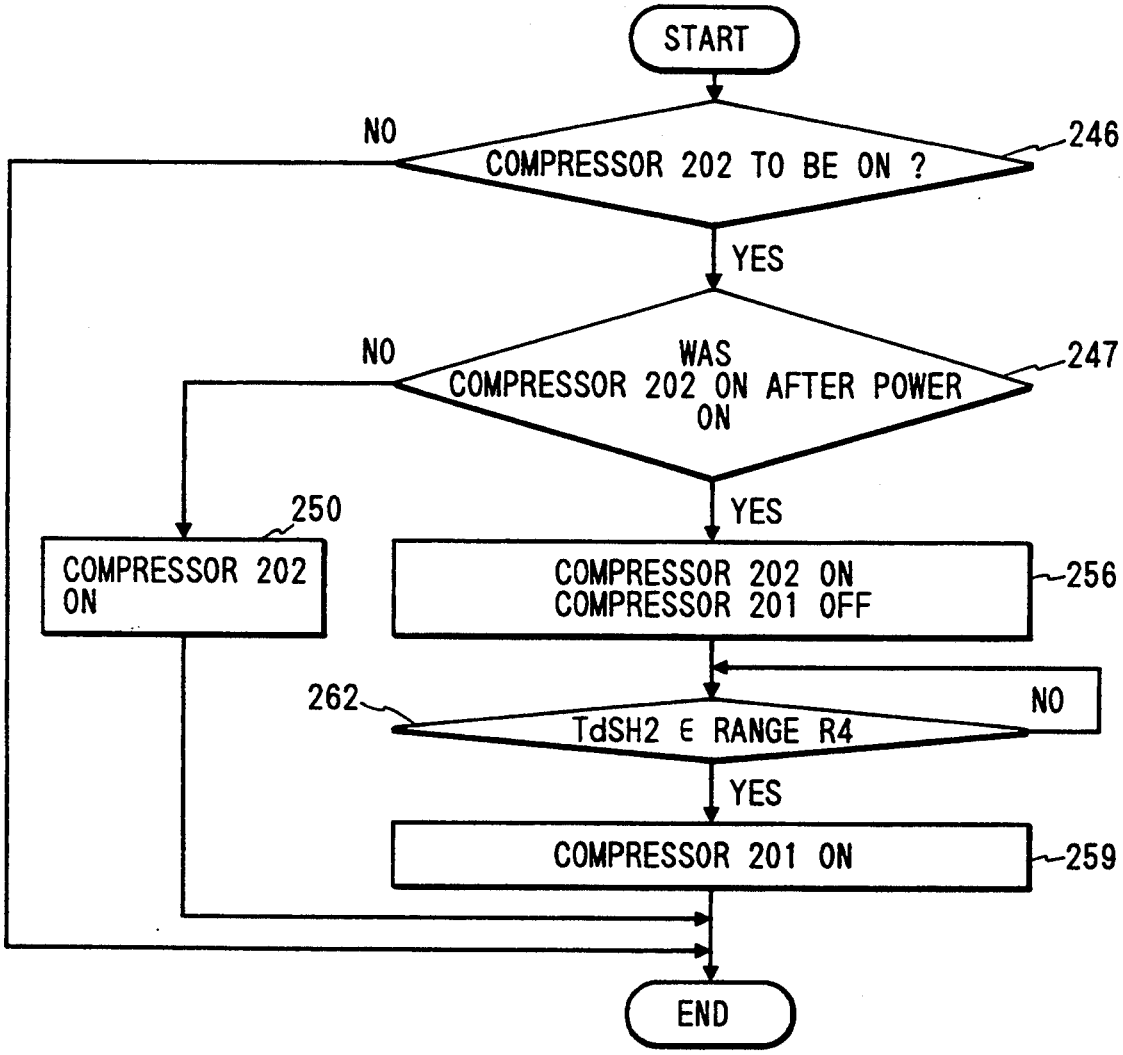
FIG. 20 is a control flowchart of the ninth embodiment.

A control flowchart is shown in FIG. 20. In this control, a determination is first made as to whether or not the running capacity of the compressor 201 outputted to the capacity-variably-changing unit 231 from the operation control unit 227 has reached a changing-over capacity for starting the compressor 202 (Step 246). If the changing-over capacity has not been reached, this control ends, whereas if the changing-over capacity has been reached, the operation proceeds to Step 247. In Step 247, if the compressor 202 had never been operated after the supply of power to the operation control unit 227, the operation proceeds to Step 256. In Step 256, the compressor 201 is stopped at the same time as the compressor 202 is started, and the operation proceeds to Step 262. In Step 262, the compressor 201 is kept stopped until a degree of discharged-refrigerant superheat TdSH2 detected by the second refrigerant superheat detecting device falls within a predetermined range R4 set in advance, and when the degree of discharged-refrigerant superheat TdSH2 has fallen within the range R4, the compressor 201 is restarted (Step 259). If it is determined in Step 247 that the compressor 202 had already been started, the compressor 202 is started with the compressor 201 left as it is (Step 250), and this control ends. It should be noted that, while the compressor 201 is being stopped, the power supply switch 223 is turned on to energize the heater 215 of the compressor 201, so as to promote the evaporation of the liquid refrigerant.

Consequently, when the compressor 201 is stopped and the compressor 202 is started, since the pressure difference across the equalizing pipe 203 becomes large, the mixed liquid of a high lubricating-oil concentration can be supplied from the compressor 201 being stopped to the compressor 202 which was started.

Furthermore, when the degree of superheat of the discharged refrigerant in the compressor 202 becomes large and stable, the oil is returned from the accumulator 209 even if the mixed liquid of lubricating oil is not supplied from the compressor 201. In this state, the compressor 201 being stopped is restarted. Since the internal pressure of the shell of the restarted compressor 201 drops, the difference between the internal pressures of the shells of the two compressors becomes small. Accordingly, the quantity of lubricating oil moving from the compressor 201 to the compressor 202 through the equalizing pipe 203 also decreases. Meanwhile, in a case where the running capacity of the restarted compressor 201 is larger than the running capacity of the compressor 202, the suction pressure of the compressor 201 becomes lower than the suction pressure of the compressor 202, so that the lubricating oil flows from the compressor 202 to the compressor 201. Hence, the quantity of lubricating oil in the shell of the compressor 201 does not drop more than is necessary.

10th Embodiment

Figure 21:
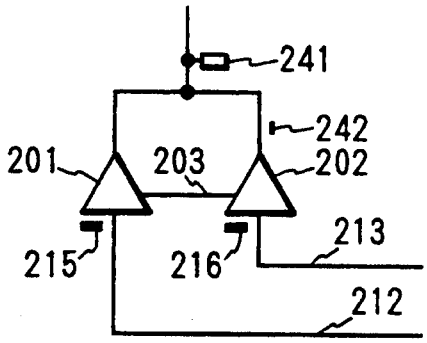
FIG. 21 is a refrigerant circuit diagram of a 10th embodiment.

Even in a case where the position of the discharge-pressure sensor 241 in FIG. 18 in the ninth embodiment is located at or downstream of the converging portion of the discharge pipe of the compressor 201 and the discharge pipe of the compressor 202 as shown in FIG. 21, there is no major difference in the value detected by the discharge-pressure sensor 241, so that operation and advantages similar to those of the ninth embodiment are obtained.

11th Embodiment

Figure 22:
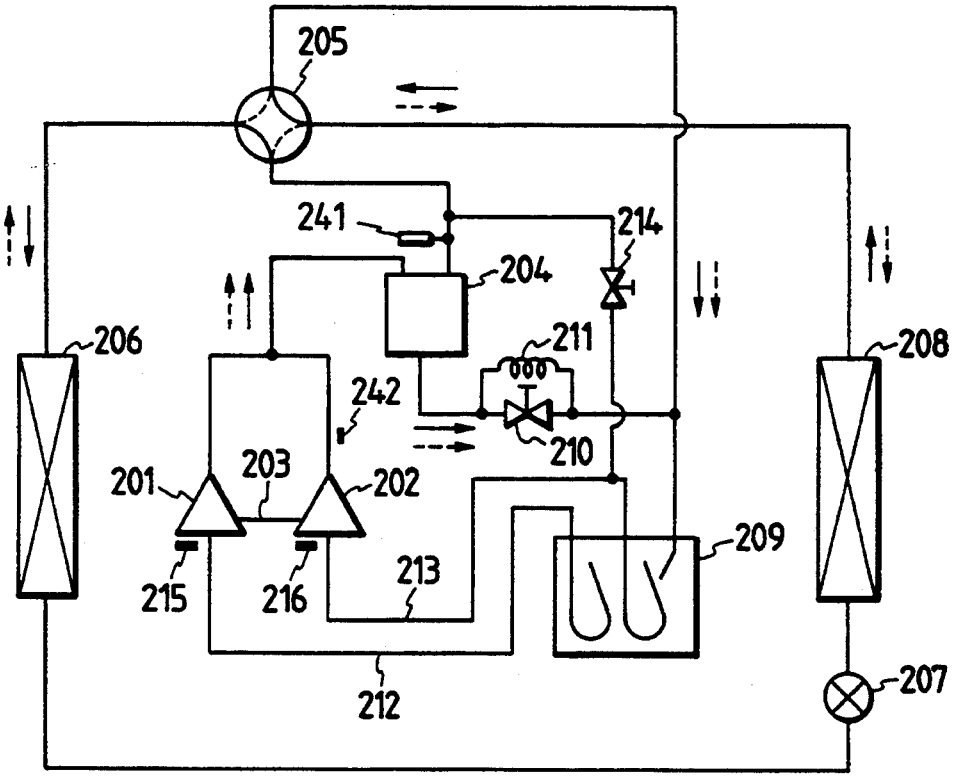
FIG. 22 is a refrigerant circuit diagram of an 11th embodiment.

Even in a case where the position of the discharge-pressure sensor 241 in the ninth embodiment is located between the oil separator 204 and the four-way change-over valve 205 as shown in FIG. 22, there is no major difference in the value detected by the discharge-pressure sensor 241, so that operation and advantages similar to those of the seventh embodiment are obtained.

12th Embodiment

Figure 23:
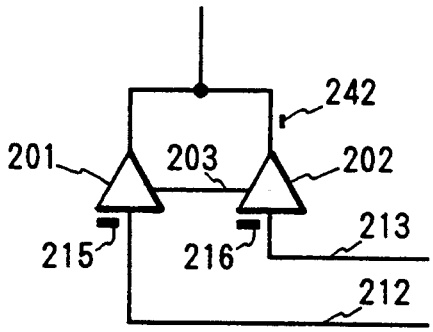
FIG. 23 is a part of a refrigerant circuit diagram of the 11th embodiment.

A refrigerant circuit diagram of this embodiment is shown in FIG. 23. The refrigerant circuit diagram in FIG. 23 shows only portions that differ from those of the first embodiment. The discharge-temperature sensor 242 serving as a third temperature detecting device is provided to detect the temperature of the discharged refrigerant from the compressor 202. It should be noted that since the operation of the refrigerant and the lubricating oil during cooling and heating operations is similar to that of the first embodiment, description thereof will be omitted.

Figure 24:
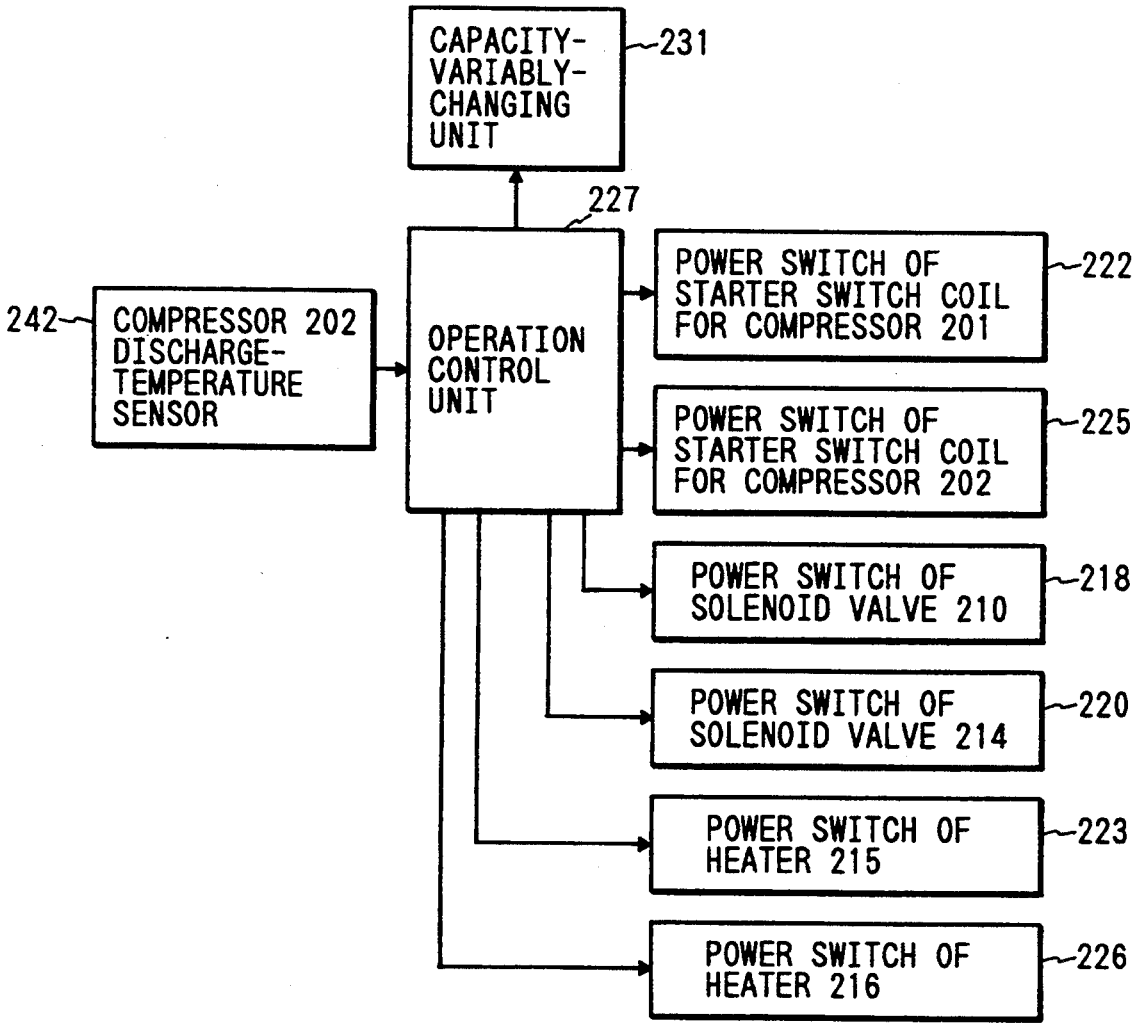
FIG. 24 is a control block diagram of a 12th embodiment.

As a control block diagram is shown in FIG. 24, the discharge-temperature sensor 242 is connected to the operation control unit 227, and the other components are similar to those of the first embodiment except for the timer 233.

Figure 25:
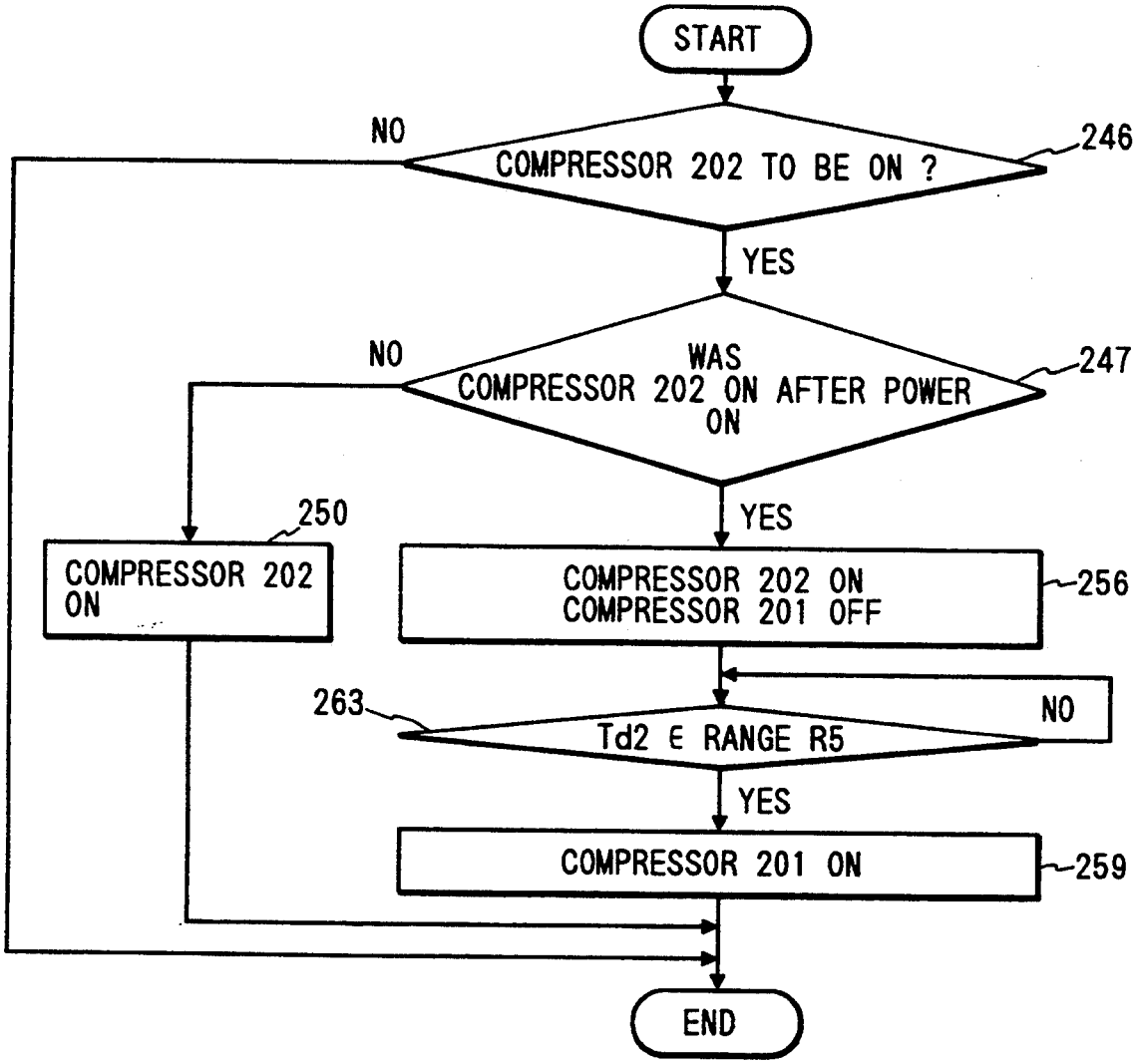
FIG. 25 is a control flowchart of the 12th embodiment.

A control flowchart is shown in FIG. 25. In this control, a determination is first made as to whether or not the running capacity of the compressor 201 outputted to the capacity-variably-changing unit 231 from the operation control unit 227 has reached a changing-over capacity for starting the compressor 202 (Step 246). If the changing-over capacity has not been reached, this control ends, whereas if the changing-over capacity has been reached, the operation proceeds to Step 247. In Step 247, if the compressor 202 had never been operated after the supply of power to the operation control unit 227, the operation proceeds to Step 256. In Step 256, the compressor 201 is stopped at the same time as the compressor 202 is started, and the operation proceeds to Step 263. In Step 263, the compressor 201 is kept stopped until a discharged-refrigerant temperature Td2 of the compressor 202 detected by the discharge temperature sensor 242 falls within a predetermined range R5 set in advance, and when the discharged-refrigerant temperature Td2 has fallen within the range R5, the compressor 201 is restarted (Step 259). If it is determined in Step 247 that the compressor 202 had already been started, the compressor 202 is started with the compressor 201 left as it is (Step 250), and this control ends. It should be noted that, while the compressor 201 is being stopped, the power supply switch 223 is turned on to energize the heater 215 of the compressor 201, so as to promote the evaporation of the liquid refrigerant.

Consequently, when the compressor 201 is stopped and the compressor 202 is started, since the pressure difference across the equalizing pipe 203 becomes large, the mixed liquid of a high lubricating-oil concentration can be supplied from the compressor 201 being stopped to the compressor 202 which was started.

Furthermore, in the operation in a state in which the atmospheric temperature is low, the discharge temperature of the compressor 202 is liable to increase, but the discharge temperature relatively drops in a state of wet vapor suction, and the discharge temperature rises as the operation becomes stabilized. Accordingly, when the discharged-refrigerant temperature Td2 of the compressor 202 falls within the range R5, the state of operation of the compressor 202 becomes stable, so that the oil is returned from the accumulator 209 even if the mixed liquid of lubricating oil is not supplied from the compressor 201. In this state, the compressor 201 being stopped is restarted. The internal pressure of the shell of the restarted compressor 201 drops, and the difference between the internal pressures of the shells of the two compressors becomes small. Accordingly, the quantity of lubricating oil moving from the compressor 201 to the compressor 202 through the equalizing pipe 203 also decreases. Meanwhile, in a case where the running capacity of the restarted compressor 201 is larger than the running capacity of the compressor 202, the suction pressure of the compressor 201 becomes lower than the suction pressure of the compressor 202, so that the lubricating oil flows from the compressor 202 to the compressor 201. Hence, the quantity of lubricating oil in the shell of the compressor 201 does not drop more than is necessary.

13th Embodiment

Since the refrigerant circuit diagram of this embodiment is similar to that of the first embodiment, the refrigerant circuit diagram will be omitted. In addition, since the operation of the refrigerant and the lubricating oil during cooling and heating operations is similar to that of the first embodiment, description thereof will be omitted.

Figure 26:
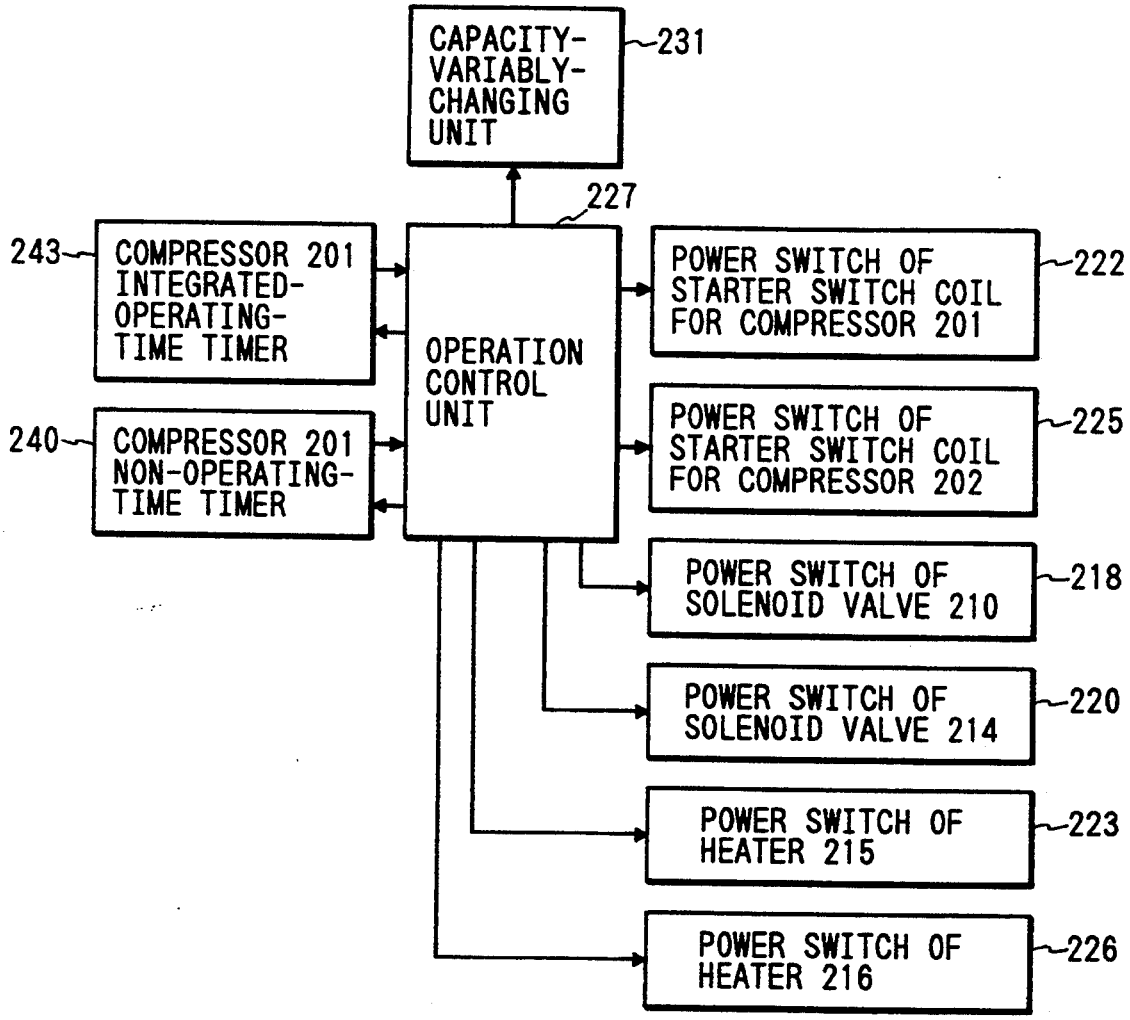
FIG. 26 is a control block diagram of a 13th embodiment.

As a control block diagram is shown in FIG. 26, a timer 243 for measuring the integrated operating time of the compressor 201, which serves as a third time measuring device, and the timer 240 for measuring the non-operating time of the compressor 201, which serves as the second time measuring device, are respectively connected to the operation control unit 227. The other components are similar to those of the first embodiment except for the timer 233.

Figure 27:
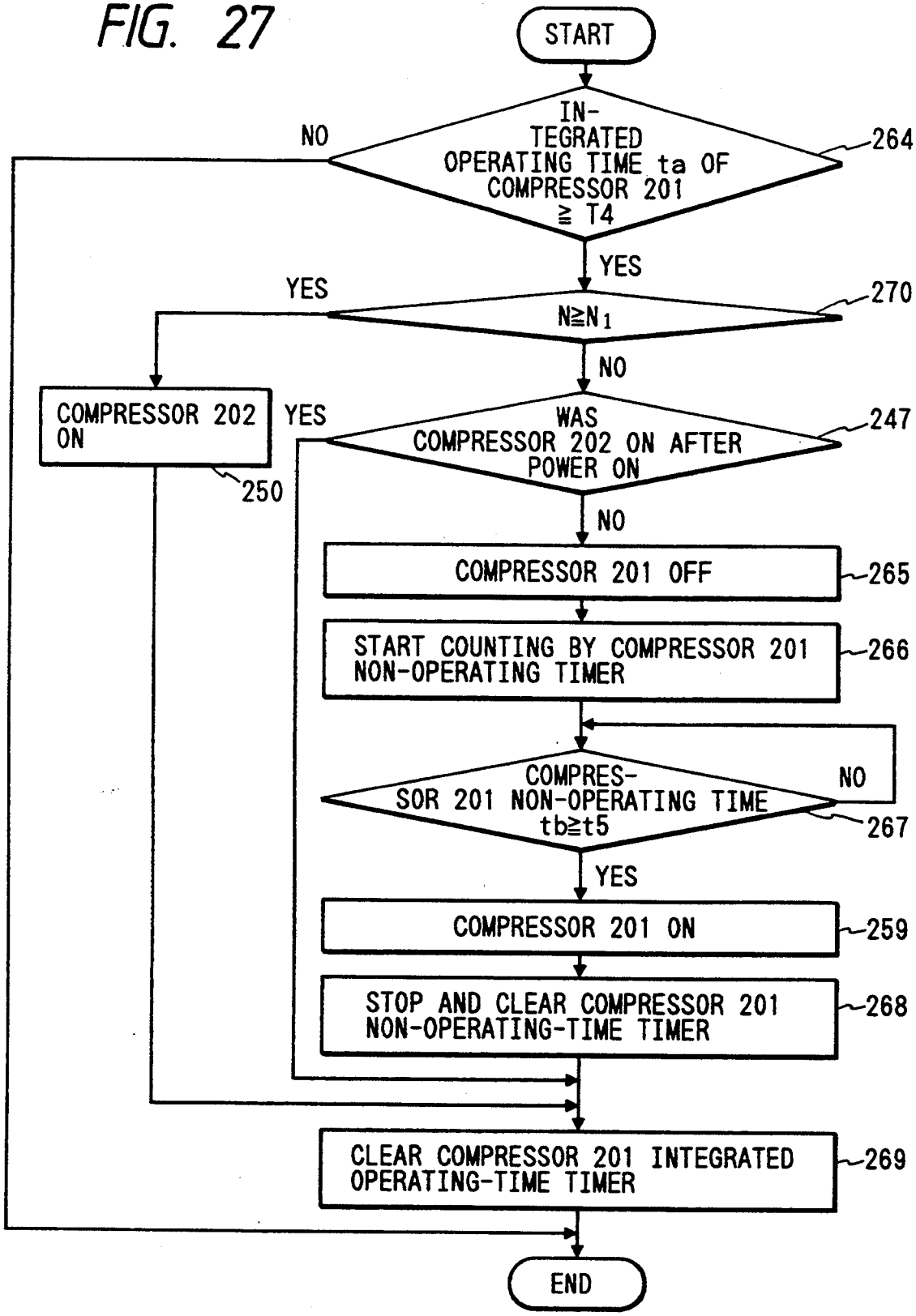
FIG. 27 is a control flowchart of the 13th embodiment.

A control flowchart is shown in FIG. 27. In this control, a comparison is first made between an integrated operating time ta of the compressor 201 measured by the timer 243 for measuring the integrated operating time and a predetermined time t4 set in advance. If $ta < t4$, this control ends, whereas if $ta \geqq t4$, the operation proceeds to Step 270 (Step 264). In Step 270, if the number of times N when the compressor 201 started running and was then stopped is equal to or greater than a predetermined number of times N1 set in advance, the compressor 202 is started in Step 250, and the operation proceeds to Step 269. If the number of times N is less than the predetermined number of times N1, the operation proceeds to Step 247. It should be noted that the number of times N is the number of times when control in Step 265 which will be described later was performed. In Step 247, a determination is made as to whether the compressor 202 had never been operated after the supply of power to the operation control unit 227. If the compressor 202 had been operated even once, the operation proceeds to Step 269. If the compressor 202 had never been operated, the compressor 201 is stopped (Step 265), the counting of the non-operating-time timer 240 of the compressor 201 is started (Step 266), and the operation proceeds to Step 267. In Step 267, a comparison is made between a non-operating time tb and a predetermined time t5 set in advance, and if $t \geqq t3$, the compressor 201 is kept stopped until $tb \geqq t5$. When the state $tb \geqq t5$ is reached, the compressor 201 is restarted (Step 259). Then, in Step 268, the non-operating-time timer 240 is stopped and cleared. In Step 269, the timer 243 for measuring the integrated operating time is cleared, and this control ends. It should be noted that, while the compressor 201 is being stopped, the power supply switch 223 is turned on to energize the heater 215 of the compressor 201, so as to promote the evaporation of the liquid refrigerant.

The liquid level of the compressor 201 is located at a position higher than the equalizing pipe 303 partly due to the return of oil from the accumulator 209, but the compressor 202, which is being stopped, is in a state in which its liquid level has been dropped to the height of the equalizing pipe 203. For this reason, in the above-described case, by stopping the compressor 201 to set the internal pressures of the two compressors at the same level, the oil can be returned from the compressor 201 to the compressor 202 owing to the difference between the level of the mixed liquid in the compressor 201 and the level of the mixed liquid in the compressor 202.

In addition, in a case where a state in which only the compressor 201 is being operated continues for a long time, by starting the compressor 202, it is possible to allow the oil to return from the accumulator 209, thereby increasing the quantity of lubricating oil in the compressor 202.

14th Embodiment

Hereafter, a description will be given of an embodiment of the present invention.

Figure 28:
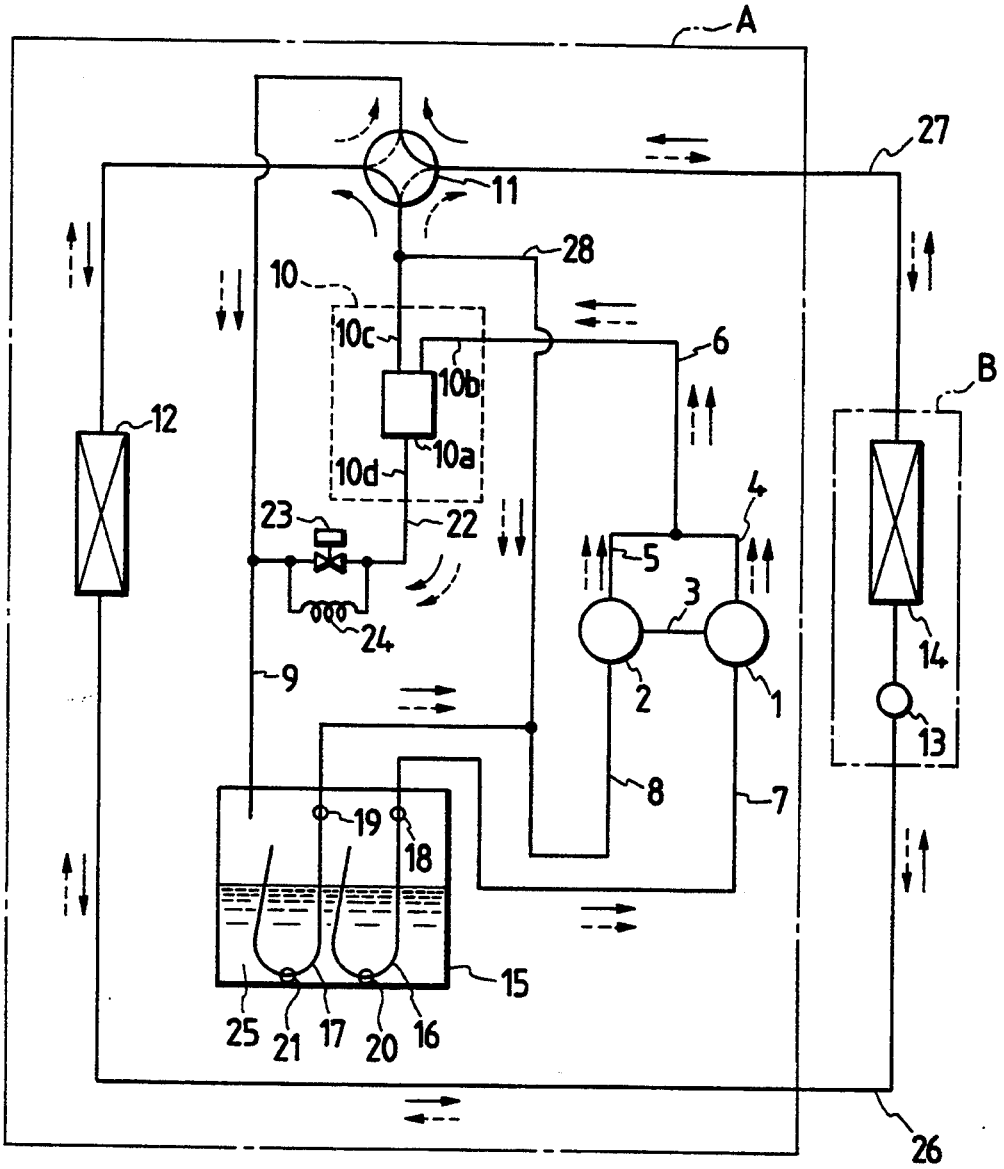
FIG. 28 is a refrigerant circuit diagram centering on a refrigerant system of an air conditioner in accordance with a first embodiment of the present invention.

FIG. 28 is a refrigerant circuit diagram of an air conditioner in accordance with an embodiment of the present invention. In the drawing, same reference characters or numerals with that shown in FIG. 53A denote component parts that are similar to those of the conventional air conditioner shown in FIG. 53A, and description thereof will be omitted here. Numeral 28 denotes a bypass passage which branches off midway in the pipe between the four-way changeover valve 11 and the outlet pipe **10*c* of the oil separator 10, converges with the suction pipe 8 between the accumulator 15 and the second compressor 2, and has a certain channel resistance (a much greater channel resistance than that of the main flow to the indoor unit B). In addition, it is assumed that in a case where the load on the indoor unit B is small and it is unnecessary for both the first and second compressors 1 and 2 to be operated, and either one of them needs to be operated, the first compressor 1 is unfailingly started and the second compressor 2 is stopped, and that in a case where starting is effected in a state in which both units are stopped, the first compressor 1 is first started, and if the load on the indoor unit is large and both units need to be operated, the second compressor 2** is additionally started. It should be noted that, in the drawing, the solid-line arrows indicate the direction of flow of the refrigerant during the cooling operation, while the broken-line arrows indicate the direction of flow of the refrigerant during the heating operation.

Since the operation of the refrigerant (including lubricating oil) during the cooling and heating operations is utterly the same as that of the conventional air conditioner shown in FIG. 53A except for a portion concerning the bypass passage 28, description thereof will be omitted here, and a description will be given of the portion concerning the bypass passage 28. The high-temperature, high-pressure gas refrigerant discharged from the first compressor 1 or the second compressor 2 flows into the outlet pipe 10c of the oil separator 10 via the oil separator 10, and part of the gas refrigerant flows into the bypass passage 28 here. Since the bypass passage 28 is branched off midway in the pipe between the four-way changeover valve 11 and the outlet pipe 10c of the oil separator 10, the liquid is separated by the oil separator 10, so that the refrigerant which flows into the bypass passage 28 is a gas refrigerant which is always at a high temperature. The high-temperature gas refrigerant, which has flown into the bypass passage 28 and has a much greater channel resistance than that of the main flow to the indoor unit B, undergoes pressure reduction to a low level while flowing through the bypass passage 28, and flows into the suction pipe 8 in the form of low-pressure, high-temperature gas refrigerant. When the first compressor 1 is being operated and the second compressor is being stopped, the pressure within the suction pipe 8 rises, so that neither the liquid refrigerant nor the gas refrigerant flows into the suction pipe 8 from the accumulator 15. When the first compressor 1 is being operated and the second compressor 2 is being stopped, the internal pressure of the shell of the second compressor 2 is higher than the internal pressure of the shell of the first compressor 1, so that most of the low-pressure, high-temperature gas refrigerant which has flown into the suction pipe 8 flows into the first compressor 1 via the second compressor 2 and the equalizing pipe 3. At this time, the level of a mixed liquid (a mixture of the lubricating oil and the liquid refrigerant) in the second compressor 2 drops until it reaches the position of the equalizing pipe 3, but it does not drop further than that; since the high-temperature gas refrigerant passes through the shell of the second compressor 2, the concentration of the lubricating oil does not decline. If the refrigerant flowing into the bypass passage 28 is in excess, part of it flows into the first compressor 1 via the accumulator 15 and the suction pipe 7. Accordingly, even if the liquid refrigerant is accumulated in the accumulator 15 when the first compressor 1 is being operated and the second compressor 2 is being stopped, the gas refrigerant which is supplied from the bypass passage 28 is sufficient in terms of the flow rate of the refrigerant supplied to the first compressor via the shell of the second compressor 2, so that the liquid refrigerant in the accumulator 15 does not flow into the second compressor 2. Also, should the liquid refrigerant in the accumulator 15 flow into the suction pipe 8, the liquid refrigerant is evaporated by the high-temperature gas refrigerant supplied from the bypass passage 28, so that the liquid refrigerant is prevented from flowing into the second compressor 2. Thus, even if the liquid refrigerant is accumulated in the accumulator 15 when the first compressor 1 is being operated and the second compressor 2 is being stopped, the absolute quantity of the lubricating oil in the second compressor 2 does not decrease, and the concentration of the lubricating oil does not decline. Hence, it is possible to obtain a highly reliable air conditioner in which a shortage of the lubricating oil or faulty lubrication due to such as the lack of viscosity of the lubricating oil do not occur when the second compressor is started, which may otherwise result in the breakage of the second compressor. It should be noted, however, that since the refrigerant flowing in the bypass passage 28 flows neither to the heat source unit-side heat exchanger 12 nor to the indoor-side heat exchanger 14, the cooling and heating capabilities are undermined by the portion of the quantity of the refrigerant flowing in the bypass passage 28.

15th Embodiment

Figure 29:
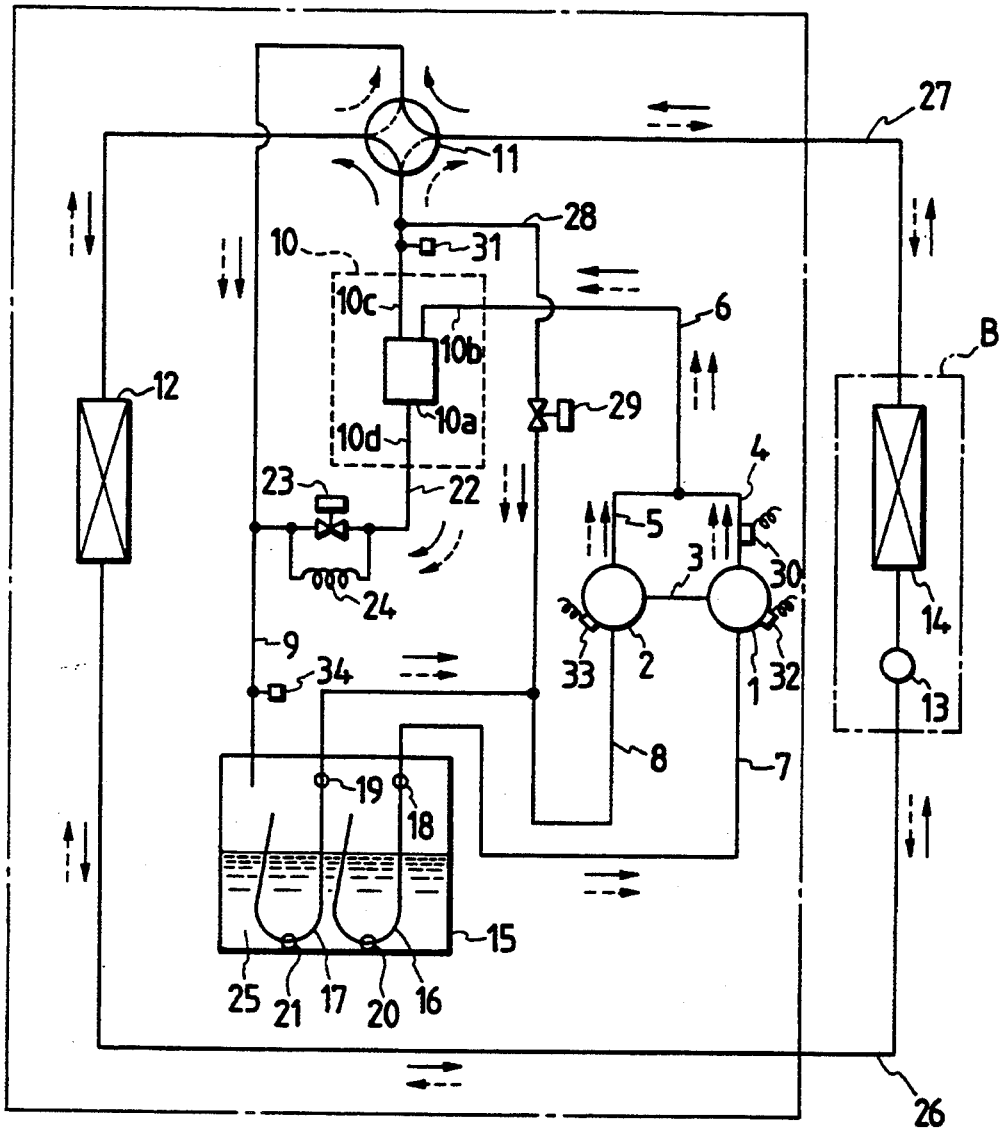
FIG. 29 is a refrigerant circuit diagram centering on the refrigerant system of an air conditioner in accordance with 14th to 23th embodiments of the present invention.

FIG. 29 is a refrigerant circuit diagram of an air conditioner in accordance with a 15th embodiment of the present invention. In the drawing, reference characters or numerals A denote component parts that are similar to those of the air conditioner in accordance with the 14th embodiment shown in FIG. 28, and description thereof will be omitted here. Numeral 29 denotes a solenoid on-off valve disposed midway in the bypass passage 28. In addition, it is assumed that in a case where the load on the indoor unit B is small and it is unnecessary for both the first and second compressors 1 and 2 to be operated, and either one of them needs to be operated, the first compressor 1 is unfailingly started and the second compressor 2 is stopped, and that in a case where starting is effected in a state in which both units are stopped, the first compressor 1 is first started, and if the load on the indoor unit is large and both units need to be operated, the second compressor 2 is additionally started. It should be noted that, in the drawing, the solid-line arrows indicate the direction of flow of the refrigerant during the cooling operation, while the broken-line arrows indicate the direction of flow of the refrigerant during the heating operation.

Figure 53A:
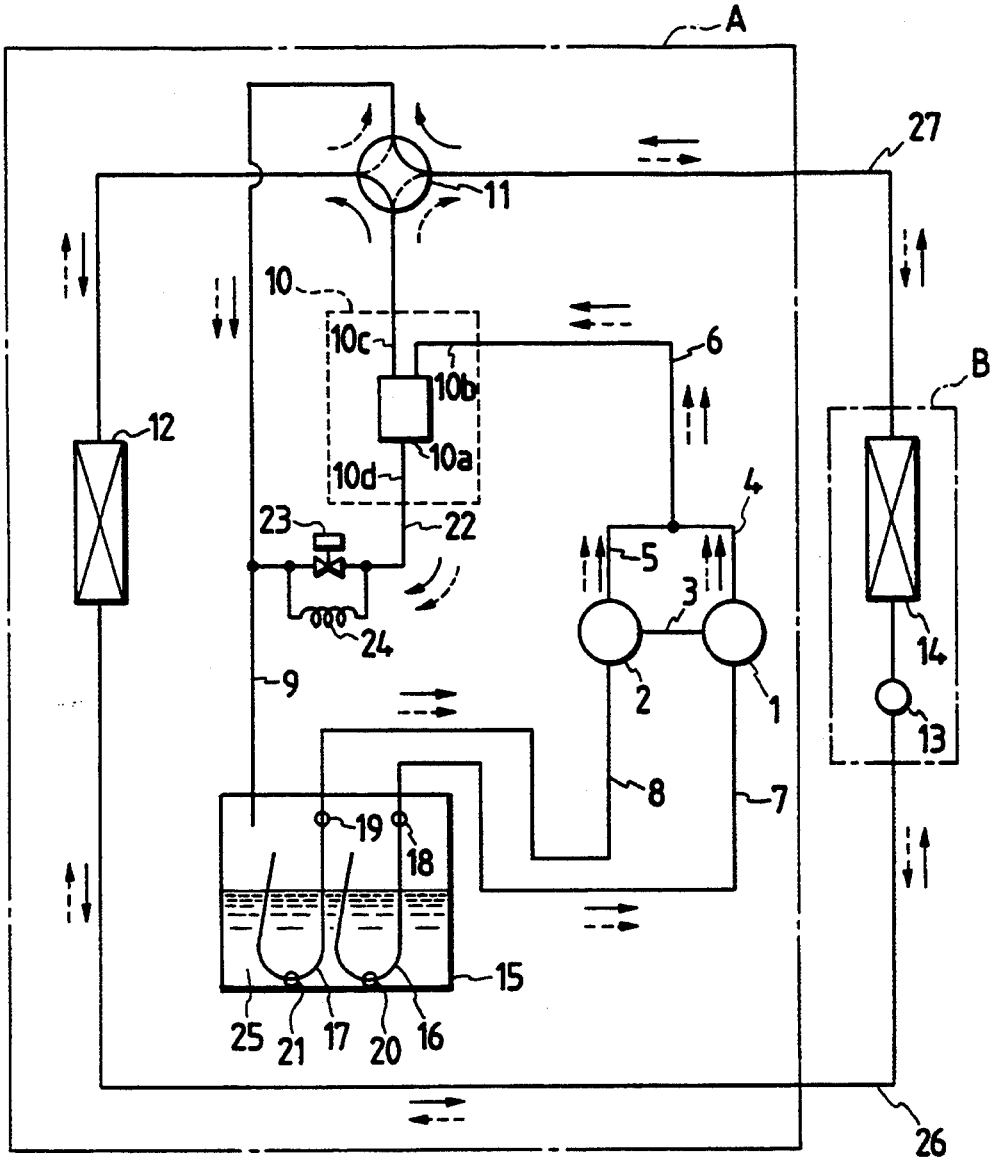
FIG. 53A PRIOR ART
FIG. 53A is a refrigerant circuit diagram centering on the refrigerant system of a conventional air conditioner.
Figure 53B:
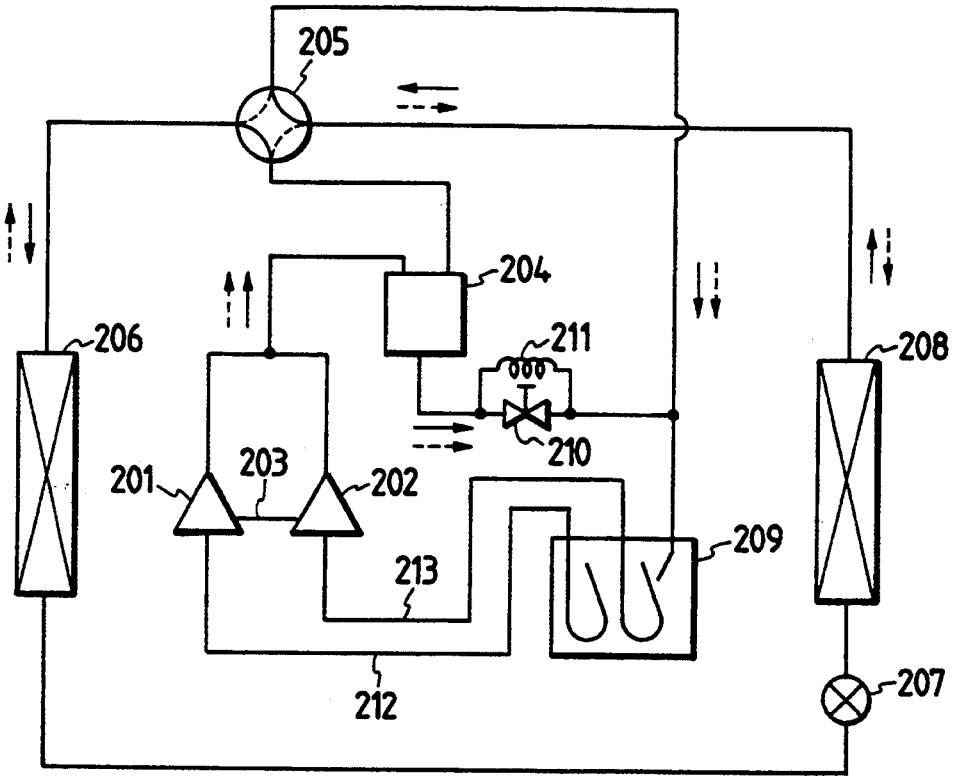
FIG. 53B PRIOR ART
FIG. 53B is a refrigerant circuit diagram in accordance with a conventional example.

Since the operation of the refrigerant (including lubricating oil) during the cooling and heating operations is utterly the same as that of the conventional air conditioner shown in FIG. 53A except for a portion concerning the solenoid on-off valve 29, description thereof will be omitted here. In addition, since the operation of the refrigerant in the bypass passage 28 with the solenoid on-off valve 29 opened is the same as that of the refrigerant in the bypass passage 28 in accordance with the 14th embodiment shown in FIG. 28, description thereof will be omitted here, and a description will be given of the portion concerning the solenoid on-off valve 29. The solenoid on-off valve 29 is opened only when the first compressor 1 is operated and the second compressor 2 is stopped, and the solenoid on-off valve 29 is closed at other times. Accordingly, when the first compressor 1 is operated and the second compressor 2 is stopped, the solenoid on-off valve 29 is opened, and the high-temperature gas refrigerant is supplied to the suction pipe 8. Thus, even if the liquid refrigerant is accumulated in the accumulator 15, the absolute quantity of the lubricating oil in the second compressor 2 does not decrease, and the concentration of the lubricating oil does not decline. Hence, it is possible to obtain a highly reliable air conditioner in which a shortage of the lubricating oil or faulty lubrication due to such as the lack of viscosity of the lubricating oil do not occur when the second compressor 2 is started, which may otherwise result in the breakage of the second compressor 2. On the other hand, in a case where both the first and second compressors 1 and 2 are operated, the solenoid on-off valve 29 is closed, so that the refrigerant does not flow to the bypass passage 28. Hence, the cooling and heating capabilities are not undermined when both the first and second compressors 1 and 2 are being operated.

16th Embodiment

Figure 30:
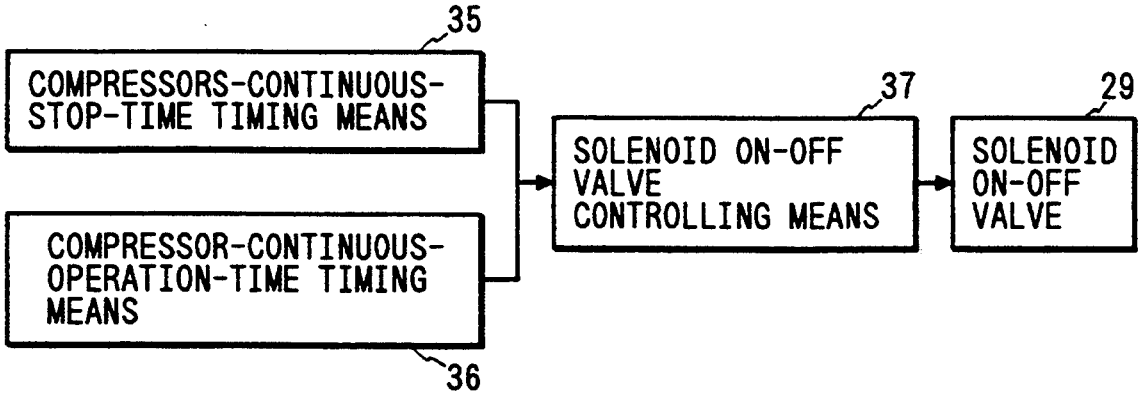
FIG. 30 is a control block diagram of the air conditioner in accordance with the 16th embodiment of the present invention.

FIG. 29 is a refrigerant circuit diagram of an air conditioner in accordance with a 16th embodiment of the present invention. FIG. 30 is a control block diagram of the air conditioner in accordance with the 16th embodiment of the present invention. In the drawing, reference numeral 35 denotes a compressors-continuous-stop-time measuring device for counting a time when both the first and second compressors 1 and 2 are being continuously stopped; 36, a compressor-continuous-operation-time measuring device which starts timing upon starting of the first compressor 1 for counting a time of continuous operation of the first compressor 1; and 37, a solenoid on-off valve controlling device for controlling the opening and closing of the solenoid on-off valve 29 on the basis of the time counted by the compressors-continuous-stop-time measuring device 35 and the time counted by the compressor-continuous-operation-time measuring device 36.

Since the operation of the refrigerant (including lubricating oil) during the cooling and heating operations is utterly the same as that of the air conditioner in accordance with the 15th embodiment, description thereof will be omitted here, and a description will be given of the details of control by the solenoid on-off valve controlling device 37. In a system in which excess refrigerant does not occur (which is realizable by making the first connecting pipe 26 short, or by disposing a liquid reservoir between the heat source unit-side heat exchanger 12 and the first connecting pipe 26 or by disposing the second accumulator between the four-way changeover valve 11 and the accumulator 15, without adopting the chargeless system), the accumulation of the liquid refrigerant in the accumulator 15 takes place after the starting of the first compressor 1 in a state in which both the first and second compressors 1 and 2 have been stopped continuously for a long time, or after the starting of the first compressor 1 in a state in which both the first and second compressors 1 and 2 have been stopped although not for a very long time. The quantity of wet vapor sucked when the first compressor 1 is started in the state in which both the first and second compressors 1 and 2 have been stopped continuously for a long time is very large, so that a considerably long time is required until the liquid refrigerant in the accumulator 15 removed. On the other hand, the quantity of wet vapor sucked when the first compressor 1 is started in the state in which both the first and second compressors 1 and 2 have been stopped although not for a very long time is not very large, so that a very long time is not required until the liquid refrigerant in the accumulator 15 removed. Accordingly, if the opening and closing of the solenoid on-off valve 29 are controlled by the solenoid on-off valve controlling device 37 as described below, in the case where the first compressor 1 is being operated and the second compressor 2 is being stopped, when the liquid refrigerant is accumulated in the accumulator 15, the solenoid on-off valve 29 is opened, and the high-temperature gas refrigerant is supplied to the suction pipe 8. Thus, even if the liquid refrigerant is accumulated in the accumulator 15, the absolute quantity of the lubricating oil in the second compressor 2 does not decrease, and the concentration of the lubricating oil does not decline. Hence, it is possible to obtain a highly reliable air conditioner in which a shortage of the lubricating oil or faulty lubrication due to such as the lack of viscosity of the lubricating oil do not occur when the second compressor 2 is started, which may otherwise result in the breakage of the second compressor 2. When the liquid refrigerant in the accumulator 15 is no longer present, the solenoid on-off valve 29 is closed and the liquid refrigerant does not flow through the bypass passage 28, so that there is no shortage in the cooling and heating capabilities.

Figure 37:
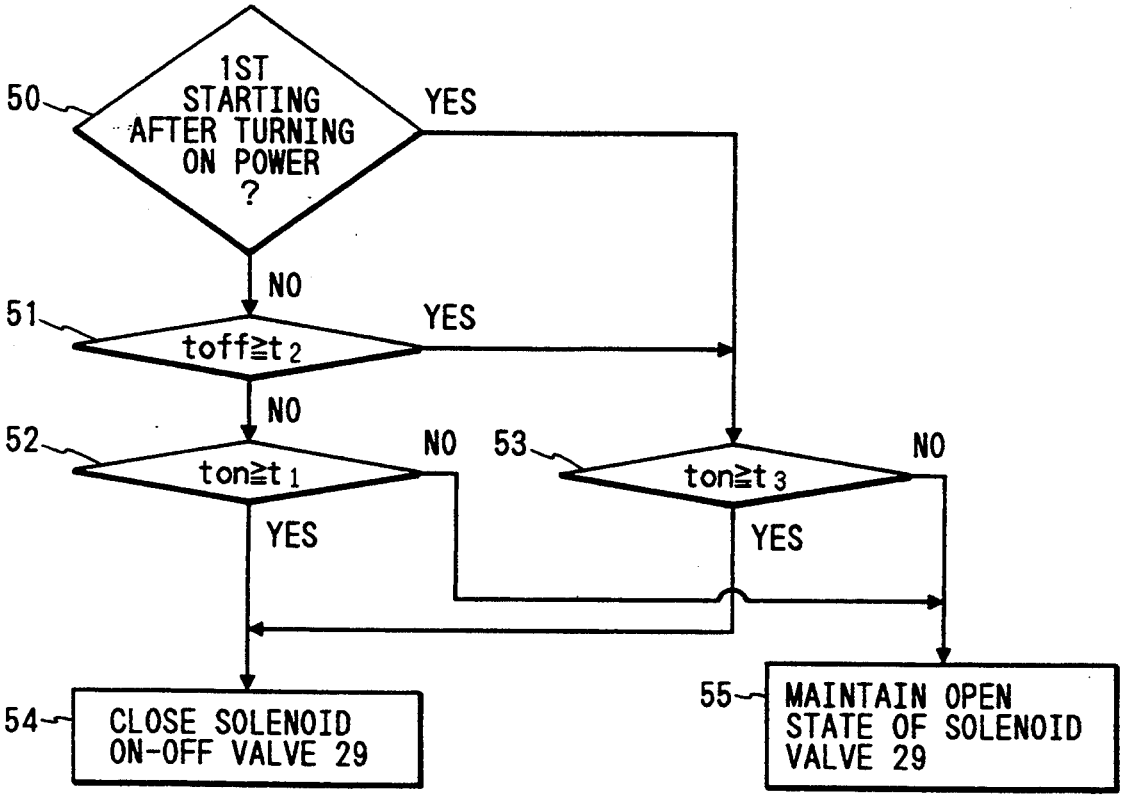
FIG. 37 is a flowchart illustrating details of control by a solenoid on-off valve controller of the air conditioner in accordance with the 16th embodiment of the present invention.

Referring now to the flowchart shown in FIG. 37, the details of control by the solenoid on-off valve controlling device 37 will be described in concrete terms. First, when the first compressor 1 is started with both the first and second compressors being stopped, the solenoid on-off valve 29 is opened. Then in Step 50 in FIG. 37, a determination is made as to whether or not it is the first starting after the turning on of the power. If it is the first starting, it is determined that it is the starting after stopping for a long time, and the operation proceeds to Step 53; if it is the second or subsequent starting, the operation proceeds to Step 51. If it is determined in Step 51 that a time $t_{off}$ counted by the compressors-continuous-stop-time measuring device 35 has reached a second set time t2 set in advance, it is judged that it is the starting after stopping for a long time, and the operation proceeds to Step 53. If $t_{off}$ has not reached the second set time t2, it is judged that it is the starting after stopping for a short time, and the operation proceeds to Step 52. If it is determined in Step 52 that a time ton counted by the compressor-continuous-operation-time measuring device 36 has reached a first set time t1 which has been set in advance to a relatively short time, though sufficient to overcome the accumulation of the liquid refrigerant in the accumulator 15 due to the wet vapor suction during starting after stopping for a short time, it is judged that the liquid refrigerant in the accumulator 15 has been removed, and the operation proceeds to Step 54 to close the solenoid on-off valve 29 so as to avoid the shortage of the cooling and heating capabilities. Meanwhile, if it is determined in Step 52 that $t_{on}$ has not reached t1, it is judged that the liquid refrigerant in the accumulator 15 has not been removed, and the operation proceeds to Step 55 so as to maintain the open state of the solenoid on-off valve 29 and supply the high-temperature gas refrigerant to the suction pipe 8, thereby controlling a decrease in the absolute quantity of the lubricating oil in the second compressor 2 and a decline in the concentration thereof. If it is determined in Step 53 that the time $t_{on}$ counted by the compressor-continuous-operation-time measuring device 36 has reached a third set time t3 set in advance to be longer than the first set time t1, it is judged that the liquid refrigerant in the accumulator 15 has been removed, and the operation proceeds to Step 54 to close the solenoid on-off valve 29 so as to avoid the shortage of the cooling and heating capabilities. Meanwhile, if it is determined in Step 53 that ton has not reached t3, it is judged that the liquid refrigerant in the accumulator 15 has not been removed, and the operation proceeds to Step 55 so as to maintain the open state of the solenoid on-off valve 29 and supply the high-temperature gas refrigerant to the suction pipe 8, thereby controlling a decrease in the absolute quantity of the lubricating oil in the second compressor 2 and a decline in the concentration thereof. Since the solenoid on-off valve 29 is controlled in the above-described manner, in a case where the first compressor 1 is operated and the second compressor 2 is stopped, the solenoid on-off valve 29 is prevented from being opened when the liquid refrigerant is accumulated in the accumulator 15, which could unnecessarily result in the shortage of the cooling and heating capabilities. When the liquid refrigerant is accumulated in the accumulator 15, the solenoid on-off valve 29 is opened to supply the high-temperature gas refrigerant to the suction pipe 8, thereby controlling a decrease in the absolute quantity of the lubricating oil in the second compressor 2 and a decline in the concentration thereof.

17th Embodiment

FIG. 29 is a refrigerant circuit diagram of an air conditioner in accordance with a 17th embodiment of the present invention. In the drawing, reference numeral 30 denotes a discharge-temperature detecting device provided on the discharge pipe 4.

Figure 31:
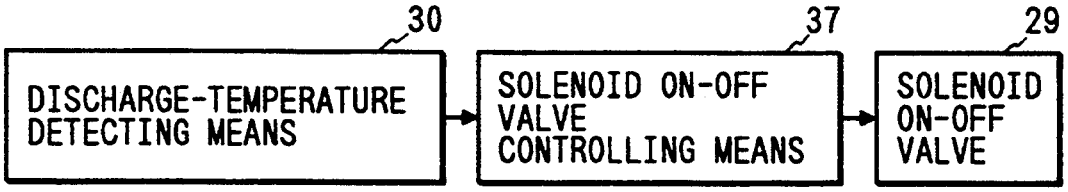
FIG. 31 is a control block diagram of the air conditioner in accordance with the 17th embodiment of the present invention.

FIG. 31 is a control block diagram of the air conditioner in accordance with the 17th embodiment of the present invention. In the drawing, reference numeral 37 denotes the solenoid on-off valve controlling device for controlling the opening and closing of the solenoid on-off valve 29 on the basis of the temperature detected by the discharge-temperature detecting device 30.

Since the operation of the refrigerant (including lubricating oil) during the cooling and heating operations is utterly the same as that of the air conditioners in accordance with the 15th and 16th embodiments, description thereof will be omitted here, and a description will be given of the details of control by the solenoid on-off valve controlling device 37. When the first compressor 1 is started with both the first and second compressors 1 and 2 being stopped, the possibility of the liquid refrigerant becoming accumulated in the accumulator 15 is large, so that the solenoid on-off valve 29 is opened. Since the liquid refrigerant flows into the first compressor 1 while the liquid refrigerant is accumulated in the accumulator 15, the discharge gas temperature is low, but when the liquid refrigerant is removed from the accumulator 15, the superheated gas refrigerant flows into the first compressor 1, so that the discharge gas temperature becomes high. Therefore, in the case where the first compressor 1 is being operated and the second compressor 2 is being stopped, when a temperature Td detected by the discharge-temperature detecting device 30 reaches a level greater than or equal to a set value Td1 of a discharge-temperature upper limit set in advance, it is judged that the liquid refrigerant has been removed from the accumulator 15, so that the solenoid on-off valve 29 is closed, making it possible to avoid the shortage of the cooling and heating capabilities caused by the bypassing of the refrigerant to the bypass passage 28. In addition, when Td drops to a level less than or equal to a set value Td2 of a discharge-temperature lower limit set in advance, it is judged that the liquid refrigerant is accumulated again in the accumulator 15 due to the occurrence of excess refrigerant caused by a change in the operation mode (such as a change from the cooling operation to the heating operation) or the like. Hence, the solenoid on-off valve 29 is opened to supply the high-temperature gas refrigerant to the suction pipe 8 from the bypass passage 28, so as to control a decrease in the absolute quantity of the lubricating oil in the second compressor 2 and a decline in the concentration thereof.

Figure 38:
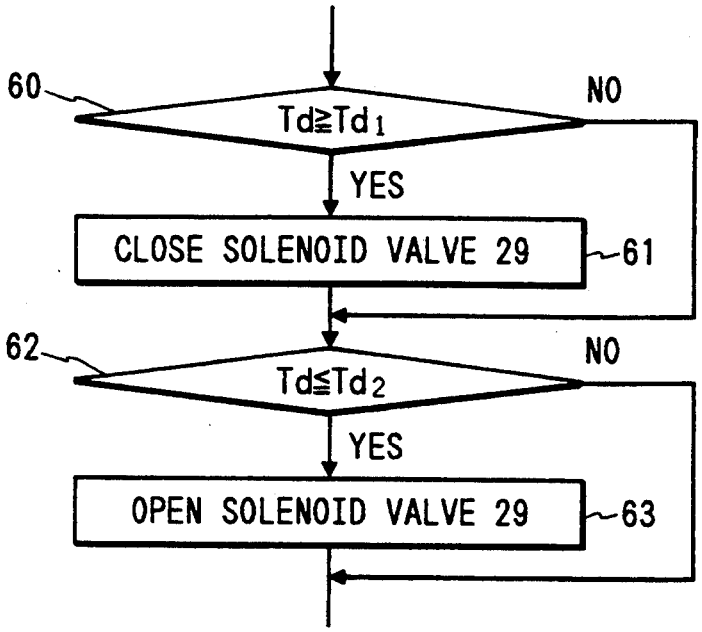
FIG. 38 is a flowchart illustrating details of control by the solenoid on-off valve controller of the air conditioner in accordance with the 17th embodiment of the present invention.

Referring now to the flowchart shown in FIG. 38, the details of control by the solenoid on-off valve controlling device 37 will be described in concrete terms. First, when the first compressor 1 is started with both the first and second compressors being stopped, the solenoid on-off valve 29 is opened. Then in Step 60 in FIG. 38, a determination is made as to whether or not the temperature Td detected by the discharge-temperature detecting device 30 is at a level greater than or equal to the set value Td1 of the discharge-temperature upper limit set in advance, and if $Td \geqq Td1$, the operation proceeds to Step 61 to close the solenoid on-off valve 29, and then the operation proceeds to Step 62. Meanwhile, if $Td < Td1$, the operation proceeds directly to Step 62. In Step 62, a determination is made as to whether or not Td is less than or equal to the set value Td2 of the discharge-temperature lower limit set in advance such that $Td2 < Td1$. If $Td \geqq Td2$, the operation proceeds to Step 63 to open the solenoid on-off valve 29, and the operation returns to Step 60. Meanwhile, if $Td > Td2$, the operation returns directly to Step 60. Since the solenoid on-off valve 29 is controlled in the above-described manner, in a case where the first compressor 1 is operated and the second compressor 2 is stopped, the solenoid on-off valve 29 is prevented from being opened when the liquid refrigerant is accumulated in the accumulator 15, which could unnecessarily result in the shortage of the cooling and heating capabilities. When the liquid refrigerant is accumulated in the accumulator 15, the solenoid on-off valve 29 is opened to supply the high-temperature gas refrigerant to the suction pipe 8, thereby controlling a decrease in the absolute quantity of the lubricating oil in the second compressor 2 and a decline in the concentration thereof.

18th Embodiment

FIG. 29 is a refrigerant circuit diagram of an air conditioner in accordance with a 18th embodiment of the present invention. In the drawing, reference numeral 31 denotes a first pressure detecting device provided in the common discharge pipe 6. In addition, it is assumed that in a case where the load on the indoor unit is small and it is unnecessary for both the first and second compressors 1 and 2 to be operated, and either one of them needs to be operated, the first compressor 1 is unfailingly started and the second compressor 2 is stopped, and that in a case where starting is effected in a state in which both units are stopped, the first compressor 1 is first started, and if the load on the indoor unit is large and both units need to be operated, the second compressor 2 is additionally started. It should be noted that, in the drawing, the solid-line arrows indicate the direction of flow of the refrigerant during the cooling operation, while the broken-line arrows indicate the direction of flow of the refrigerant during the heating operation.

Figure 32:
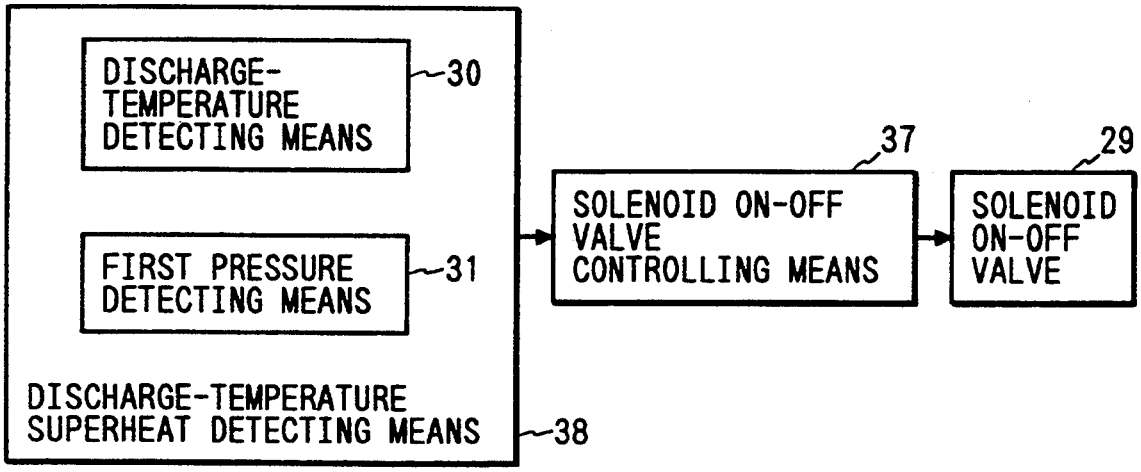
FIG. 32 is a control block diagram of the air conditioner in accordance with the 18th embodiment of the present invention.

FIG. 32 is a control block diagram of the air conditioner in accordance with the 18th embodiment of the present invention. In the drawing, reference numeral 38 denotes a discharge-temperature superheat detecting device which is comprised of the discharge-temperature detecting device 30 and the first pressure detecting device 31, and calculates the degree of superheat in the discharge temperature on the basis of the temperature detected by the discharge-temperature detecting device 30 and the pressure detected by the first pressure detecting device 31. In addition, reference numeral 37 denotes the solenoid on-off valve controlling device for controlling the opening and closing of the solenoid on-off valve 29 on the basis of the temperature detected by the discharge-temperature detecting device 30.

Since the operation of the refrigerant (including lubricating oil) during the cooling and heating operations is utterly the same as that of the air conditioners in accordance with the 15th to 17th embodiments, description thereof will be omitted here, and a description will be given of the details of control by the solenoid on-off valve controlling device 37. When the first compressor 1 is started with both the first and second compressors 1 and 2 being stopped, the possibility of the liquid refrigerant becoming accumulated in the accumulator 15 is large, so that the solenoid on-off valve 29 is opened. Since the liquid refrigerant flows into the first compressor 1 while the liquid refrigerant is accumulated in the accumulator 15, the degree of superheat in the discharge gas temperature is low, but when the liquid refrigerant is removed from the accumulator 15, the superheated gas refrigerant flows into the first compressor 1, so that the degree of superheat in the discharge gas temperature becomes high. In most cases, whether or not the liquid refrigerant is accumulated in the accumulator 15 can be determined from the discharge gas temperature level; however, in cases such as when the high-pressure level is low, the liquid refrigerant is not present in the accumulator 15, and the degree of superheat in the discharge gas temperature is high, but the discharge gas temperature is low. As a result, the determination as to whether or not the liquid refrigerant is accumulated in the accumulator 15 can be made more accurately on the basis of the degree of superheat in the discharge gas temperature, although this determining process is complicated. Therefore, in the case where the first compressor 1 is being operated and the second compressor 2 is being stopped, when a degree of superheat SHd detected by the discharge-temperature superheat detecting device 38 reaches a level greater than or equal to a set value SHd1 of a discharge-temperature superheat upper limit set in advance, it is judged that the liquid refrigerant has been removed from the accumulator 15, so that the solenoid on-off valve 29 is closed, making it possible to avoid the shortage of the cooling and heating capabilities caused by the bypassing of the refrigerant to the bypass passage 28. In addition, when SHd drops to a level less than or equal to a set value SHd2 of a discharge-temperature superheat lower limit set in advance, it is judged that the liquid refrigerant is accumulated again in the accumulator 15 due to the occurrence of excess refrigerant caused by a change in the operation mode (such as a change from the cooling operation to the heating operation) or the like. Hence, the solenoid on-off valve 29 is opened to supply the high-temperature gas refrigerant to the suction pipe 8 from the bypass passage 28, so as to control a decrease in the absolute quantity of the lubricating oil in the second compressor 2 and a decline in the concentration thereof.

Figure 39:
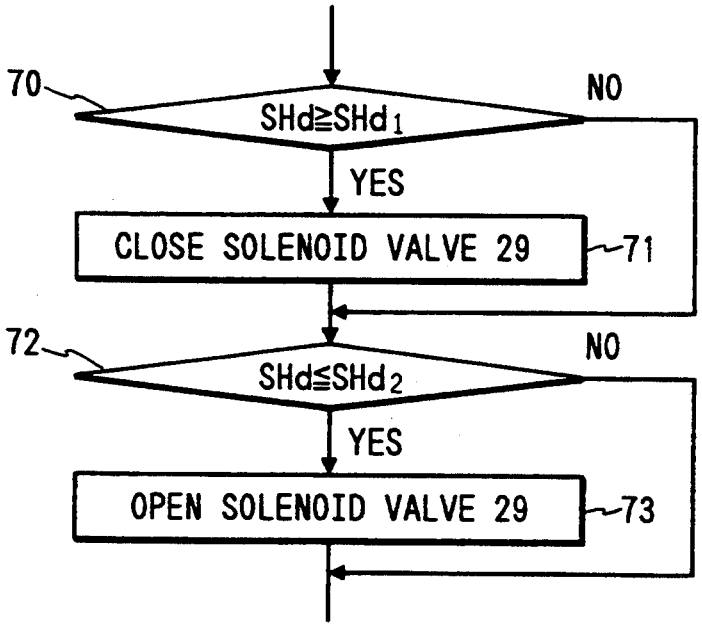
FIG. 39 is a flowchart illustrating details of control by the solenoid on-off valve controller of the air conditioner in accordance with the 18th embodiment of the present invention.

Referring now to the flowchart shown in FIG. 39, the details of control by the solenoid on-off valve controlling device 37 will be described in concrete terms. First, when the first compressor 1 is started with both the first and second compressors being stopped, the solenoid on-off valve 29 is opened. Then in Step 70 in FIG. 39, a determination is made as to whether or not the degree of superheat SHd detected by the discharge-temperature superheat detecting device 38 is at a level greater than or equal to the set value SHd1 of the discharge-temperature superheat upper limit set in advance, and if $SHd \geqq SHd1$, the operation proceeds to Step 71 to close the solenoid on-off valve 29, and then the operation proceeds to Step 72. Meanwhile, if $SHd < SHd1$, the operation proceeds directly to Step 72. In Step 72, a determination is made as to whether or not SHd is less than or equal to the set value SHd2 of the discharge-temperature superheat lower limit set in advance such that $SHd2 < SHd1$. If $SHd \leqq SHd2$, the operation proceeds to Step 73 to open the solenoid on-off valve 29, and the operation returns to Step 70. Meanwhile, if $SHd > SHd2$, the operation returns directly to Step 70. Since the solenoid on-off valve 29 is controlled in the above-described manners in a case where the first compressor 1 is operated and the second compressor 2 is stopped, the solenoid on-off valve 29 is prevented from being opened when the liquid refrigerant accumulated in the accumulator 15, which could unnecessarily result in the shortage of the cooling and heating capabilities. When the liquid refrigerant is accumulated in the accumulator 15, the solenoid on-off valve 29 is opened to supply the high-temperature gas refrigerant to the suction pipe 8, thereby controlling a decrease in the absolute quantity of the lubricating oil in the second compressor 2 and a decline in the concentration thereof.

19th Embodiment

Similar effects are obtained if the discharge-temperature detecting device 30 is provided on the common discharge pipe 6 in the 17th and 18th embodiments.

In addition, similar effects are obtained if the first pressure detecting device 31 is provided in the common discharge pipe 6 or the discharge pipe 5 in the 17th and 18th embodiments.

20th Embodiment

FIG. 29 is a refrigerant circuit diagram of an air conditioner in accordance with a 20th embodiment of the present invention. In the drawing, reference numeral 32 denotes a first shell-temperature detecting device provided on the bottom of the shell of the first compressor 1.

Figure 33:
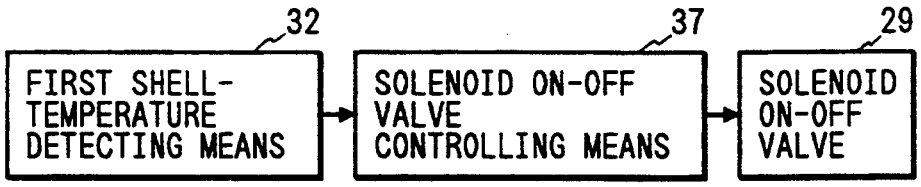
FIG. 33 is a control block diagram of the air conditioner in accordance with the 19th embodiment of the present invention.

FIG. 33 is a control block diagram of the air conditioner in accordance with the 20th embodiment of the present invention. In the drawing, reference numeral 37 denotes the solenoid on-off valve controlling device for controlling the opening and closing of the solenoid on-off valve 29 on the basis of the temperature detected by the first shell-temperature detecting device 32.

Since the operation of the refrigerant (including lubricating oil) during the cooling and heating operations is utterly the same as that of the air conditioners in accordance with the 15th to 19th embodiments, description thereof will be omitted here, and a description will be given of the details of control by the solenoid on-off valve controlling device 37. When the first compressor 1 is started with both the first and second compressors 1 and 2 being stopped, the possibility of the liquid refrigerant becoming accumulated in the accumulator 15 is large, so that the solenoid on-off valve 29 is opened. Since the liquid refrigerant flows into the first compressor 1 while the liquid refrigerant is accumulated in the accumulator 15, the concentration of the lubricating oil in the shell of the first compressor 1 is low, but when the liquid refrigerant is removed from the accumulator 15, the superheated gas refrigerant flows into the first compressor 1, so that the concentration of the lubricating oil in the shell of the first compressor 1 becomes high. Meanwhile, a mixed liquid of the lubricating oil and the liquid refrigerant has a characteristic that, under the same conditions of pressure, the higher the concentration of the lubricating oil, the higher the temperature of the mixed liquid. Hence, it is possible to detect the temperature of the mixed liquid on the basis of the temperature of the bottom of the shell of the first compressor 1. Therefore, in the case where the first compressor 1 is being operated and the second compressor 2 is being stopped, when a temperature $Tshell_1$ detected by the first shell-temperature detecting device 32 reaches a level greater than or equal to a set value $Tshell_1$ of a shell-temperature upper limit set in advance, it is judged that the liquid refrigerant has been removed from the accumulator 15, so that the solenoid on-off valve 29 is closed, making it possible to avoid the shortage of the cooling and heating capabilities caused by the bypassing of the refrigerant to the bypass passage 28. In addition, when the detected temperature $Tshell_1$ drops to a level less than or equal to a set value $Tshell_{12}$ of a first-shell-temperature lower limit set in advance, it is judged that the liquid refrigerant is accumulated again in the accumulator 15 due to the occurrence of excess refrigerant caused by a change in the operation mode (such as a change from the cooling operation to the heating operation) or the like. Hence, the solenoid on-off valve 29 is opened to supply the high-temperature gas refrigerant to the suction pipe 8 from the bypass passage 28, so as to control a decrease in the absolute quantity of the lubricating oil in the second compressor 2 and a decline in the concentration thereof. In addition, in the determination of the presence or absence of the accumulation of the liquid refrigerant in the accumulator 15, the state of wet vapor being sucked to the first compressor 1 can be detected more directly by the detection of the temperature of the bottom of the first compressor 1 rather than by the detection of the discharge gas temperature. Hence, the former detection method is more accurate although the method of mounting the first shell-temperature detecting device 32 is difficult.

Figure 40:
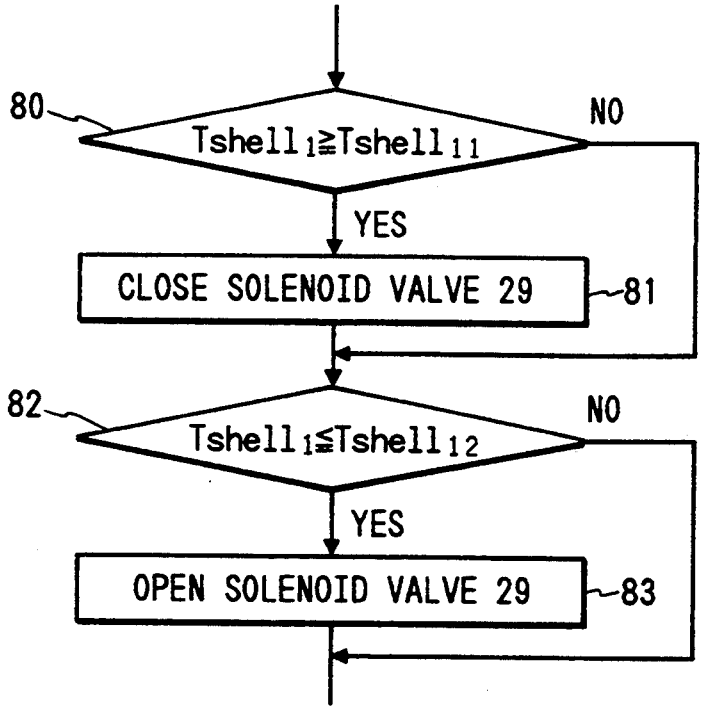
FIG. 40 is a flowchart illustrating details of control by the solenoid on-off valve controller of the air conditioner in accordance with the 20th embodiment of the present invention.

Referring now to the flowchart shown in FIG. 40, the details of control by the solenoid on-off valve controlling device 37 will be described in concrete terms. First, when the first compressor 1 is started with both the first and second compressors being stopped, the solenoid on-off valve 29 is opened. Then in Step 80 in FIG. 40, a determination is made as to whether or not the temperature $Tshell_1$ detected by the first shell-temperature detecting device 32 is at a level greater than or equal to the set value $Tshell_1$ of the first-shell-temperature upper limit set in advance, and if $Tshell_1 \geqq Tshell_{11}$, the operation proceeds to Step 81 to close the solenoid on-off valve 29, and then the operation proceeds to Step 82. Meanwhile, if $Tshell_1 < Tshell_{11}$, the operation proceeds directly to Step 82. In Step 82, a determination is made as to whether or not Td is less than or equal to the set value $Tshell_{12}$ of the first-shell-temperature lower limit set in advance such that $Tshell_{12} < Tshell_{11}$. If $Tshell_1 \leqq Tshell_{12}$, the operation proceeds to Step 83 to open the solenoid on-off valve 29, and the operation returns to Step 80. Meanwhile, if $Tshell_1 > Tshell_{12}$, the operation returns directly to Step 80. Since the solenoid on-off valve 29 is controlled in the above-described manner, in a case where the first compressor 1 is operated and the second compressor 2 is stopped, the solenoid on-off valve 29 is prevented from being opened when the liquid refrigerant is accumulated in the accumulator 15, which could unnecessarily result in the shortage of the cooling and heating capabilities. When the liquid refrigerant is accumulated in the accumulator 15, the solenoid on-off valve 29 is opened to supply the high-temperature gas refrigerant to the suction pipe 8, thereby controlling a decrease in the absolute quantity of the lubricating oil in the second compressor 2 and a decline in the concentration thereof.

21th Embodiment

FIG. 29 is a refrigerant circuit diagram of an air conditioner in accordance with a 21th embodiment of the present invention. In the drawing, reference numeral 33 denotes a second shell-temperature detecting device provided on the bottom of the shell of the second compressor 2.

Figure 34:
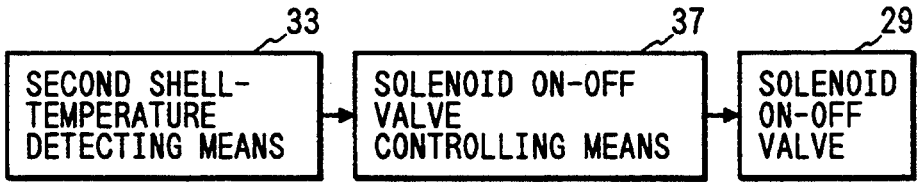
FIG. 34 is a control block diagram of the air conditioner in accordance with the 21th embodiment of the present invention.

FIG. 34 is a control block diagram of the air conditioner in accordance with the 20th embodiment of the present invention. In the drawing, reference numeral 37 denotes the solenoid on-off valve controlling device for controlling the opening and closing of the solenoid on-off valve 29 on the basis of the temperature detected by the second shell-temperature detecting device 33.

Since the operation of the refrigerant (including lubricating oil) during the cooling and heating operations is utterly the same as that of the air conditioners in accordance with the 15th to 20th embodiments, description thereof will be omitted here, and a description will be given of the details of control by the solenoid on-off valve controlling device 37. A mixed liquid of the lubricating oil and the liquid refrigerant has a characteristic that, under the same conditions of pressure, the higher the concentration of the lubricating oil, the higher the temperature of the mixed liquid. Hence, it is possible to detect the temperature of the mixed liquid on the basis of the temperature of the bottom of the shell of the second compressor 2. When the first compressor 1 is started with both the first and second compressors 1 and 2 being stopped, the possibility of the concentration of the lubricating oil in the shell of the second compressor 2 being low is large, and the possibility of the liquid refrigerant becoming accumulated in the accumulator 15 is large. Hence, the influx of the liquid refrigerant from the accumulator 15 into the second compressor 2 can be suppressed by opening the solenoid on-off valve 29 and supplying the high-temperature gas refrigerant from the bypass passage 28 to the suction pipe 8. At the same time, the liquid refrigerant in the shell of the second compressor 2 is evaporated by the high-temperature gas refrigerant supplied from the bypass passage 28, thereby making it possible to increase the concentration of the lubricating oil in the shell of the second compressor 2. The increase in the concentration of the lubricating oil in the second compressor 2, in turn, increases the temperature of the mixed liquid in the shell of the second compressor 2, and the temperature of the bottom of the shell of the second compressor 2 rises. As a result, when the temperature of the bottom of the shell of the second compressor 2 rises, it is determined that the concentration of the lubricating oil in the shell of the second compressor 2 has increased, so that the solenoid on-off valve 29 is opened, thereby avoiding the shortage of the cooling and heating capabilities caused by the bypassing of the refrigerant to the bypass passage 28. If, at that time, the accumulation of the liquid refrigerant in the accumulator 15 has not yet been overcome, the liquid refrigerant flows into the second compressor 2 from the accumulator 15, which causes a decline in the concentration of the lubricating oil in the mixed liquid in the shell of the second compressor 2, and the temperature of the mixed liquid in the shell of the second compressor 2 drops, so that the temperature of the bottom of the shell of the second compressor 2 also drops. If the drop in the temperature of the bottom of the shell of the second compressor 2, by opening the solenoid on-off valve 29 again, it becomes possible again to suppress the influx of the liquid refrigerant from the accumulator 15 into the second compressor 2 and to increase the concentration of the lubricating oil in the shell of the second compressor 2. That is, when the first compressor 1 is started with both the first and second compressors 1 and 2 being stopped, the solenoid on-off valve 29 is opened. In the case where the first compressor 1 is being operated and the second compressor 2 is being stopped, when a temperature $Tshell_2$ detected by the shell-temperature detecting device 33 of the second compressor 2 reaches a level greater than or equal to a set value $Tshell_2$ of a shell-temperature upper limit of the second compressor 2 set in advance, it is judged that the liquid refrigerant has been removed from the accumulator 15, so that the solenoid on-off valve 29 is closed, making it possible to avoid the shortage of the cooling and heating capabilities caused by the bypassing of the refrigerant to the bypass passage 28. In addition, when the detected temperature $Tshell_{12}$ drops to a level less than or equal to a set value $Tshell_{22}$ of a shell-temperature lower limit of the second compressor 2 set in advance, it is judged that the liquid refrigerant is accumulated in the accumulator 15 (or the accumulation of the liquid refrigerant has not been overcome). Hence, the solenoid on-off valve 29 is opened to supply the high-temperature gas refrigerant to the suction pipe 8 from the bypass passage 28, so as to control a decrease in the absolute quantity of the lubricating oil in the second compressor 2 and a decline in the concentration thereof. In addition, it is also possible to detect a case where the liquid refrigerant is not present in the accumulator 15 but the concentration of the lubricating oil in the second compressor 2 is low, and the concentration can be increased by opening the solenoid on-off valve 29.

Figure 41:
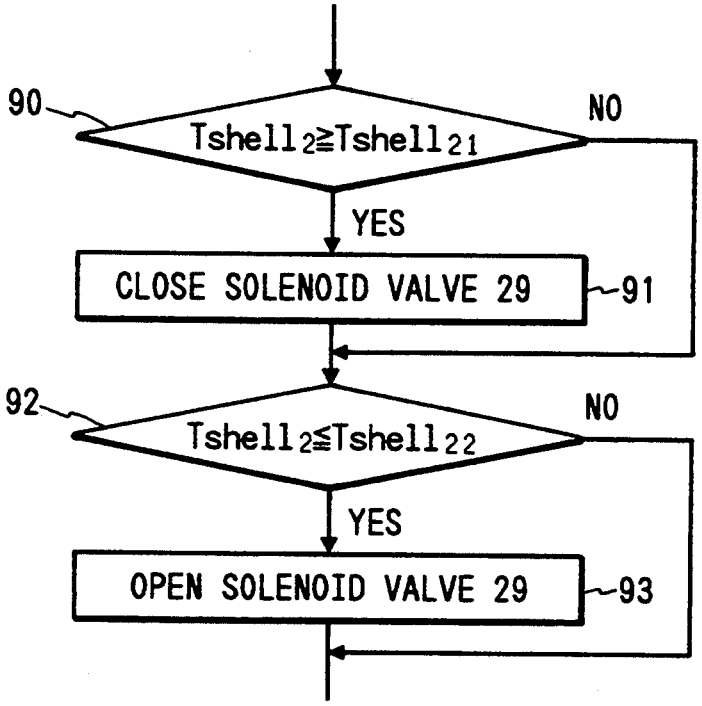
FIG. 41 is a flowchart illustrating details of control by the solenoid on-off valve controller of the air conditioner in accordance with the 21th embodiment of the present invention.

Referring now to the flowchart shown in FIG. 41, the details of control by the solenoid on-off valve controlling device 37 will be described in concrete terms. First, when the first compressor 1 is started with both the first and second compressors being stopped, the solenoid on-off valve 29 is opened. Then in Step 90 in FIG. 41, a determination is made as to whether or not the temperature $Tshell_2$ detected by the second shell-temperature detecting device 33 is at a level greater than or equal to the set value $Tshell_{21}$ of the shell-temperature upper limit of the second compressor 2 set in advance, and if $Tshell_2 \geqq Tshell_{21}$, the operation proceeds to Step 91 to close the solenoid on-off valve 29, and then the operation proceeds to Step 92. Meanwhile, if $Tshell_2 < Tshell_{21}$, the operation proceeds directly to Step 92. In Step 92, a determination is made as to whether or not $Tshell_2$ is less than or equal to the set value $Tshell_{22}$ of the shell-temperature lower limit of the second compressor 2 set in advance such that $Tshell_{22} < Tshell_{21}$. If $Tshell_2 \leqq Tshell_{22}$, the operation proceeds to Step 93 to open the solenoid on-off valve 29, and the operation returns to Step 90. Meanwhile, if $Tshell_2 > Tshell_{22}$, the operation returns directly to Step 90. Since the solenoid on-off valve 29 is controlled in the above-described manner, in a case where the first compressor 1 is operated and the second compressor 2 is stopped, the solenoid on-off valve 29 is prevented from being opened when the liquid refrigerant is accumulated in the accumulator 15, which could unnecessarily result in the shortage of the cooling and heating capabilities. When the liquid refrigerant is accumulated in the accumulator 15, the solenoid on-off valve 29 is opened to supply the high-temperature gas refrigerant to the suction pipe 8, thereby controlling a decrease in the absolute quantity of the lubricating oil in the second compressor 2 and a decline in the concentration thereof. Also, in a case where the liquid refrigerant is not present in the accumulator 15 but the concentration of the lubricating oil in the second compressor is low, it is possible to increase the concentration of the lubricating oil in the second compressor.

22th Embodiment

FIG. 29 is a refrigerant circuit diagram of an air conditioner in accordance with a 22th embodiment of the present invention. In the drawing, reference numeral 34 denotes a second pressure detecting device provided in the common suction pipe 9.

Figure 35:
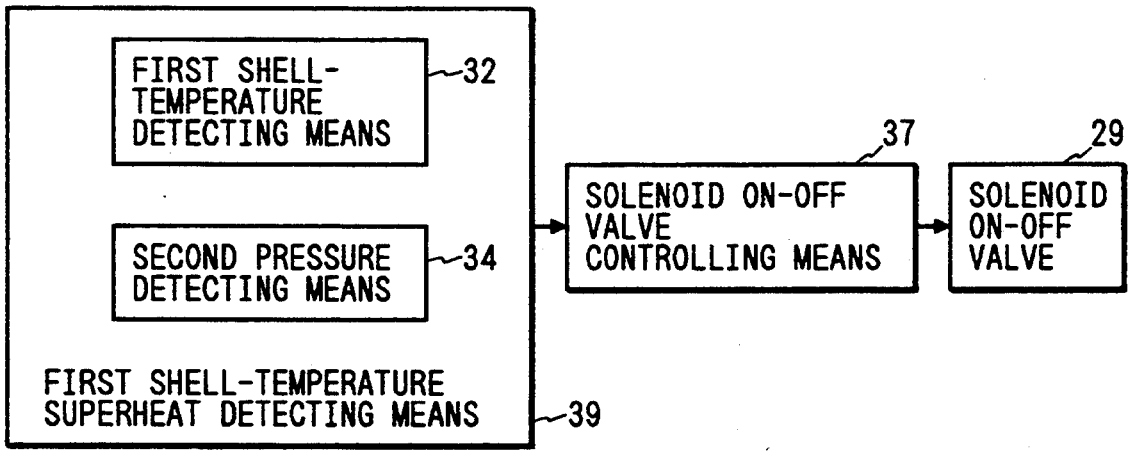
FIG. 35 is a control block diagram of the air conditioner in accordance with the 22th embodiment of the present invention.

FIG. 35 is a control block diagram of the air conditioner in accordance with the 22th embodiment of the present invention. In the drawing, reference numeral 39 denotes a first shell-temperature superheat detecting device which is comprised of the first shell-temperature detecting device 32 and the second pressure detecting device 34 and calculates the degree of superheat of the first shell temperature on the basis of the temperature detected by the first shell-temperature detecting device 32 and the pressure detected by the second pressure detecting device 34. In addition, reference numeral 37 denotes the solenoid on-off valve controlling device for controlling the opening and closing of the solenoid on-off valve 29 on the basis of the degree of superheat detected by the first shell-temperature superheat detecting device 39.

Since the operation of the refrigerant (including lubricating oil) during the cooling and heating operations is utterly the same as that of the air conditioners in accordance with the 15th to 21th embodiments, description thereof will be omitted here, and a description will be given of the details of control by the solenoid on-off valve controlling device 37. When the first compressor 1 is started with both the first and second compressors 1 and 2 being stopped, the possibility of the liquid refrigerant becoming accumulated in the accumulator 15 is large, so that the solenoid on-off valve 29 is opened. Since the liquid refrigerant flows into the first compressor 1 while the liquid refrigerant is accumulated in the accumulator 15, the concentration of the lubricating oil in the shell of the first compressor 1 is low, but when the liquid refrigerant is removed from the accumulator 15, the superheated gas refrigerant flows into the first compressor 1, so that the concentration of the lubricating oil in the shell of the first compressor 1 becomes high. Namely, there is a characteristic that the higher the concentration of the lubricating oil, the higher the degree of superheat in the temperature of the mixed liquid. Hence, it is possible to detect the degree of superheat in the temperature of the mixed liquid on the basis of the degree of superheat in the temperature of the bottom of the shell of the first compressor 1. Here, the degree of superheat in the temperature of the mixed liquid referred to device a temperature difference between the temperature of the mixed liquid and the saturation temperature of the refrigerant under a pressure persisting at a time when the concentration of the lubricating oil in the mixed liquid is 0%. The degree of superheat in the temperature of the bottom of the shell device the temperature difference between the temperature of the bottom of the shell and the saturation temperature of the refrigerant under that pressure. Therefore, in the case where the first compressor 1 is being operated and the second compressor 2 is being stopped, when the degree of superheat $SHshell_1$ detected by the first shell-temperature superheat detecting device 39 reaches a level greater than or equal to a set value $SHshell_{11}$ of a first-shell-temperature superheat upper limit set in advance, it is judged that the liquid refrigerant has been removed from the accumulator 15, so that the solenoid on-off valve 29 is closed, making it possible to avoid the shortage of the cooling and heating capabilities caused by the bypassing of the refrigerant to the bypass passage 28. In addition, when $SHshell_1$ drops to a level less than or equal to a set value $SHshell_{12}$ of a first-shell-temperature superheat lower limit set in advance, it is judged that the liquid refrigerant is accumulated again in the accumulator 15 due to the occurrence of excess refrigerant caused by a change in the operation mode (such as a change from the cooling operation to the heating operation) or the like. Hence, the solenoid on-off valve 29 is opened to supply the high-temperature gas refrigerant to the suction pipe 8 from the bypass passage 28, so as to control a decrease in the absolute quantity of the lubricating oil in the second compressor 2 and a decline in the concentration thereof. In addition, in the determination of the presence or absence of the accumulation of the liquid refrigerant in the accumulator 15, the state of wet vapor being sucked to the first compressor 1 can be detected more directly by the detection of the temperature of the bottom of the first compressor 1 rather than by the detection of the discharge gas temperature. Hence, the former detection method is more accurate although the method of mounting the first shell-temperature detecting device 32 is difficult. In addition, in the detection of the state of wet vapor suction, the detection based on the degree of superheat is complicated but is more accurate than the detection based on the temperature, since correction based on pressure is added.

Figure 42:
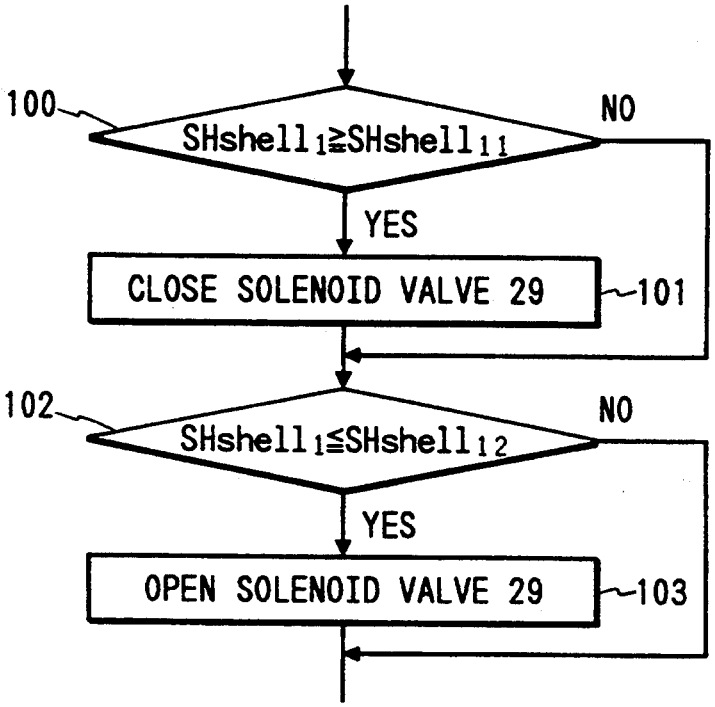
FIG. 42 is a flowchart illustrating details of control by the solenoid on-off valve controller of the air conditioner in accordance with the 22th embodiment of the present invention.

Referring now to the flowchart shown in FIG. 42, the details of control by the solenoid on-off valve controlling device 37 will be described in concrete terms. Firsty when the first compressor 1 is started with both the first and second compressors being stopped, the solenoid on-off valve 29 is opened. Then in Step 100 in FIG. 42, a determination is made as to whether or not the temperature $SHshell_1$ detected by the first shell-temperature superheat detecting device 39 is at a level greater than or equal to the set value $SHshell_{11}$ of the first-shell-temperature superheat upper limit set in advance, and if $SHshell_1 \geqq SHshell_{11}$, the operation proceeds to Step 101 to close the solenoid on-off valve 29, and then the operation proceeds to Step 102. Meanwhile, if $SHshell_1 < SHshell_{11}$, the operation proceeds directly to Step 102. In Step 102, a determination is made as to whether or not the detected temperature $SHshell_1$ is less than or equal to the set value $SHshell_{12}$ of the first-shell-temperature superheat lower limit set in advance such that $SHshell_{12} < SHshell_{11}$. If $SHshell_1 \leqq SHshell_{12}$, the operation proceeds to Step 103 to open the solenoid on-off valve 29, and the operation returns to Step 100. Meanwhile, if $SHshell_1 > SHshell_{12}$, the operation returns directly to Step 100. Since the solenoid on-off valve 29 is controlled in the above-described manner, in a case where the first compressor 1 is operated and the second compressor 2 is stopped, the solenoid on-off valve 29 is prevented from being opened when the liquid refrigerant is accumulated in the accumulator 15, which could unnecessarily result in the shortage of the cooling and heating capabilities. When the liquid refrigerant is accumulated in the accumulator 15, the solenoid on-off valve 29 is opened to supply the high-temperature gas refrigerant to the suction pipe 8, thereby controlling a decrease in the absolute quantity of the lubricating oil in the second compressor 2 and a decline in the concentration thereof.

23th Embodiment

Figure 36:
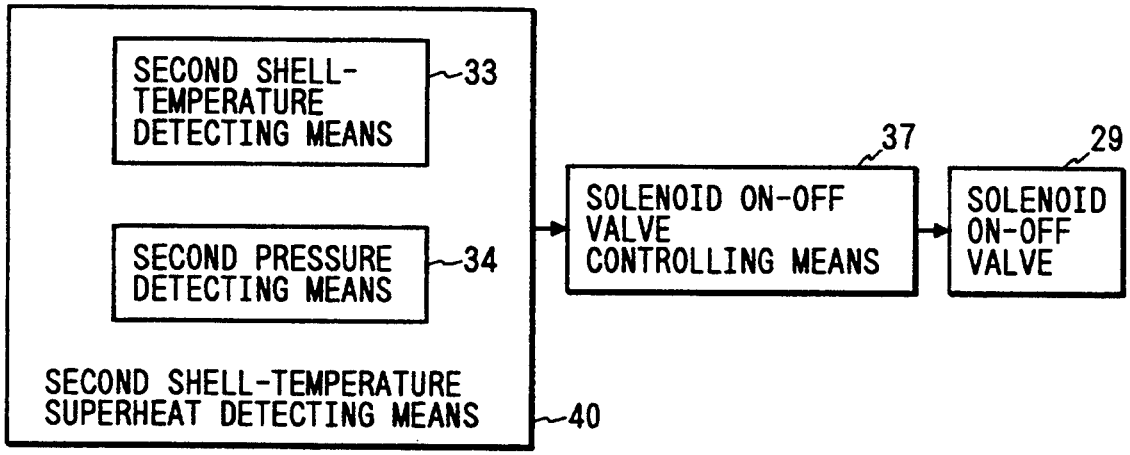
FIG. 36 is a control block diagram of the air conditioner in accordance with the 23th embodiment of the present invention.

FIG. 29 is a refrigerant circuit diagram of an air conditioner in accordance with a 23th embodiment of the present invention. FIG. 36 is a control block diagram of the air conditioner in accordance with the 23th embodiment of the present invention. In the drawing, reference numeral 40 denotes a second shell-temperature superheat detecting device which is comprised of the second shell-temperature detecting device 33 and the second pressure detecting device 34 and calculates the degree of superheat of the second shell temperature on the basis of the temperature detected by the second shell-temperature detecting device 33 and the pressure detected by the second pressure detecting device 34. In addition, reference numeral 37 denotes the solenoid on-off valve controlling device for controlling the opening and closing of the solenoid on-off valve 29 on the basis of the degree of superheat detected by the second shell-temperature superheat detecting device 40.

Since the operation of the refrigerant (including lubricating oil) during the cooling and heating operations is utterly the same as that of the air conditioners in accordance with the 15th to 22th embodiments, description thereof will be omitted here, and a description will be given of the details of control by the solenoid on-off valve controlling device 37. A mixed liquid of the lubricating oil and the liquid refrigerant has a characteristic that, under the same conditions of pressure, the higher the concentration of the lubricating oil, the higher the temperature of the mixed liquid, i.e., the higher the concentration of the lubricating oil, the higher the degree of superheat in the temperature of the mixed liquid. Hence, it is possible to detect the degree of super heal in the temperature of the mixed liquid on the basis of the degree of superheat in the temperature of the bottom of the shell of the second compressor 2. Here, the definitions of the degree of superheat in the temperature of the mixed liquid and the degree of superheat in the temperature of the bottom of the shell are the same as those given in the 22th embodiment. When the first compressor 1 is started with both the first and second compressors 1 and 2 being stopped, the possibility of the concentration of the lubricating oil in the shell of the second compressor 2 being low is large, and the possibility of the liquid refrigerant becoming accumulated in the accumulator 15 is large. Hence, the influx of the liquid refrigerant from the accumulator 15 into the second compressor 2 can be suppressed by opening the solenoid on-off valve 29 and supplying the high-temperature gas refrigerant from the bypass passage 28 to the suction pipe 8. At the same time, the liquid refrigerant in the shell of the second compressor 2 is evaporated by the high-temperature gas refrigerant supplied from the bypass passage 28, thereby making it possible to increase the concentration of the lubricating oil in the shell of the second compressor 2. The increase in the concentration of the lubricating oil in the second compressor 2, in turn, increases the degree of superheat in the mixed liquid in the shell of the second compressor 2, and the degree of superheat in the temperature of the bottom of the shell of the second compressor 2 rises. As a result, when the degree of superheat in the temperature of the bottom of the shell of the second compressor 2 rises, it is determined that the concentration of the lubricating oil in the shell of the second compressor 2 has increased, so that the solenoid on-off valve 29 is opened, thereby avoiding the shortage of the cooling and heating capabilities caused by the bypassing of the refrigerant to the bypass passage 28. If, at that time, the accumulation of the liquid refrigerant in the accumulator 15 has not yet been overcome, the liquid refrigerant flows into the second compressor 2 from the accumulator 15, which causes a decline in the concentration of the lubricating oil in the mixed liquid in the shell of the second compressor 2, and the degree of superheat in the temperature of the mixed liquid in the shell of the second compressor 2 drops, so that the degree of superheat in the temperature of the bottom of the shell of the second compressor 2 also drops. If the drop in the degree of superheat in the temperature of the bottom of the shell of the second compressor 2, by opening the solenoid on-off valve 29 again, it becomes possible again to suppress the influx of the liquid refrigerant from the accumulator 15 into the second compressor 2 and to increase the concentration of the lubricating oil in the shell of the second compressor 2. That is, when the first compressor 1 is started with both the first and second compressors 1 and 2 being stopped, the solenoid on-off valve 29 is opened. In the case where the first compressor 1 is being operated and the second compressor 2 is being stopped, when the degree of superheat $Tshell_2$ detected by the second shell-temperature superheat detecting device 40 reaches a level greater than or equal to a set value $Tshell_{21}$ of a second-shell-temperature superheat upper limit set in advance, it is judged that the liquid refrigerant has been removed from the accumulator 15, so that the solenoid on-off valve 29 is closed, making it possible to avoid the shortage of the cooling and heating capabilities caused by the bypassing of the refrigerant to the bypass passage 28. In addition, when $SHshell_2$ drops to a level less than or equal to a set value $SHshell_{22}$ of a second-shell-temperature superheat lower limit set in advance, it is judged that the liquid refrigerant is accumulated in the accumulator 15 (or the accumulation of the liquid refrigerant has not been overcome). Hence, the solenoid on-off valve 29 is opened to supply the high-temperature gas refrigerant to the suction pipe 8 from the bypass passage 28, so as to control a decrease in the absolute quantity of the lubricating oil in the second compressor 2 and a decline in the concentration thereof. In addition, it is also possible to detect a case where the liquid refrigerant is not present in the accumulator 15 but the concentration of the lubricating oil in the second compressor 2 is low, and the concentration can be increased by opening the solenoid on-off valve 29. In addition, in the detection of the low concentration of the lubricating oil in the second compressor 2, the detection based on the degree of superheat is complicated but is more accurate than the detection based on the temperature, since correction based on pressure is added.

Figure 43:
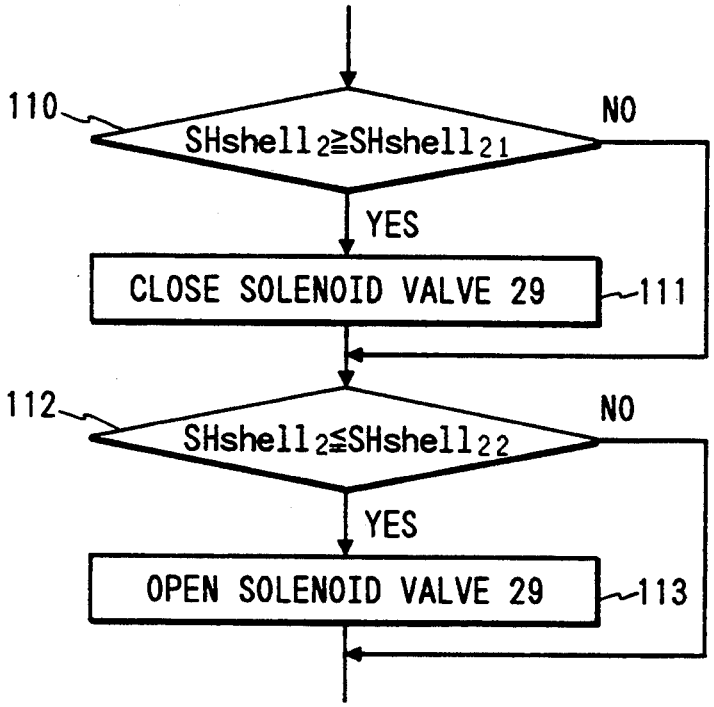
FIG. 43 is a flowchart illustrating details of control by the solenoid on-off valve controller of the air conditioner in accordance with the 23th embodiment of the present invention.

Referring now to the flowchart shown in FIG. 43, the details of control by the solenoid on-off valve controlling device 37 will be described in concrete terms. First, when the first compressor 1 is started with both the first and second compressors being stopped, the solenoid on-off valve 29 is opened. Then in Step 110 in FIG. 43, a determination is made as to whether or not the degree of superheat $SHshell_2$ detected by the second shell-temperature superheat detecting device 40 is at a level greater than or equal to the set value $SHshell_{21}$ of the second-shell-temperature superheat upper limit set in advance, and if $SHshell_2 \geqq SHshell_{21}$, the operation proceeds to Step 111 to close the solenoid on-off valve 29, and then the operation proceeds to Step 112. Meanwhile, if $SHshell_2 < SHshell_{21}$, the operation proceeds directly to Step 112. In Step 112, a determination is made as to whether or not $SHshell_2$ is less than or equal to the set value $SHshell_{22}$ of the second-shell-temperature superheat lower limit set in advance such that $SHshell_{22} < SHshell_{21}$. If $SHshell_2 \leqq SHshell_{22}$, the operation proceeds to Step 113 to open the solenoid on-off valve 29, and the operation returns to Step 110. Meanwhile, if $SHshell_2 > SHshell_{22}$, the operation returns directly to Step 110. Since the solenoid on-off valve 29 is controlled in the above-described manner, in a case where the first compressor 1 is operated and the second compressor 2 is stopped, the solenoid on-off valve 29 is prevented from being opened when the liquid refrigerant is accumulated in the accumulator 15, which could unnecessarily result in the shortage of the cooling and heating capabilities. When the liquid refrigerant is accumulated in the accumulator 15, the solenoid on-off valve 29 is opened to supply the high-temperature gas refrigerant to the suction pipe 8, thereby controlling a decrease in the absolute quantity of the lubricating oil in the second compressor 2 and a decline in the concentration thereof. Also, in a case where the liquid refrigerant is not present in the accumulator 15 but the concentration of the lubricating oil in the second compressor 2 is low, it is possible to increase the concentration of the lubricating oil in the second compressor 2.

24th Embodiment

Figure 44:
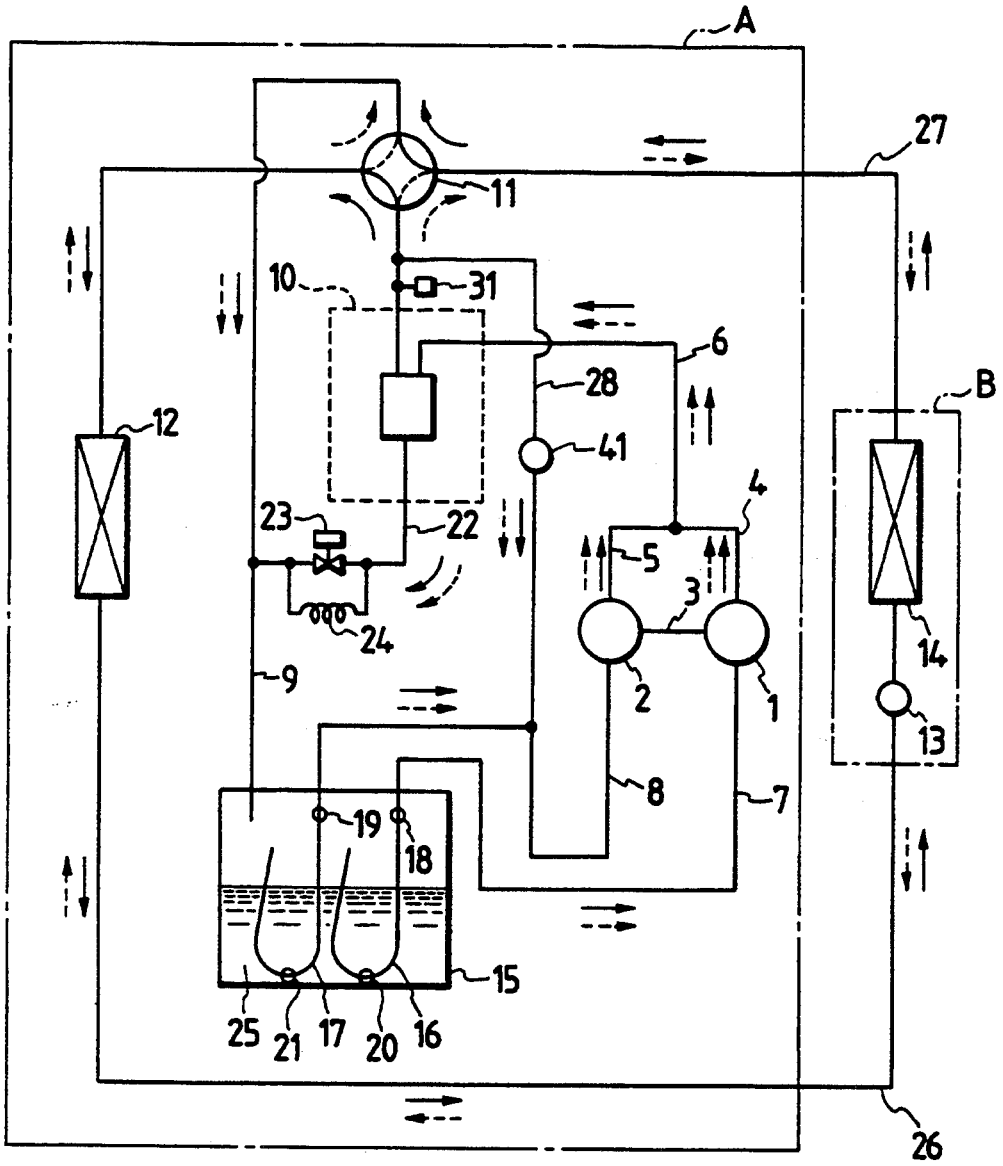
FIG. 44 is a refrigerant circuit diagram centering on the refrigerant system of an air conditioner in accordance with a 24th embodiment of the present invention.

FIG. 44 is a refrigerant circuit diagram of an air conditioner in accordance with a 24th embodiment of the present invention. In the drawing, reference numeral 41 denotes a flow-rate controlling device provided midway in the pipe of the bypass passage 28. It is assumed that the first compressor 1 is a compressor whose flow rate is controllable. It should be noted that, in the drawing, the solid-line arrows indicate the direction of flow of the refrigerant during the cooling operation, while the broken-line arrows indicate the direction of flow of the refrigerant during the heating operation.

Figure 45:
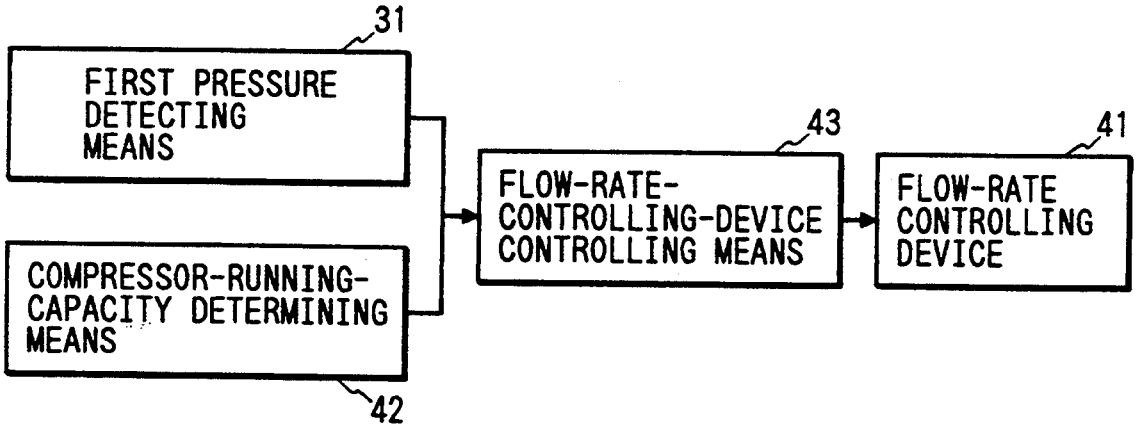
FIG. 45 is a control block diagram of the air conditioner in accordance with the 24th embodiment of the present invention.

FIG. 45 is a control block diagram of the air conditioner in accordance with the 24th embodiment of the present invention. In the drawing, reference numeral 42 denotes a compressor-running-capacity determining device for determining the running capacity of the first compressor 1; and numeral 43 denotes a flow-rate-controlling-device controlling device for controlling the opening of the flow-rate controlling device 41 on the basis of the running capacity of the first compressor 1 determined by the compressor-running-capacity determining device 42 and the pressure detected by the first pressure detecting device 31.

Since the operation of the refrigerant (including lubricating oil) during the cooling and heating operations is utterly the same as that of the air conditioner in accordance with the 14th embodiment, description thereof will be omitted here, and a description will be given of the details of control by the flow-rate-controlling-device controlling device 43. Here, it is assumed that, with respect to the flow-rate controlling device 41, the following relationship holds between a channel cross-sectional area S and the opening x of the flow-rate controlling device 41 (k1 is a constant):

$$S=k1\ x$$

In addition, since the refrigerant flowing through the bypass passage 28 can be regarded as a compressive fluid, the following relationship holds between the channel cross-sectional area S and the primary pressure of the flow-rate controlling device 41, i.e., the high-pressure level Ph and a refrigerant flow rate Gb in the bypass passage 28 (k2 is a constant):

$$Gb=k2\ Ph\ S$$

Namely, the following relationship holds among Gb, x, and Ph:

$$Gb=k1\ k2\ x\ Ph$$

If it is assumed that the flow rate of the refrigerant in the first compressor 1 is G1, that the low rate of the refrigerant in the bypass passage 28 necessary and sufficient for preventing the liquid refrigerant from flowing in from the accumulator 15 is Gb0, that the pressure loss from the accumulator 15 up to the first compressor 1 is ΔPs1, and that the pressure loss from a converging portion of the bypass passage 28 and the suction pipe 8 up to the first compressor 1 via the shell of the second compressor 2 and the equalizing pipe 3 is ΔPs2, the following relations substantially hold (k3, k4, and n are constants):

$$\Delta Ps1=k3\ G1^{n}$$

$$\Delta Ps2=4\ Gb0^{n}$$

$$\Delta Ps1=\Delta Ps2$$

Accordingly, the following relationship holds between G1 and Gb0 (k5 is a constant):

$$Gb0=k5\ G1$$

In addition, the following relationship substantially holds between G1 and the running capacity Q of the first compressor 1 (k6 is a constant):

$$Q=k6\ G1$$

Namely, the following relationship holds between Q and Gb0:

$$Gb0=(k5/k6)\ Q$$

Now, if Gb >Gb0, the cooling and heating capabilities are lost more than necessary by the portion of Gb−Gb0. On the other hand, if Gb<Gb0, the liquid refrigerant flows into the second compressor 2 from the accumulator 15. That is, if channel resistance is added by a solenoid on-off valve capillary tube, an orifice and the like without providing the bypass passage 28 with the flow-rate controlling device capable of controlling the flow rate of the passing refrigerant, then unfailingly Gb>Gb0 or Gb<Gb0 depending on the running capacity of the first compressor 1 or the high-pressure level. In this case, since the channel resistance is selected so that Gb>Gb0 by placing priority on the protection of the compressor, so that the cooling and heating capabilities are undermined more than is necessary.

From the above, to ensure that Gb=Gb0, it suffices if the opening x of the flow-rate controlling device 41 is set as follows (where, k=k5/(k1 k2 k6)):

$$x=k\ Q/Ph$$

The details of control by the flow-rate-controlling-device controlling device 43 will be described hereafter in concrete terms. The opening of the flow-rate controlling device 41 is set to an opening which is calculated by x=k Q/Pd on the basis of the running capacity Q of the first compressor 1 determined by the compressor-running-capacity determining device 42 and the pressure Pd detected by the first pressure detecting device 31. Since the flow-rate controlling device 41 is controlled in this manner, in a case where the first compressor 1 is being operated and the second compressor 2 is being stopped, a decrease in the absolute quantity of the lubricating oil in the second compressor 2 and a decline in the concentration thereof can be controlled by supplying a necessary and sufficient quantity of high-temperature gas refrigerant to the suction pipe 8 without lapsing into a shorting of the cooling and heating capacities more than is necessary.

25th Embodiment

Figure 46:
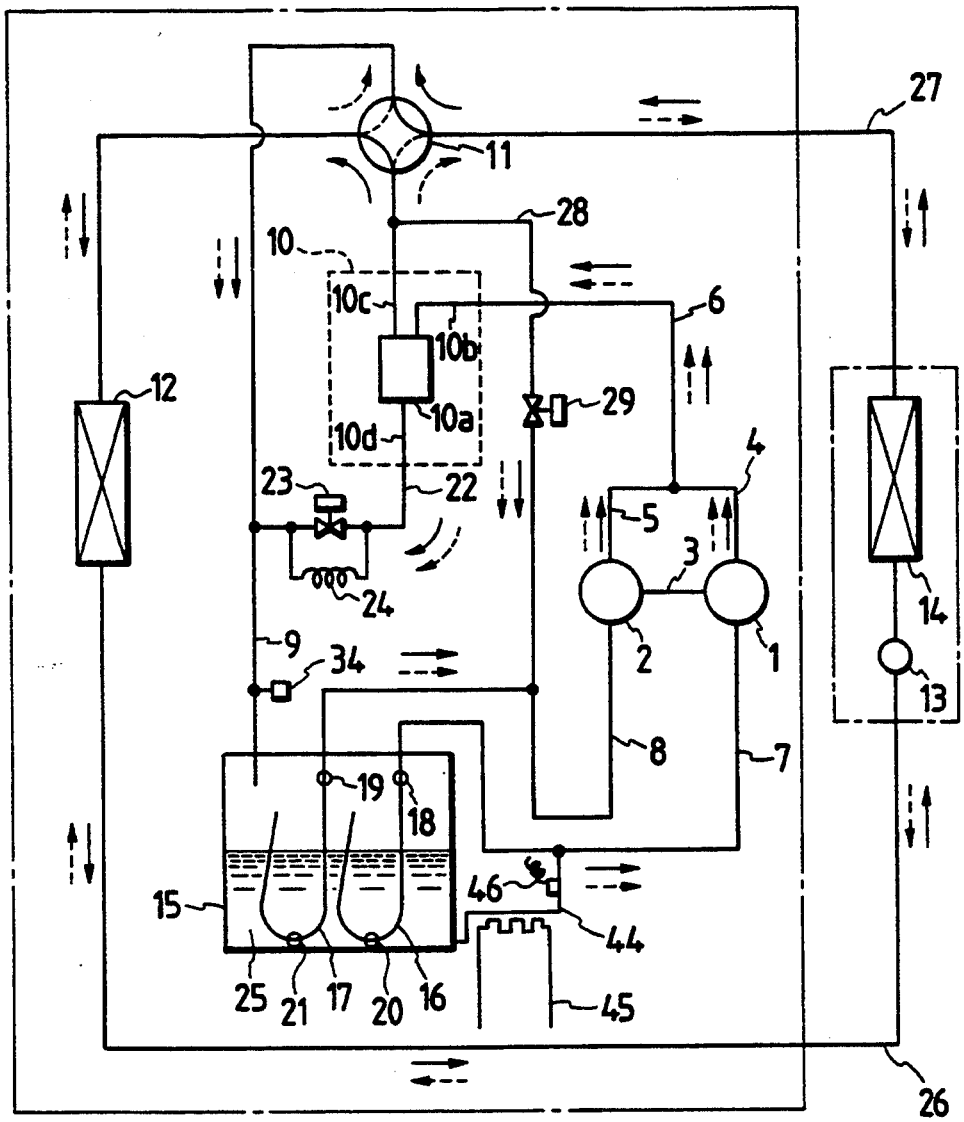
FIG. 46 is a refrigerant circuit diagram centering on the refrigerant system of an air conditioner in accordance with a 25th embodiment of the present invention.

FIG. 46 is a refrigerant circuit diagram of an air conditioner in accordance with a 25th embodiment of the present invention. In the drawing, reference numeral 44 denotes a liquid-level detecting circuit having one end communicating with a lower end inside the accumulator 15 and the other end connected to the suction pipe 7; 45, a heating device disposed in contact with the liquid-level detecting circuit, adapted to heat the liquid-level detecting circuit and having a heating capacity for heating the liquid-level detecting circuit 44 so as to produce superheat vapor when wet vapor or saturated vapor flows through the liquid-level detecting circuit 44, or wet vapor or saturated vapor when the liquid refrigerant flows therethrough; and 46, a liquid-level-detecting temperature detecting device provided at an outlet of the liquid-level detecting circuit 44. In addition, it is assumed that in a case where the load on the indoor unit is small and it is unnecessary for both the first and second compressors 1 and 2 to be operated, and either one of them needs to be operated, the first compressor 1 is unfailingly started and the second compressor 2 is stopped, and that in a case where starting is effected in a state in which both units are stopped, the first compressor 1 is first started, and if the load on the indoor unit is large and both units need to be operated, the second compressor 2 is additionally started. It should be noted that, in the drawing, the solid-line arrows indicate the direction of flow of the refrigerant during the cooling operation, while the broken-line arrows indicate the direction of flow of the refrigerant during the heating operation.

Figure 47:
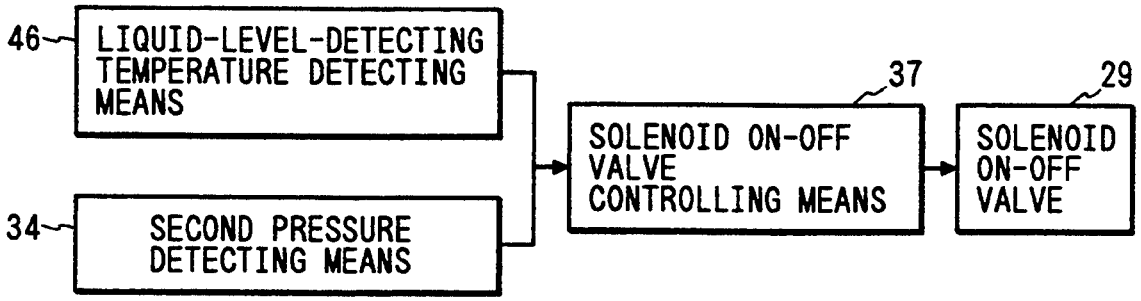
FIG. 47 is a control block diagram of the air conditioner in accordance with the 25th embodiment of the present invention.

FIG. 47 is a control block diagram of the air conditioner in accordance with the 25th embodiment of the present invention. In the drawing, reference numeral 37 denotes the solenoid on-off valve controlling device for calculating the degree of superheat for liquid-level detection on the basis of the temperature detected by the liquid-level-detecting temperature detecting device 46 and the pressure detected by the second pressure detecting device 34, and for controlling the opening and closing of the solenoid on-off valve 29 on the basis of that result.

Since the operation of the refrigerant (including lubricating oil) during the cooling and heating operations is utterly the same as that of the air conditioners in accordance with the 15th to 23th embodiments, description thereof will be omitted here, and a description will be given of the details of control by the solenoid on-off valve controlling device 37. When the first compressor 1 is started with both the first and second compressors 1 and 2 being stopped, the possibility of the liquid refrigerant becoming accumulated in the accumulator 15 is large, so that the solenoid on-off valve 29 is opened. While the liquid refrigerant is accumulated in the accumulator 15, the liquid level of the accumulator 15 is above one end of the liquid-level detecting circuit 44 connected to the accumulator 15, and the liquid refrigerant flows through the liquid-level detecting circuit 44. As a result, even if the liquid refrigerant flowing through the liquid-level detecting circuit 44 is heated by the heating device, the liquid refrigerant passes through the outlet portion of the liquid-level detecting circuit 44 in the form of wet vapor or saturated vapor. Hence, the degree of superheat for liquid-level detection, which is calculated from the temperature detected by the temperature detected by the liquid-level-detecting temperature detecting device 46 and the pressure detected by the second pressure detecting device 34, is low. In a case where the liquid refrigerant is not present in the accumulator 15, since the vapor refrigerant, which flows through the liquid-level detecting circuit 44 while being heated by the heating device, passes through the outlet portion of the liquid-level detecting circuit 44 in the superheated state. Hence, the degree of superheat for liquid-level detection, which is calculated from the temperature detected by the temperature detected by the liquid-level-detecting temperature detecting device 46 and the pressure detected by the second pressure detecting device, is high. Therefore, in the case where the first compressor 1 is being operated and the second compressor 2 is being stopped, when the degree of superheat SHL for liquid-level detection reaches; a level greater than or equal to a set value $SHL_1$ of a liquid-level-detection superheat upper limit set in advance, it is judged that the liquid refrigerant has been removed from the accumulator 15, so that the solenoid on-off valve 29 is closed, making it possible to avoid the shortage of the cooling and heating capabilities caused by the bypassing of the refrigerant to the bypass passage 28. In addition, when SHL drops to a level less than or equal to a set value $SHL_2$ of a liquid-level-detection superheat lower limit set in advance, it is judged that the liquid refrigerant is accumulated again in the accumulator 15 due to the occurrence of excess refrigerant caused by a change in the operation mode (such as a change from the cooling operation to the heating operation) or the like. Hence, the solenoid on-off valve 29 is opened to supply the high-temperature gas refrigerant to the suction pipe 8 from the bypass passage 28, so as to control a decrease in the absolute quantity of the lubricating oil in the second compressor 2 and a decline in the concentration thereof. In addition, in the determination of the presence or absence of the accumulation of the liquid refrigerant in the accumulator 15, since the determination is made directly by device of the liquid-level detecting circuit 44, so that the determination is accurate.

Figure 48:
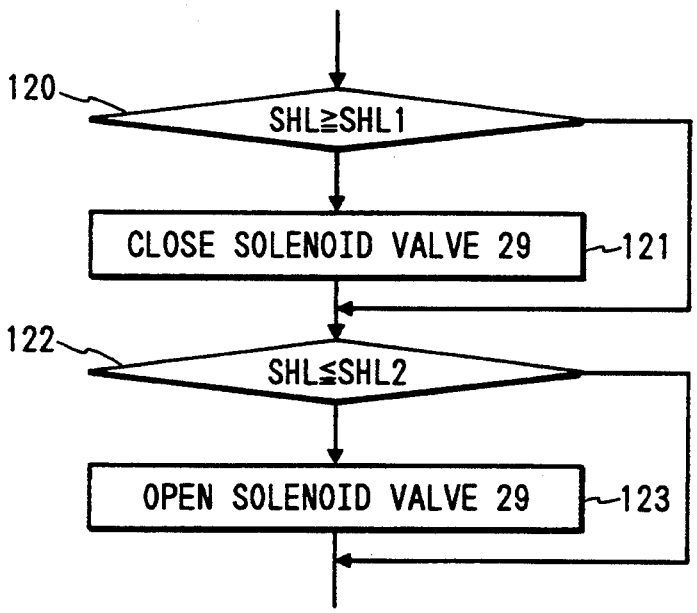
FIG. 48 is a flowchart illustrating details of control by the solenoid on-off valve controller of the air conditioner in accordance with the 25th embodiment of the present invention.

Referring now to the flowchart shown in FIG. 48, the details of control by the solenoid on-off valve controlling device 37 will be described in concrete terms. First, when the first compressor 1 is started with both the first and second compressors being stopped, the solenoid on-off valve 29 is opened. Then in Step 120 in FIG. 48, a determination is made as to whether or not the degree of superheat SHL for liquid-level detection is at a level greater than or equal to the set value $SHL_1$ of the liquid-level-detection superheat upper limit set in advance, and if $SHL \geqq SHL_1$, the operation proceeds to Step 121 to close the solenoid on-off valve 29, and then the operation proceeds to Step 122. Meanwhile, if $SHL < SHL_1$, the operation proceeds directly to Step 122. In Step 122, a determination is made as to whether or not the degree of superheat SHL for liquid-level detection is less than or equal to the set value $SHL_2$ of the liquid-level-detection superheat lower limit set in advance such that $SHL_2 < SHL_1$. If $SHL \leqq SHL_2$, the operation proceeds to Step 123 to open the solenoid on-off valve 29, and the operation returns to Step 120. Meanwhile, if $SHL > SHL_2$, the operation returns directly to Step 120. Since the solenoid on-off valve 29 is controlled in the above-described manner, in a case where the first compressor 1 is operated and the second compressor 2 is stopped, the solenoid on-off valve 29 is prevented from being opened when the liquid refrigerant is accumulated in the accumulator 15, which could unnecessarily result in the shortage of the cooling and heating capabilities. When the liquid refrigerant is accumulated in the accumulator 15, the solenoid on-off valve 29 is opened to supply the high-temperature gas refrigerant to the suction pipe 8, thereby controlling a decrease in the absolute quantity of the lubricating oil in the second compressor 2 and a decline in the concentration thereof.

26th Embodiment

Figure 49:
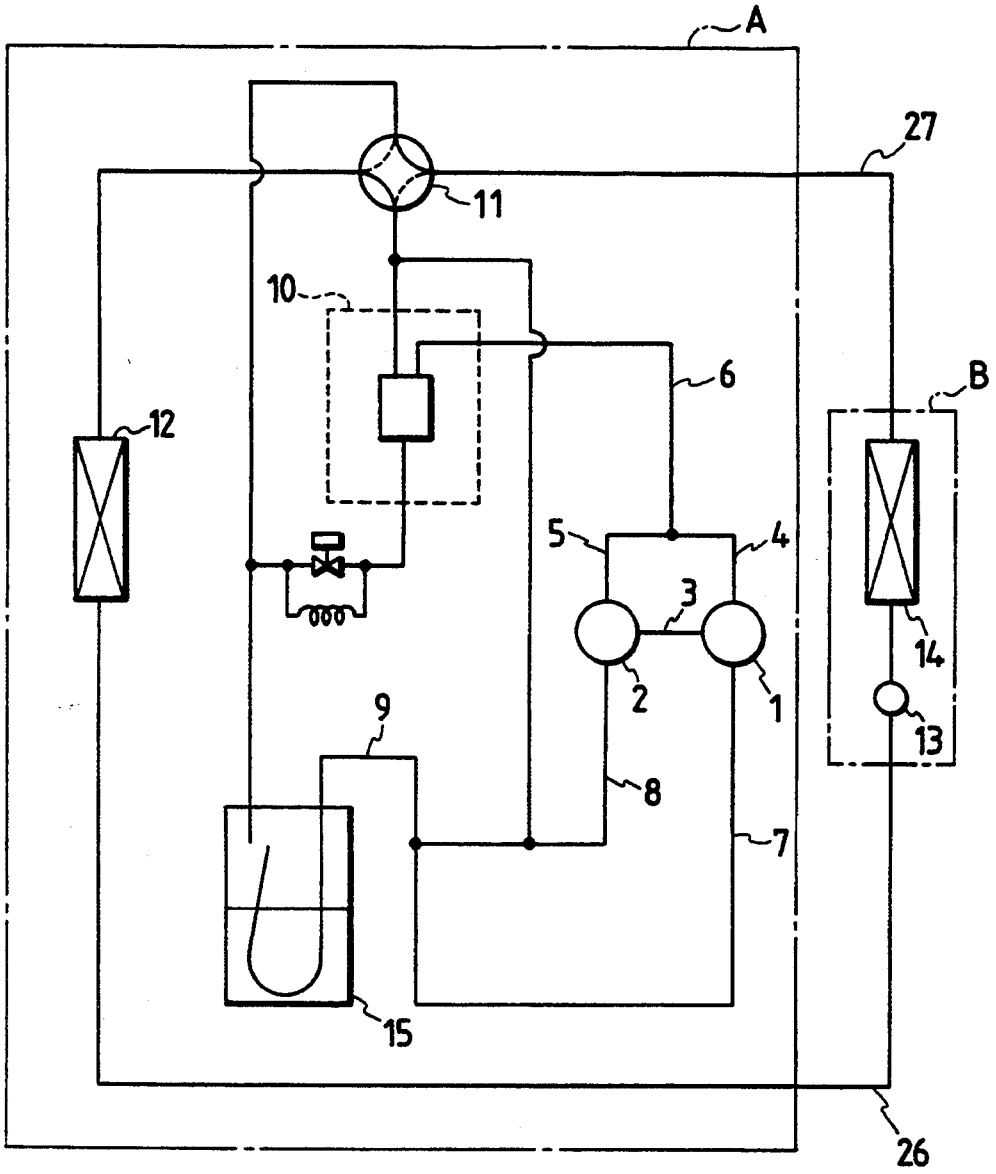
FIG. 49 is a refrigerant circuit diagram centering on the refrigerant system of an air conditioner in accordance with a 26th embodiment of the present invention.

Similar effects are obtained if the accumulator 15 is provided midway in the common suction pipe 9 in the 14th to 25th embodiments, as shown in FIG. 49.

Figure 50:
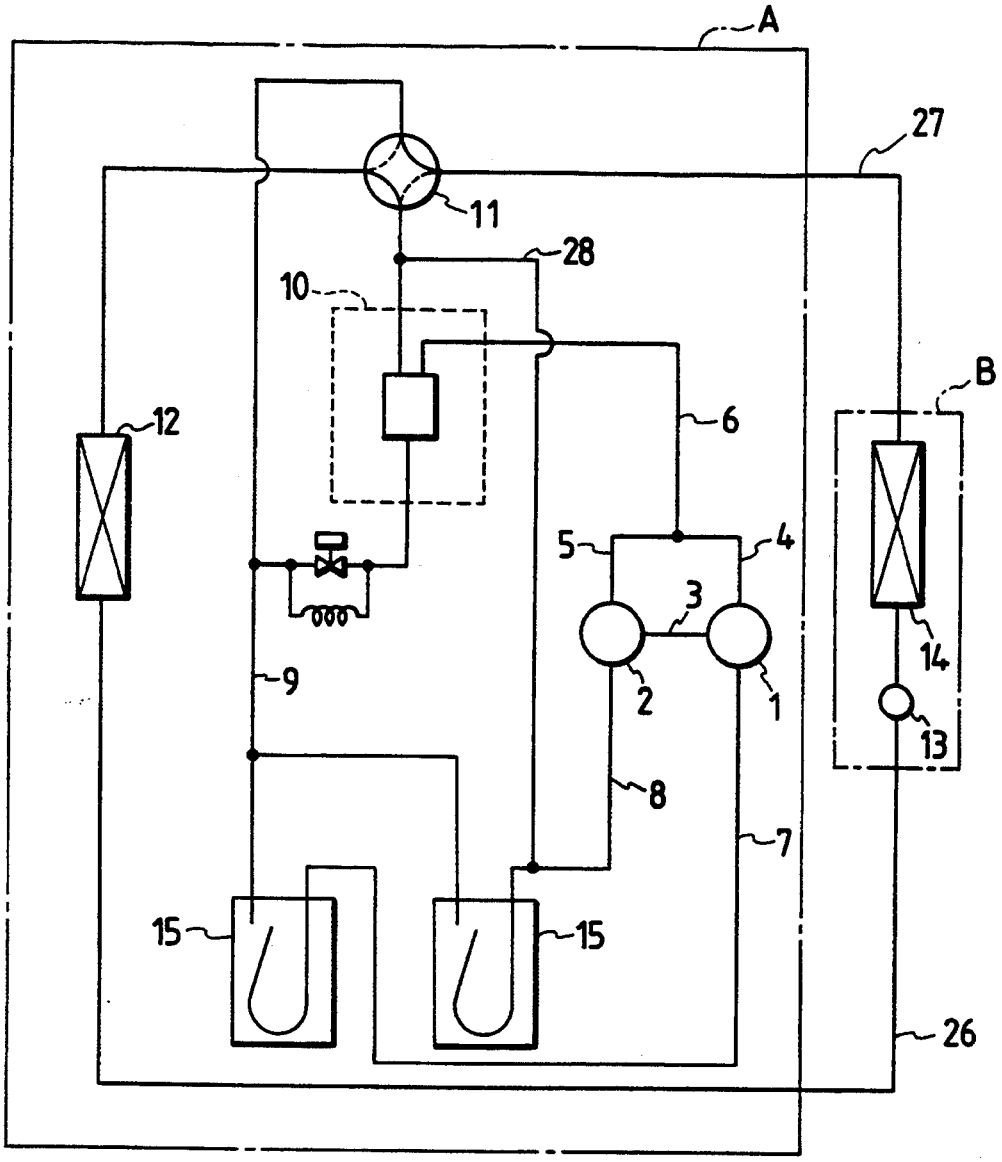
FIG. 50 is a refrigerant circuit diagram centering on the refrigerant system of an air conditioner in accordance with the 26th embodiment of the present invention.

In addition, similar effects are obtained if one accumulator 15 is provided midway in each of the suction pipe and the suction pipe 8 in the 14th to 25th embodiments, as shown in FIG. 50.

27th Embodiment

Figure 51:
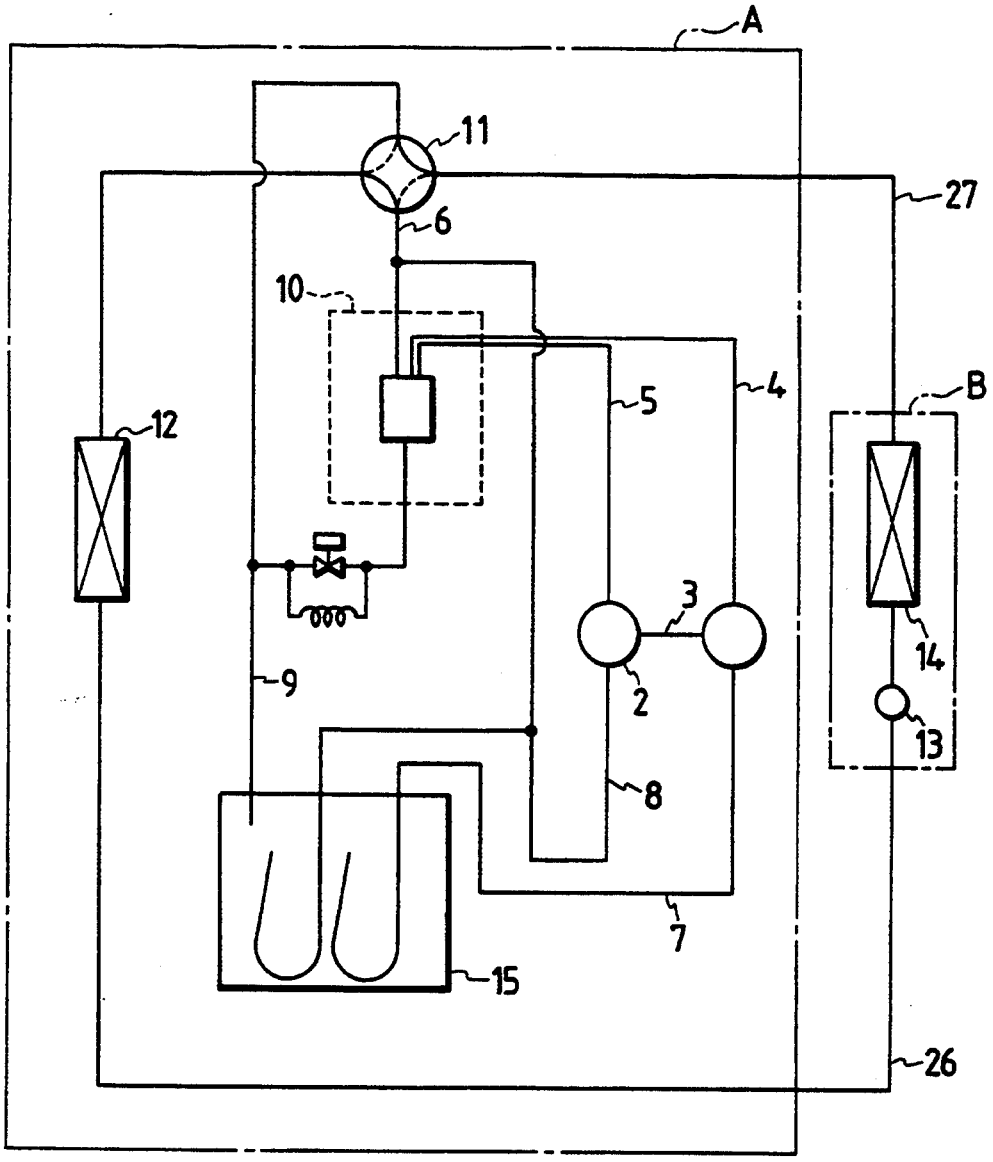
FIG. 51 is a refrigerant circuit diagram centering on the refrigerant system of an air conditioner in accordance with a 27th embodiment of the present invention.

Similar effects are obtained if, as shown in FIG. 51, the oil separator 10 is provided at a converging portion of the discharge pipe 4 and the discharge pipe 5 in the 14th to 26th embodiments.

Figure 52:
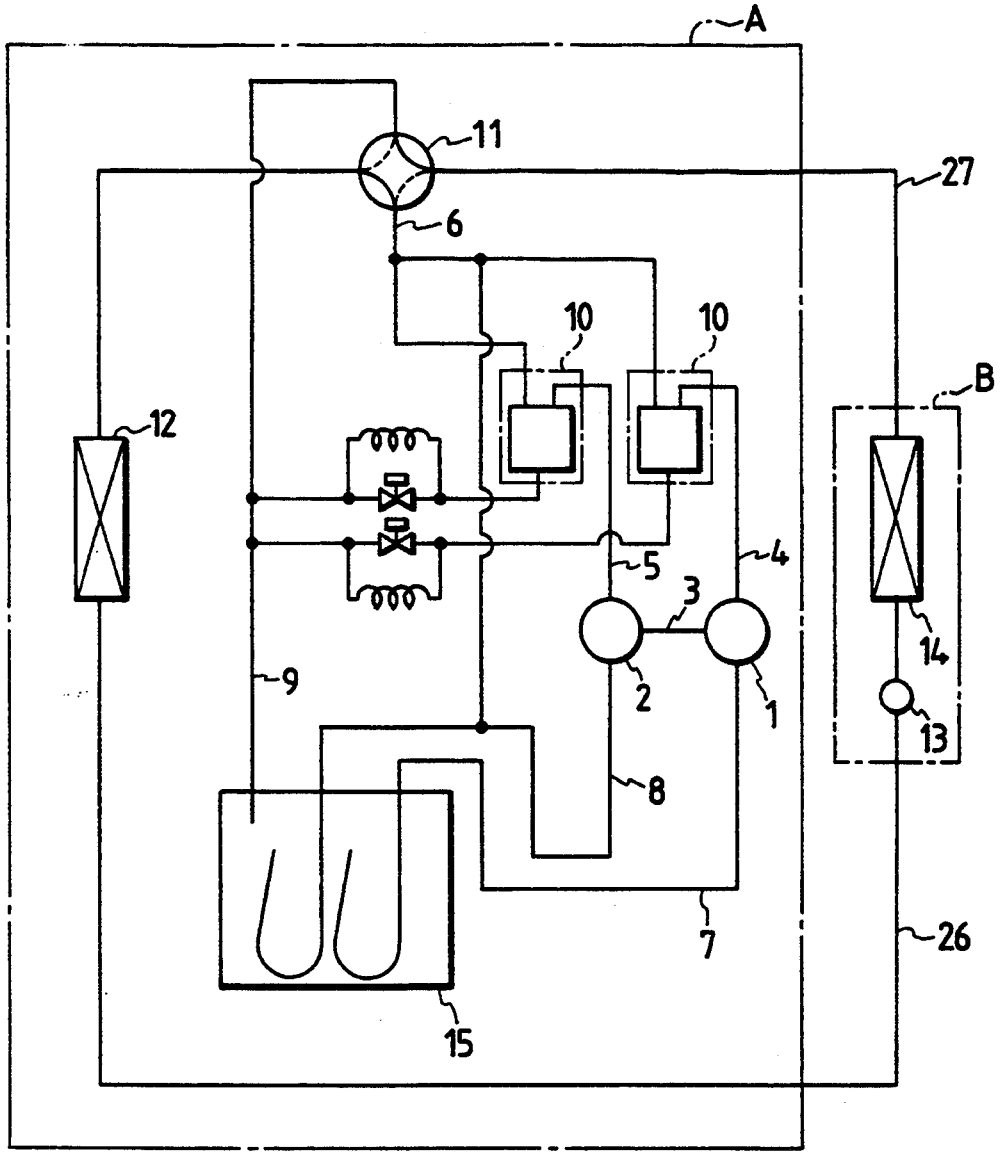
FIG. 52 is a refrigerant circuit diagram centering on the refrigerant system of an air conditioner in accordance with the 27th embodiment of the present invention.

In addition, similar effects are obtained if, as shown in FIG. 52, one oil separator 10 is provided midway in each of the discharge pipe 4 and the discharge pipe 5 in the 14th to 26th embodiments.

In accordance with the first aspect of the invention, in a case where the first compressor is started with the refrigerant being held up in the two compressors before turning on of the power, the concentration of the lubricating oil in the first compressor is low. However, since the mixed liquid of the refrigerant and the lubricating oil in the second compressor is supplied to the first compressor through the equalizing pipe while the second compressor is being stopped. Accordingly, even if some lubricating oil is discharged together with the refrigerant due to foaming caused by a decline in suction pressure during the starting of the first compressor, the lubricating oil does not run short, thereby making it possible to prevent the seizure of the bearing of the first compressor and remarkably enhancing the reliability of the air conditioner.

As for the first compressor, since its capacity during starting can be lowered by control of its capacity, the load on the bearing is relatively small, whereas in the case of a compressor in which the second compressor is started by commercial power supply, the load on the bearing becomes large. However, since a first predetermined time longer than a second predetermined time is provided, even if a large quantity of refrigerant is accumulated in the accumulator 209 at the time of starting, that quantity can be reduced sufficiently by the operation of the first compressor. Hence, a large quantity of wet vapor suction does not occur when the second compressor is started, so that a decline in the concentration of the lubricating oil or liquid compression do not occur, the burden on the bearing is reduced, and damage to the second compressor is prevented, thereby remarkably enhancing the reliability of the air conditioner.

In accordance with the second aspect of the invention, after the first compressor is started in a state in which the quantity of liquid being held up is large subsequent to the turning on of power, if the degree of superheat of the refrigerant discharged from the first compressor is detected, it is possible to ascertain the state in which the state of wet vapor suction has been overcome for the first compressor. Since the first compressor and the second compressor employ a common accumulator, even when the second compressor is started for the first time, wet vapor suction does not occur, and a decline in the concentration of the lubricating oil and liquid compression doe not occur. Consequently, damage to the second compressor is prevented, thereby remarkably enhancing the reliability of the air conditioner.

In accordance with the third aspect of the invention, in the state in which the refrigerant is held up, the concentration of the lubricating oil in the first compressor during starting is low, and the degree of superheat of the lubricating oil is also low. However, as the operation is continued, the concentration of the lubricating oil in the first compressor rises due to the return of oil from the accumulator, and the degree of superheat of the lubricating oil also rises. Hence, by detecting the degree of superheat of the lubricating oil in the first compressor being operated, the state of a high lubricating-oil concentration in the mixed liquid is ascertained, and the second compressor is started in this state. Consequently, it is possible to supply the mixed liquid of the refrigerant and the lubricating oil with a high lubricating-oil concentration from the first compressor to the second compressor through the equalizing pipe, and damage to the bearing of the second compressor due to a shortage of the lubricating oil can be prevented, thereby remarkably enhancing the reliability of the air conditioner.

In addition, since the concentration of the lubricating oil in the second compressor can be ascertained by detecting the degree of superheat of the lubricating oil in the second compressor, it is possible to cause the second compressor not to be started in the state in which the concentration of the lubricating oil is low. Hence, it is possible to prevent damage to the compressor due to the shortage of the lubricating oil during starting and wet vapor suction, thereby remarkably enhancing the reliability of the air conditioner.

In accordance with the fourth aspect of the invention, in the state in which the refrigerant is held up, the concentration of the lubricating oil in the first compressor during starting is low, and the evaporation of the liquid refrigerant such as foaming occurs during starting due to a temporary sudden drop in suction pressure, and the temperature of the mixed liquid declines. However, as the operation is continued, the suction pressure rises, and the temperature of the mixed liquid also rises. At the same time, the concentration of the lubricating oil in the first compressor rises due to the return of oil from the accumulator. Hence, by detecting the temperature of the mixed liquid in the first compressor, the state of a high lubricating-oil concentration is ascertained, and the second compressor is started in this state. Consequently, it is possible to supply the mixed liquid of a high concentration from the first compressor to the second compressor through the equalizing pipe, so that it is possible to prevent damage caused by the shortage of the lubricating oil when the second compressor is started, thereby remarkably enhancing the reliability of the air conditioner.

In addition, the second compressor being stopped communicates with the first compressor via the equalizing pipe, so that the second compressor similarly exhibits a pressure drop during the starting of the first compressor, and the temperature of the mixed liquid declines due to the evaporation of the refrigerant in the mixed liquid. However, when the state of operation of the first compressor becomes stable, the temperature of the mixed liquid in the second compressor also becomes stable. In such a stable state, the concentration of the lubricating oil in the first compressor has become high. Hence, by detecting the temperature of the mixed liquid in the second compressor, the state of a high lubricating-oil concentration in the first compressor is ascertained, and the second compressor is started in this state. By starting the second compressor in this state, it is possible to supply the mixed liquid of a high concentration from the first compressor to the second compressor through the equalizing pipe, so that it is possible to prevent damage caused by the shortage of the lubricating oil when the second compressor is started, thereby remarkably enhancing the reliability of the air conditioner.

In accordance with the fifth aspect of the invention, when the first compressor is first stopped, and the second compressor is started, the pressure difference across the equalizing pipe is large, and the suction pressure of the second compressor which was started is low. Hence, it is possible to supply through the equalizing pipe the mixed liquid of a high concentration from the first compressor which was stopped to the second compressor which was started, so that it is possible to prevent damage caused by the shortage of the lubricating oil when the second compressor is started, thereby remarkably enhancing the reliability of the air conditioner.

Then, as the second compressor is started, and the first compressor being stopped is restarted after the lapse of a predetermined time, the internal pressure of the shell of the restarted first compressor drops. Hence, and the difference between the internal pressures of the shells of the two compressors becomes small, with the result that the quantity of lubricating oil moving from the first compressor to the second compressor through the equalizing pipe decreases. Meanwhile, in a case where the running capacity of the restarted first compressor is larger than the running capacity of the second compressor, the suction pressure of the first compressor becomes lower than the suction pressure of the second compressor, so that the lubricating oil flows from the second compressor to the first compressor. Hence, the quantity of lubricating oil in the shell of the first compressor which was stopped does not drop more than is necessary. Therefore, it is possible to prevent the first compressor from being damaged by the shortage of the lubricating oil, thereby remarkably enhancing the reliability of the air conditioner.

In addition, since the lubricating oil is returned together with the refrigerant from the accumulator to the first compressor which was restarted after the lapse of a predetermined time after the first compressor was stopped while in operation, the quantity of lubricating oil in the shell of the first compressor does not drop more than is necessary. Therefore, it is possible to prevent the first compressor from being damaged by the shortage of the lubricating oil, thereby remarkably enhancing the reliability of the air conditioner.

In accordance with the sixth aspect of the invention, when the first compressor is first stopped, and the second compressor is started, the pressure difference across the equalizing pipe is large, and the suction pressure of the second compressor which was started is low. Hence, it is possible to supply through the equalizing pipe the mixed liquid of a high concentration from the first compressor which was stopped to the second compressor which was started, so that it is possible to prevent damage caused by the shortage of the lubricating oil when the second compressor is started, thereby remarkably enhancing the reliability of the air conditioner.

Then, by detecting the degree of superheat of the refrigerant discharged from the second compressor, the state in which the state of wet vapor suction of the second compressor has been overcome is ascertained. In this state, the first compressor being stopped is restarted, allowing the oil to be returned from the accumulator to the second compressor. As a result, the concentration of the lubricating oil in the second compressor does not run short. At the same time, the internal pressure of the shell of the restarted first compressor drops, so that the difference between the internal pressures of the shells of the two compressors becomes small, and the quantity of lubricating oil moving from the first compressor to the second compressor through the equalizing pipe also drops. Meanwhile, in a case where the running capacity of the restarted first compressor is larger than the running capacity of the second compressor, the suction pressure of the first compressor becomes lower than the suction pressure of the second compressor, so that the lubricating oil flows from the second compressor to the first compressor. Hence, the quantity of lubricating oil in the shell of the first compressor which was restarted does not drop more than is necessary. Therefore, it is possible to prevent the first compressor from being damaged by the shortage of the lubricating oil, thereby remarkably enhancing the reliability of the air conditioner.

In accordance with the seventh aspect of the invention, when the first compressor is first stopped, and the second compressor is started, the pressure difference across the equalizing pipe is large, and the suction pressure of the second compressor which was started is low. Hence, it is possible to supply through the equalizing pipe the mixed liquid of a high concentration from the first compressor which was stopped to the second compressor which was started, so that it is possible to prevent damage caused by the shortage of the lubricating oil when the second compressor is started, thereby remarkably enhancing the reliability of the air conditioner.

Then, by detecting the temperature of the refrigerant discharged from the second compressor, the state in which the state of wet vapor suction of the second compressor has been overcome is ascertained. In this state, the first compressor being stopped is restarted, allowing the oil to be returned from the accumulator to the second compressor. As a result, the concentration of the lubricating oil in the second compressor does not run short. At the same time, the internal pressure of the shell of the restarted first compressor drops, so that the difference between the internal pressures of the shells of the two compressors becomes small, and the quantity of lubricating oil moving from the first compressor to the second compressor through the equalizing pipe also drops. Meanwhile, in a case where the running capacity of the restarted first compressor is larger than the running capacity of the second compressor, the suction pressure of the first compressor becomes lower than the suction pressure of the second compressor, so that the lubricating oil flows from the second compressor to the first compressor. Hence, the quantity of lubricating oil in the shell of the first compressor which was restarted does not drop more than is necessary. Therefore, it is possible to prevent the first compressor from being damaged by the shortage of the lubricating oil, thereby remarkably enhancing the reliability of the air conditioner.

In accordance with the eighth aspect of the invention, when only the first compressor is being operated after the power is turned on, the liquid level of the first compressor is located at a position higher than the equalizing pipe partly due to the return of oil from the accumulator. However, ass for the second compressor which is being stopped, there is no return of oil from the accumulator, and the pressure within the compressor is higher than the pressure within the first compressor, so that the lubricating oil moves through the equalizing pipe. Hence, the second compressor is in a state in which its liquid level has been dropped to the height of the equalizing pipe. For this reason, by stopping the first compressor when the integrated operating time of the first compressor has reached a predetermined time, and its stoppage is continued for a predetermined time. Consequently the internal pressures of the two compressors are made identical, and oil is returned from the first compressor to the second compressor due to the difference between the level of the mixed liquid in the first compressor and the level of the mixed liquid in the second compressor. Thus, the shortage of the lubricating oil when the second compressor is started is overcome, and damage to the second compressor is prevented, thereby remarkably enhancing the reliability of the air conditioner.

In accordance with the ninth aspect of the invention, when the second compressor continues to be in a state of a non-operation for a long time after turning on of the power, by starting the second compressor, oil is returned from the accumulator, allowing a sufficient quantity of lubricating oil to be secured in the second compressor. Consequently, even if the second compressor thereafter continues to be in the state of non-operation, it is possible to prevent the second compressor from being damaged due to the shortage of the lubricating oil when the second compressor is started next, thereby remarkably enhancing the reliability of the air conditioner.

As described above, in accordance with the air conditioner according to the tenth aspect of the invention, since the bypass passage is provided which is branched off from the discharge pipe and is connected to the suction pipe of the second compressor, the refrigerant flowing through the bypass passage is always a high-temperature gas refrigerant, so that the high-temperature gas refrigerant is always supplied to the suction pipe of the second compressor. Accordingly, in a case where the first compressor 1 is being operated and the second compressor 2 is being stopped, even if the first compressor 1 is in a state of wet vapor suction, the gas refrigerant supplied from the bypass passage is sufficient in terms of the flow rate of the refrigerant supplied to the first compressor via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor is started, and the second compressor does not break.

As described above, in accordance with the air conditioner according to the eleventh aspect of the invention, since the high-temperature gas refrigerant is supplied to the suction pipe of the second compressor through the bypass passage, therefore, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor is started, and the second compressor does not break.

Also, there is an advantage in that in a case where the first compressor 1 ceases to be in the state of wet vapor suction and there is no need to open the bypass passage, the on-off valve is closed, with the result that the refrigerant is not bypassed to the bypass passage, thereby making it possible to avoid a shortage of the cooling and heating capabilities.

As described above, in accordance with the air conditioner according to the twelfth aspect of the invention, the bypass passage is provided which is branched off from the discharge pipe and is connected to the suction pipe of the second compressor, the on-off valve is provided midway in the bypass passage, and the on-off valve is opened only when the first compressor is operated and the second compressor is stopped, while the on-off valve is opened at other times. Accordingly, in a case where the first compressor 1 is being operated and the second compressor 2 is being stopped, even if the first compressor 1 is in a state of wet vapor suction, the refrigerant flowing through the bypass passage can always be made a high-temperature gas refrigerant by opening the on-off valve, so that the high-temperature gas refrigerant is always supplied to the suction pipe of the second compressor. At the same time, the gas refrigerant supplied from the bypass passage is sufficient in terms of the flow rate of the refrigerant supplied to the first compressor via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor is started, and the second compressor does not break.

Also, there is an advantage in that when both the first and second compressors are operated, the on-off valve is closed, with the result that the refrigerant is not bypassed to the bypass passage, thereby making it possible to avoid a shortage of the cooling and heating capabilities.

As described above, in accordance with the air conditioner according to the thirteenth aspect of the invention, the bypass passage is provided which is branched off from the discharge pipe and is connected to the suction pipe of the second compressor, the on-off valve is provided midway in the bypass passage, and a compressor-continuous-operation-time measuring device is provided which starts timing upon starting of the first compressor for counting a time of continuous operation of the first compressor. When the first compressor is operated and the second compressor is stopped, the on-off valve is opened at the time of starting the first compressor, and the on-off valve is closed when the time counted by the compressor-continuous-operation-time measuring device reaches a first set time set in advance. Accordingly, in a case where the first compressor is started with both the first and second compressors being stopped, the on-off valve is opened for a fixed period of time subsequent to starting. As a result, during the time when the first compressor 1 is in a temporary state of wet vapor suction after starting, the high-temperature gas refrigerant supplied from the bypass passage is sufficient is in terms of the flow rate of the refrigerant supplied to the first compressor via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, during the time when the first compressor 1 is in a temporary state of wet vapor suction after starting, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor is started, and the second compressor does not break.

In addition, there is an advantage in that since the on-off valve is closed after the lapse of a fixed period of time subsequent to starting, the refrigerant is not bypassed to the bypass passage after the temporary state of wet vapor suction subsequent to starting is overcome, thereby making it possible to avoid a shortage of the cooling and heating capabilities.

As described above, in accordance with the air conditioner according to the fourteenth aspect of the invention, the bypass passage is provided which is branched off from the discharge pipe and is connected to the suction pipe of the second compressor, the on-off valve is provided midway in the bypass passage, the compressor-continuous-operation-time measuring device is provided which starts timing upon starting of the first compressor for counting a time of continuous operation of the first compressor, and a compressors-continuous-stop-time measuring device is provided for counting a time when both the first and second compressors are being continuously stopped. When the first compressor is operated and the second compressor is stopped, the on-off valve is opened at the time of starting the first compressor, and the on-off valve is closed when the time counted by the compressor-continuous-operation-time measuring device reaches a first set time set in advance in a case where the time counted by the compressors-continuous-stop-time measuring device does not reach a second set time set in advance. In addition, the on-off valve is closed when the time counted by the compressor-continuous-operation-time measuring device reaches a third set time set in advance in such a manner as to be longer than the first set time in a case where the starting of the first compressor is a first starting after the turning on of the power or a starting in which the time counted by the compressor-continuous-operation-time measuring device reaches the second set time set in advance. Accordingly, in a case where the first compressor is started with both the first and second compressors being stopped for a short time, the on-off valve is opened for a fixed period of time subsequent to starting. As a result, during the time when the first compressor 1 is in a temporary state of wet vapor suction after starting, the high-temperature gas refrigerant supplied from the bypass passage is sufficient in terms of the flow rate of the refrigerant supplied to the first compressor via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, during the time when the first compressor 1 is in a temporary state of wet vapor suction after starting, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor is started, and the second compressor does not break.

In addition, there is an advantage in that since the on-off valve is closed after the lapse of a fixed period of time subsequent to starting, the refrigerant is not bypassed to the bypass passage after the temporary state of wet vapor suction subsequent to starting is overcome, thereby making it possible to avoid a shortage of the cooling and heating capabilities.

In addition, in a case where the first compressor is started with both the first and second compressors being stopped for a long time, the on-off valve is opened for a fixed and long period of time subsequent to starting. As a result, during the time when the first compressor 1 is in a temporary state of, but a long period of, wet vapor suction after starting with the liquid refrigerant being held up in the shell of the first compressor, the high-temperature gas refrigerant supplied from the bypass passage is sufficient in terms of the flow rate of the refrigerant supplied to the first compressor via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, during the time when the first compressor 1 is in a temporary state of, but a long period of, wet vapor suction after starting with the liquid refrigerant being held up in the shell of the first compressor, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

In addition, there is an advantage in that since the on-off valve is closed after the lapse of a fixed and long period of time subsequent to starting with the liquid refrigerant being held up in the shell of the first compressor, the refrigerant is not bypassed to the bypass passage after the temporary state of, but a long period of, wet vapor suction subsequent to starting with the liquid refrigerant being held up in the shell of the first compressor is overcome, thereby making it possible to avoid a shortage of the cooling and heating capabilities.

As described above, in accordance with the air conditioner according to the fifteenth aspect of the invention, the bypass passage is provided which is branched off from the discharge pipe and is connected to the suction pipe of the second compressor, the on-off valve is provided midway in the bypass passage, and a discharge-temperature detecting device is disposed on the discharge pipe of the first compressor, the common discharge pipe, or the converging portion of the discharge pipes of the first and second compressors. When the first compressor is operated and the second compressor is stopped, the on-off valve is opened at the time of starting the first compressor, the on-off valve is closed when the temperature detected by the discharge-temperature detecting device reaches a level greater than or equal to a set value of a discharge-temperature upper limit set in advance, and the on-off valve is opened when the temperature detected by the discharge-temperature detecting device drops to a level less than or equal to a set value of a discharge-temperature lower limit set in advance in such a manner as to be lower than the set value of the discharge-temperature upper limit. Accordingly, in a case where the first compressor 1 is being operated and the second compressor 2 is being stopped, even if the first compressor 1 is in a state of wet vapor suction, the refrigerant flowing through the bypass passage can always be made a high-temperature gas refrigerant by opening the on-off valve during the starting of the first compressor, so that the high-temperature gas refrigerant is always supplied to the suction pipe of the second compressor. At the same time, the gas refrigerant supplied from the bypass passage is sufficient in terms of the flow rate of the refrigerant supplied to the first compressor via the shell of the second compressor 2, so that the liquid refrigerant is prevented from flowing into the second compressor 2. In addition., should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

Also, there is an advantage in that when the stale of wet vapor suction is overcome with a resultant rise in the temperature detected by the discharge-temperature detecting device to a level greater than or equal to a set value of the discharge-temperature upper limit, the on-off valve is closed, with the result that the refrigerant is not bypassed to the bypass passage, thereby making it possible to avoid a shortage of the cooling and heating capabilities.

Then, when the state of wet vapor suction is resumed, the temperature detected by the discharge-temperature detecting device drops to a level less than or equal to the set value of the discharge-temperature lower limit. Hence, the on-off valve is opened, so that the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

As described above, in accordance with the air conditioner according to the sixteenth aspect of the invention, the bypass passage is provided which is branched off from the discharge pipe and is connected to the suction pipe of the second compressor 2, the on-off valve is provided midway in the bypass passage, and a discharge-temperature superheat detecting device is provided which is comprised of a first pressure detecting device and the discharge-temperature detecting device disposed on the discharge pipe of the first compressor 1, the common discharge pipe, or the converging portion of the discharge pipes of the first and second compressors. When the first compressor 1 is operated and the second compressor is stopped, the on-off valve is opened at the time of starting the first compressor 1, the on-off valve is closed when the degree of superheat detected by the discharge-temperature superheat detecting device reaches a level greater than or equal to a set value of a discharge-temperature superheat upper limit set in advance, and the on-off valve is opened when the degree of superheat detected by the discharge-temperature superheat detecting device drops to a level less than or equal to a set value of a discharge-temperature superheat lower limit set in advance in such a manner as to be lower than the set value of the discharge-temperature superheat upper limit. Accordingly, in a case where the first compressor 1 is being operated and the second compressor 2 is being stopped, even if the first compressor 1 is in a state of wet vapor suction, the refrigerant flowing through the bypass passage can always be made a high-temperature gas refrigerant by opening the on-off valve during the starting of the first compressor, so that the high-temperature gas refrigerant is always supplied to the suction pipe of the second compressor. At the same time, the gas refrigerant supplied from the bypass passage is sufficient in terms of the flow rate of the refrigerant supplied to the first compressor 1 via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

Also, there is an advantage in that when the state of wet vapor suction is overcome with a resultant rise in the degree of superheat detected by the discharge-temperature superheat detecting device to a level greater than or equal to a set value of the discharge-temperature superheat upper limit, the on-off valve is closed, with the result that the refrigerant is not bypassed to the bypass passage, thereby making it possible to avoid a shortage of the cooling and heating capabilities.

In addition, when the state of wet vapor suction has been overcome but the discharge gas temperature is low due to a low high-pressure level, the degree of superheat detected by the discharge-temperature superheat detecting device also rises. Hence, the on-off valve is closed, so that there is an advantage in that the refrigerant is not bypassed to the bypass passage, thereby making it possible to avoid a shortage of the cooling and heating capacities.

Also, when the state of wet vapor suction is resumed, the degree of superheat detected by the discharge-temperature superheat detecting device drops to a level less than or equal to the set value of the discharge-temperature superheat lower limit. Hence, the on-off valve is opened, so that the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor is started, and the second compressor 2 does not break.

As described above, in accordance with the air conditioner according to the seventeenth aspect of the invention, the bypass passage is provided which is branched off from the discharge pipe and is connected to the suction pipe of the second compressor, the on-off valve is provided midway in the bypass passage, and a shell-temperature detecting device is disposed on the shell of the first or second compressor. When the first compressor is operated and the second compressor 2 is stopped, the on-off valve is opened at the time of starting the first compressor 1, the on-off valve is closed when the temperature detected by the shell-temperature detecting device reaches a level greater than or equal to a set value of a shell-temperature upper limit set in advance, and the on-off valve is opened when the temperature detected by the shell-temperature detecting device drops to a level less than or equal to a set value of a shell-temperature lower limit set in advance in such a manner as to be lower than the set value of the shell-temperature upper limit. Accordingly, in a case where the first compressor 1 is being operated and the second compressor 2 is being stopped, even if the first compressor 1 is in a state of wet vapor suction, the refrigerant flowing through the bypass passage can always be made a high-temperature gas refrigerant by opening the on-off valve during the starting of the first compressor 1, so that the high-temperature gas refrigerant is always supplied to the suction pipe of the second compressor. At the same time, the gas refrigerant supplied from the bypass passage is sufficient in terms of the flow rate of the refrigerant supplied to the first compressor 1 via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

Also, there is an advantage in that when the state of wet vapor suction is overcome with a resultant rise in the temperature detected by the shell-temperature detecting device to a level greater than or equal to a set value of the shell temperature upper limit, the on-off valve is closed, with the result that the refrigerant is not bypassed to the bypass passage, thereby making it possible to avoid a shortage of the cooling and heating capabilities.

Then, when the state of wet vapor suction is resumed, the temperature detected by the shell-temperature detecting device drops to a level less than or equal to the set value of the shell-temperature lower limit. Hence, the on-off valve is opened, so that the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

Furthermore, since the state of wet vapor suction is detected by the temperature detected by the shell-temperature detecting device, there is an advantage in that it is possible to prevent an erroneous detection from being made, in a case where detection is made on the basis of the discharge gas temperature or the degree of superheat in the discharge gas temperature, that wet vapor suction has not occurred because the discharge gas temperature or the degree of superheat in the discharge gas temperature has risen even if wet vapor suction has occurred during high-compression-ratio operation, or that wet vapor suction has occurred because the discharge gas temperature or the degree of superheat in the discharge gas temperature has not risen even if wet vapor suction has not occurred during low-compression-ratio operation.

As described above, in accordance with the air conditioner according to the eighteenth aspect of the invention, the bypass passage is provided which is branched off from the discharge pipe and is connected to the suction pipe of the second compressor, the on-off valve is provided midway in the bypass passage, and a shell-temperature superheat detecting device is provided which is comprised of the shell-temperature detecting device disposed on the shell of the first or second compressor and a second pressure detecting device disposed in a suction-side refrigerant circuit of the first and second compressors. When the first compressor 1 is operated and the second compressor 2 is stopped, the on-off valve is opened at the time of starting the first compressor 1, the on-off valve is closed when the degree of superheat detected by the shell-temperature superheat detecting device reaches a level greater than or equal to a set value of a shell-temperature superheat upper limit set in advance, and the on-off valve is opened when the degree of superheat detected by the shell-temperature superheat detecting device drops to a level less than or equal to a set value of a shell-temperature superheat lower limit set in advance in such a manner as to be lower than the set value of the shell-temperature superheat upper limit. Accordingly, in a case where the first compressor 1 is being operated and the second compressor 2 is being stopped, even if the first compressor 1 is in a state of wet vapor suction, the refrigerant flowing through the bypass passage can always be made a high-temperature gas refrigerant by opening the on-off valve during the starting of the first compressor 1, so that the high-temperature gas refrigerant is always supplied to the suction pipe of the second compressor. At the same time, the gas refrigerant supplied from the bypass passage is sufficient in terms of the flow rate of the refrigerant supplied to the first compressor 1 via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

Also, there is an advantage in that when the state of wet vapor suction is overcome with a resultant rise in the degree of superheat detected by the shell-temperature superheat detecting device to a level greater than or equal to a set value of the shell-temperature superheat upper limit, the on-off valve is closed, with the result that the refrigerant is not bypassed to the bypass passage, thereby making it possible to avoid a shortage of the cooling and heating capabilities.

Then, when the state of wet vapor suction is resumed, the degree of superheat detected by the shell-temperature superheat detecting device drops to a level less than or equal to the set value of the shell-temperature superheat lower limit. Hence, the on-off valve is opened, so that the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

Furthermore, since the state of wet vapor suction is detected by the degree of superheat detected by the shell-temperature superheat detecting device, there is an advantage in that it is possible to prevent an erroneous detection from being made, in a case where detection is made on the basis of the discharge gas temperature or the degree of superheat in the discharge gas temperature, that wet vapor suction has not occurred because the discharge gas temperature or the degree of superheat in the discharge gas temperature has risen even if wet vapor suction has occurred during high-compression-ratio operation, or that wet vapor suction has occurred because the discharge gas temperature or the degree of superheat in the discharge gas temperature has not risen even if wet vapor suction has not occurred during low-compression-ratio operation.

In addition, since the state of wet vapor suction is detected by the degree of superheat detected by the shell-temperature superheat detecting device, there is an advantage in that more accurate detection is possible than detection based on the temperature detected by the shell-temperature detecting device, because correction based on pressure is added.

As described above, in accordance with the air conditioner according to the nineteenth aspect of the invention, the bypass passage is provided which is branched off from the discharge pipe and is connected to the suction pipe of the second compressor, and a flow-rate controlling device is provided midway in the bypass passage. Accordingly, in a case where the first compressor 1 is being operated and the second compressor 2 is being stopped, even if the first compressor 1 is in a state of wet vapor suction, the high-temperature gas refrigerant supplied from the bypass passage can be controlled to a necessary and sufficient quantity in terms of the flow rate of the refrigerant supplied to the first compressor 1 via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

In addition, since the gas refrigerant is not supplied to the bypass passage, there is an advantage in that the shortage of the cooling and heating capabilities can be controlled to a necessary minimum.

As described above, in accordance with the air conditioner according to the twentieth aspect of the invention, the bypass passage is provided which is branched off from the discharge pipe and is connected to the suction pipe of the second compressor, the flow-rate controlling device is provided midway in the bypass passage, a high-pressure detecting device is provided in the discharge pipe of the first compressor or the common discharge pipe, and the flow-rate controlling device is controlled in accordance with the pressure detected by the high-pressure detecting device. Accordingly, in a case where the first compressor 1 is being operated and the second compressor is being stopped, even if the first compressor 1 is in a state of wet vapor suction, the high-temperature gas refrigerant supplied from the bypass passage can be controlled to a necessary and sufficient quantity with respect to the high or low high-pressure level in terms of the flow rate of the refrigerant supplied to the first compressor 1 via the shell of the second compressor 2, so that the liquid refrigerant is prevented from flowing into the second compressor 2 even when the high-pressure level is low. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

In addition, since excess gas refrigerant is not supplied to the bypass passage even when the high-pressure level is high, there is an advantage in that the shortage of the cooling and heating capabilities can be controlled to a necessary minimum.

As described above, in accordance with the air conditioner according to the twenty-first aspect of the invention, the bypass passage is provided which is branched off from the discharge pipe and is connected to the suction pipe of the second compressor, the flow-rate controlling device is provided midway in the bypass passage, a high-pressure detecting device is provided in the discharge pipe of the first compressor or the common discharge pipe, and the flow-rate controlling device is controlled in accordance with the running capacity of the first compressor 1. Accordingly, in a case where the first compressor 1 is being operated and the second compressor is being stopped, even if the first compressor 1 is in a state of wet vapor suction, the high-temperature gas refrigerant supplied from the bypass passage can be controlled to a necessary and sufficient quantity in accordance with the running capacity of the first compressor 1 in terms of the flow rate of the refrigerant supplied to the first compressor 1 via the shell of the second compressor 2, so that the liquid refrigerant is prevented from flowing into the second compressor 2 even when the running capacity of the first compressor 1 is large. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

In addition, since excess gas refrigerant is not supplied to the bypass passage even when the running capacity of the first compressor 1 is small, there is an advantage in that the shortage of the cooling and heating capabilities can be controlled to a necessary minimum.

As described above, in accordance with the air conditioner according to the twenty-second aspect of the invention, the bypass passage is provided which is branched off from the discharge pipe and is connected to the suction pipe of the second compressor; the on-off valve is provided midway in the bypass passage a liquid-level detecting circuit is provided which has one end communicating with a lower end inside the accumulator and another end connected to a discharge pipe of the accumulator; a heating device is provided which heats the liquid-level detecting circuit and has a heating capacity falling within a range for heating the liquid-level detecting circuit so as to produce superheat vapor when wet vapor or saturated vapor flows through the liquid-level detecting circuit, or wet vapor or saturated vapor when the liquid refrigerant flows therethrough; a liquid-level-detecting temperature detecting device is provided at an outlet of the liquid-level detecting circuit; and a low-pressure detecting device is disposed in a suction pipe of the first compressor, the suction pipe of the second compressor, or a common suction pipe of the first and second compressors. When the first compressor is operated and the second compressor is stopped, the on-off valve is closed when the degree of superheat for liquid-level detection calculated from the temperature detected by the liquid-level-detecting temperature detecting device and the pressure detected by the low-pressure detecting device is greater than a liquid-level-detection superheat upper limit value set in advance, and the on-off valve is opened when the degree of superheat for liquid-level detection is less than a liquid-level-detection superheat lower limit value set in advance in such a manner as to be lower than the liquid-level-detection superheat upper limit value. Accordingly, in a case where the first compressor 1 is being operated and the second compressor 2 is being stopped, even if the first compressor 1 is in a state of wet vapor suction, the refrigerant flowing through the bypass passage can always be made a high-temperature gas refrigerant by opening the on-off valve during the starting of the first compressor 1, so that the high-temperature gas refrigerant is always supplied to the suction pipe of the second compressor. At the same time, the gas refrigerant supplied from the bypass passage is sufficient in terms of the flow rate of the refrigerant supplied to the first compressor 1 via the shell of the second compressor 2, so that the liquid refrigerant is prevented from flowing into the second compressor 2. In addition, should the liquid refrigerant flow into the suction pipe, the liquid refrigerant is evaporated by the high-temperature gas refrigerant supplied from the bypass passage, so that the liquid refrigerant is prevented from flowing into the second compressor 2. Thus, in the case where the first compressor 1 is being operated and the second compressor 2 is being stopped, even if the first compressor 1 is in the state of wet vapor suction, the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

Also, there is an advantage in that when the state of wet vapor suction is overcome with a resultant rise in the degree of superheat for liquid-level detection to a level greater than or equal to the set value of the liquid-level-detection superheat upper limit, the on-off valve is closed, with the result that the refrigerant is not bypassed to the bypass passage, thereby making it possible to avoid a shortage of the cooling and heating capabilities.

Then, when the state of wet vapor suction is resumed, the degree of superheat for liquid-level detection drops to a level less than or equal to the set value of the liquid-level-detection superheat lower limit. Hence, the on-off valve is opened, so that the absolute quantity of the lubricating oil in the second compressor 2 does not decrease, and the concentration of the lubricating oil does not decline. Therefore, it is possible to obtain high reliability whereby a shortage of the lubricating oil or faulty lubrication due to such as the lack of viscosity of the lubricating oil do not occur when the second compressor 2 is started, and the second compressor 2 does not break.

In addition, since the state of wet vapor suction directly detected by the liquid-level detecting circuit, there is an advantage in that more accurate detection is possible.

What is claimed is:

1. An air conditioner including a refrigeration circuit having a first compressor of a low-pressure shell type which is always operated when only one of two units is operated; a second compressor of a low-pressure shell type which is stopped when only one of the two units is operated, the first compressor and the second compressor being connected in parallel; an equalizing pipe connecting together shells of said first and second compressors; a heat source unit-side heat exchanger; a throttling device; and an indoor-side heat exchanger, said air conditioner comprising:

a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor.

2. An air conditioner according to claim 1, further comprising an on-off valve disposed midway in said bypass passage.

3. An air conditioner according to claim 2, wherein said on-off valve is opened only when the first compressor is operated and the second compressor is stopped, and the on-off valve is closed at other times.

4. An air conditioner according to claim 2, further comprising:

an oil separator which is disposed at one of where in the discharge pipe of the first compressor, the converging portion of the discharge pipes of the first and second compressors, and the common discharge pipe located after convergence of the discharge pipes of the first and second compressors, said oil separator having an inlet pipe, an outlet pipe, and an oil return pipe; and a compressor-continuous-operation-time measuring means which starts timing upon starting of the first compressor for counting a time of continuous operation of the first compressor, wherein when the first compressor is operated and the second compressor is stopped, the on-off valve is opened at the time of starting the first compressor, and the on-off valve is closed when the time counted by the compressor-continuous-operation-time measuring means reaches a first set time set in advance.

5. An air conditioner according to claim 2, further comprising:

an oil separator which is disposed at one of where in the discharge pipe of the first compressor, the converging portion of the discharge pipes of the first and second compressors, and the common discharge pipe located after convergence of the discharge pipes of the first and second compressors, said oil separator having an inlet pipe, an outlet pipe, and an return pipe;

a compressor-continuous-operation-time measuring means which starts timing upon starting of the first compressor for counting a time of continuous operation of the first compressor; and a compressors-continuous-stop-time measuring means for counting a time when both the first and second compressors are being continuously stopped, wherein when the first compressor is operated and the second compressor is stopped, the on-off valve is opened at the time of starting the first compressor, the on-off valve is closed when the time counted by the compressor-continuous-operation-time measuring means reaches a first set time set in advance in a case where the time counted by the compressors-continuous-stop-time measuring means does not reach a second set time set in advance, and the on-off valve is closed when the time counted by the compressor-continuous-operation-time measuring means reaches a third set time set in advance in such a manner as to be longer than the first set time in a case where the starting of the first compressor is a first starting after the turning on of the power or a starting in which the time counted by the compressor-continuous-operation-time measuring means reaches the second set time set in advance.

6. An air conditioner according to claim 2, further comprising:

an oil separator which is disposed at one of where in the discharge pipe of the first compressor, the converging portion of the discharge pipes of the first and second compressors; and the common discharge pipe located after convergence of the discharge pipes of the first and second compressors, said oil separator having an inlet pipe, an outlet pipe, and an oil return pipe; and a discharge-temperature detecting means disposed on the discharge pipe of the first compressor, the common discharge pipe, or the converging portion of the discharge pipes of the first and second compressors, wherein when the first compressor is operated and the second compressor is stopped, the on-off valve is opened at the time of starting the first compressor, the on-off valve is closed when a temperature detected by the discharge-temperature detecting means reaches a level greater than or equal to a set value of a discharge-temperature upper limit set in advance, and the on-off valve is opened when the temperature detected by the discharge-temperature detecting means drops to a level less than or equal to a set value of a discharge-temperature lower limit set in advance in such a manner as to be lower than the set value of the discharge-temperature upper limit.

7. An air conditioner according to claim 2, further comprising:

an oil separator which is disposed at one of where in the converging portion of the discharge pipes of the first and second compressors or the common discharge pipe located after convergence of the discharge pipes of the first and second compressors and has an inlet pipe, an outlet pipe, and an oil return pipe; and a discharge-temperature superheat detecting means which is comprised of a discharge-temperature detecting means disposed on the discharge pipe of the first compressor, the common discharge pipe, or the converging portion of the discharge pipes of the first and second compressors and of a first pressure detecting means disposed in a discharge-side refrigerant circuit of the first and second compressors, wherein when the first compressor is operated and the second compressor is stopped, the on-off valve is opened at the time of starting the first compressor, the on-off valve is closed when a degree of superheat detected by the discharge-temperature superheat detecting means reaches a level greater than or equal to a set value of a discharge-temperature superheat upper limit set in advance, and the on-off valve is opened when the degree of superheat detected by the discharge-temperature superheat detecting means drops to a level less than or equal to a set value of a discharge-temperature superheat lower limit set in advance in such a manner as to be lower than the set value of the discharge-temperature superheat upper limit.

8. An air conditioner according to claim 2, further comprising:

an oil separator which is disposed at one of where in the discharge pipe of the first compressor, the converging portion of the discharge pipes of the first and second compressors, and the common discharge pipe located after convergence of the discharge pipes of the first and second compressors, said oil separator having an inlet pipe, an outlet pipe, and an oil return pipe; and a shell-temperature detecting means disposed on a shell of the first or second compressor, wherein when the first compressor is operated and the second compressor is stopped, the on-off valve is opened at the time of starting the first compressor, the on-off valve is closed when a temperature detected by the shell-temperature detecting means reaches a level greater than or equal to a value of a shell-temperature upper limit set in advance, and the on-off valve is opened when the temperature detected by the shell-temperature detecting means drops to a level less than or equal to a set value of a shell-temperature lower limit set in advance in such a manner as to be lower than the set value of the shell-temperature upper limit.

9. An air conditioner according to claim 2, further comprising:

an oil separator which is disposed at one of where in the discharge pipe of the first compressor, the converging portion of the discharge pipes of the first and second compressors, and the common discharge pipe located after convergence of the discharge pipes of the first and second compressors, said oil separator having an inlet pipe, an outlet pipe, and an oil return pipe; and a shell-temperature superheat detecting means which is comprised of a shell-temperature detecting means disposed on a shell of the first or second compressor and a second pressure detecting means disposed in a suction-side refrigerant circuit of the first and second compressors, wherein when the first compressor is operated and the second compressor is stopped, the on-off valve is opened at the time of starting the first compressor, the on-off valve is closed when a degree of superheat detected by the shell-temperature superheat detecting means reaches a level greater than or equal to a value of a shell-temperature superheat upper limit set in advance, and the on-off valve is opened when the degree of superheat detected by the shell-temperature superheat detecting means drops to a level less than or equal to a set value of a shell-temperature superheat lower limit set in advance in such a manner as to be lower than the set value of the shell-temperature superheat upper limit.

10. An air conditioner according to claim 1, wherein a flow-rate controlling device is provided midway in the bypass passage.

11. An air conditioner according to claim 10, wherein further comprising:

a high-pressure detecting means disposed in the discharge pipe of the first compressor or the common discharge pipe, wherein said flow-rate controlling device is controlled in accordance with a pressure detected by the high-pressure detecting means.

12. An air conditioner according to claim 10, wherein said first compressor is a compressor whose running capacity is controllable, and the flow-rate controlling device is controlled in accordance with the running capacity of the first compressor.

13. An air conditioner having a refrigeration circuit including a first compressor of a low-pressure shell type which is always operated when only one of two units is operated; a second compressor of a low-pressure shell type which is stopped when only one of the two units is operated, the first compressor and the second compressor being connected in parallel; an equalizing pipe connecting together shells of the first and second compressors; a heat source unit-side heat exchanger; a throttling device; an indoor-side heat exchanger; and an accumulator, said air conditioner comprising:

a bypass passage which branches off from a discharge pipe of the first compressor, a converging portion of discharge pipes of the first and second compressors, or a common discharge pipe located after convergence of the discharge pipes of the first and second compressors, and is connected to a suction pipe of the second compressor;

an on-off valve disposed midway in the bypass passage;

a liquid-level detecting circuit having one end communicating with a lower end inside the accumulator and another end connected to a discharge pipe of the accumulator;

a heating means for heating the liquid-level detecting circuit and having a heating capacity falling within a range for heating the liquid-level detecting circuit so as to produce superheat vapor when wet vapor or saturated vapor flows through the liquid-level detecting circuit, or wet vapor or saturated vapor when the liquid refrigerant flows therethrough;

a liquid-level temperature detecting means provided at an outlet of the liquid-level detecting circuit for detecting liquid-level; and a low-pressure detecting means disposed in a suction pipe of the first compressor, the suction pipe of the second compressor, or a common suction pipe of the first and second compressors, wherein when the first compressor is operated and the second compressor is stopped, the on-off valve is closed when a degree of superheat for liquid-level detection calculated from a temperature detected by the liquid-level-detecting temperature detecting means and a pressure detected by the low-pressure detecting means is greater than a liquid-level-detection superheat upper limit value set in advance, and the on-off valve is opened when the degree of superheat for liquid-level detection is less than a liquid-level-detection superheat lower limit value set in advance in such a manner as to be lower than the liquid-level-detection superheat upper limit value.

* * * * *